United States Patent [19]

Ishikawa et al.

[11] Patent Number: 5,006,438

[45] Date of Patent: Apr. 9, 1991

[54] PROCESS FOR PROCESSING SILVER HALIDE COLOR PHOTOGRAPHIC MATERIALS

[75] Inventors: Takatoshi Ishikawa; Makoto Umemoto; Nobuo Sakai; Genichi Furusawa, all of Kanagawa, Japan

[73] Assignee: Fuji Photo Film Co., Ltd., Kanagawa, Japan

[21] Appl. No.: 518,266

[22] Filed: May 3, 1990

Related U.S. Application Data

[63] Continuation of Ser. No. 308,595, Feb. 10, 1989, abandoned.

[30] Foreign Application Priority Data

Feb. 10, 1988 [JP] Japan ..... 63-29621

[51] Int. Cl.[5] ..... G03C 7/00

[52] U.S. Cl. ..... 430/372; 430/380; 430/436; 430/450; 430/466; 430/467; 430/490; 430/551

[58] Field of Search ..... 430/372, 380, 436, 450, 430/466, 467, 490, 551

[56] References Cited

U.S. PATENT DOCUMENTS

| | | | |
|---|---|---|---|
| 4,232,113 | 11/1980 | Marchesano | 430/450 |
| 4,690,885 | 9/1987 | Yagihara et al. | 430/212 |
| 4,704,350 | 11/1987 | Moriaki et al. | 430/546 |
| 4,741,994 | 5/1988 | Ichijima et al. | 430/549 |
| 4,778,743 | 10/1988 | Ishikawa et al. | 430/376 |

FOREIGN PATENT DOCUMENTS

| | | |
|---|---|---|
| 0255722 | 2/1988 | European Pat. Off. . |
| 0258662 | 9/1988 | European Pat. Off. . |
| 2394113 | 1/1979 | France . |
| 2016723 | 9/1979 | United Kingdom . |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A process for processing a silver halide color photographic material is disclosed which comprises processing a silver halide color photographic material containing at least one compound represented by formula (I) or (II):

$$R_1-(A)_n-X \quad (I)$$

$$R_2-\underset{\underset{B}{|}}{C}=Y \quad (II)$$

wherein $R_1$ and $R_2$ each represents an aliphatic group, an aromatic group, or a heterocyclic group; A represents a group forming a chemical bond by reaction with an aromatic primary amine color developing agent; n represents 0 or 1; X represents a group released on reaction with an aromatic primary amine color developing agent; B represents a hydrogen atom, an aliphatic group, an aromatic group, a heterocyclic group, an acyl group, or a sulfonyl group; and Y represents a group accelerating the addition of an aromatic primary amine color developing agent to the compound of formula (II), and said $R_1$ and X or said Y and $R_2$ or B may combine with each other to form a ring, with a color developer prepared by diluting a concentrated color developer composition containing from 90 ml/liter to 600 ml/liter of benzyl alcohol and from 0.07 mol/liter to 0.5 mol/liter of an aromatic primary amine color developing agent.

12 Claims, No Drawings

PROCESS FOR PROCESSING SILVER HALIDE COLOR PHOTOGRAPHIC MATERIALS

This is a Continuation of application Ser. No. 07/308,595 filed Feb. 10, 1989 now abandon.

FIELD OF THE INVENTION

The present invention relates to a process for processing silver halide color photographic materials using a concentrated color developer composition. More particularly, the present invention relates to a process for processing silver halide color photographic materials using a concentrated color developer composition having excellent stability, where the processing gives color images having improved storage property.

BACKGROUND OF THE INVENTION

In general, a color developer for a silver halide color photographic material is a concentrated composition in order to reduce the cost of transportation thereof, to facilitate handling thereof, and to reduce the cost of packaging materials, and such is diluted with water at use.

Also, a concentrated color developer composition is split into few parts, each a concentrated component, to facilitate the concentration and to improve the stability of each component as described in U.S. Pat. Nos. 3,615,572, 3,814,606, 3,574,619, 4,501,812 and 4,232,113, JP-A-61-264343 and JP-A-51-26543 (the term "JP-A" as used herein refers to a "published unexamined Japanese patent application").

A conventional concentrated color developer composition for color prints is generally split into four concentrated parts comprising an alkali agent, a preservative, benzyl alcohol, and a color developing agent, respectively, as each main component. However, recently, for the purpose of reducing cost, a three-part construction of the concentrated color developer composition has been employed by combining benzyl alcohol and a color developing agent in a same part.

However, it has been found that in the case of three part constitution, benzyl alcohol reacts with the color developing agent in the part where both components are present to form compounds reducing the storage stability of images formed, which results in greatly reducing the storage stability of the images obtained by processing color photographic materials.

As an example of such a reaction, a presumptive reaction mechanism of benzyl alcohol and a color developing agent (CD-3) is shown below.

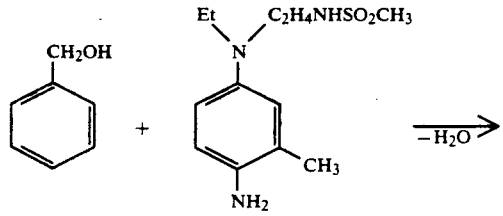

-continued

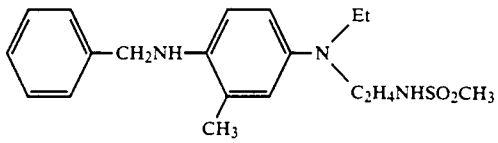

Compound A

SUMMARY OF THE INVENTION

An object of the present invention is to provide a process for processing silver halide color photographic materials using the concentrated color developer composition.

More specifically, an object of the present invention is to provide a process for processing silver halide color photographic materials using a concentrated color developer composition which is inexpensive and has excellent stability, this processing giving color images having improved storage stability.

It has now been discovered that the aforesaid objects are attained by the process of the present invention as shown below.

That is, the present invention provides a process for processing silver halide color photographic materials, which comprises processing a silver halide color photographic material containing at least one of the compounds represented by formula (I) or (II):

$$R_1-(A)_n-X \quad (I)$$

$$R_2-\underset{\underset{B}{|}}{C}=Y \quad (II)$$

wherein $R_1$ and $R_2$ each represents an aliphatic group, an aromatic group, or a heterocyclic group; A represents a group forming a chemical bond by reaction with an aromatic primary amine color developing agent; X represents a group released on reaction with an aromatic primary amine color developing agent; n represents 0 or 1; B represents a hydrogen atom, an aliphatic group, an aromatic group, a heterocyclic group, an acyl group, or a sulfonyl group; and Y represents a group accelerating the addition of an aromatic primary amine color developing agent to the compound of formula (II); said $R_1$ and X and said Y and $R_2$ or B may combine with each other to form a cyclic structure, with a color developer prepared by diluting a condensed color developer composition containing from 90 ml/liter to 600 ml/liter of benzyl alcohol and 0.07 mol/liter to 0.5 mol/liter of an aromatic primary amine color developing agent.

The typical reactions for chemical bonding with a residual aromatic amino color developing agent are a displacement reaction and an addition reaction.

DETAILED DESCRIPTION OF THE INVENTION

The concentrated developer composition for silver halide color photographic materials is a color developer concentrated for reducing the cost on transportation of the color developer, facilitating handling of the developer, and reducing the cost of the packaging material, and is split into three or four different component parts for facilitating the concentration and improving the stability of each concentrate. At use, the aforesaid three part or four part compositions are mixed and diluted with water and used as a color developer for silver halide color photographic materials.

The concentrated color developer composition for silver halide color photographic material, which is used in the process of the present invention, is the aforesaid concentrated part containing benzyl alcohol and an aromatic primary amine color developing agent as the main components and is used together with other concentrated parts after being diluted with water.

The concentration ratio of the concentrated composition used in the present invention is generally from 5 to 30 times, and preferably from about 10 to 30 times, and preferably from about 10 to 30 times the concentration. If the concentration ratio is higher than the aforesaid range, the solubility of the components is reduced and the components tend to deposit at low temperature, and if the concentration ratio is lower than 5 times, the utilization for cost is less and the handling property is lowered.

The concentration of benzyl alcohol in the present invention is from 90 ml/liter to 600 ml/liter, and preferably from 250 ml/liter to 550 ml/liter, and the concentration of the aromatic amine color developing agent in the present invention is from 0.07 mol/liter to 0.5 mol/liter, and preferably from 0.15 mol/liter to 0.45 mol/liter. If the concentrations of benzyl alcohol and the color developing agent are higher than the aforesaid ranges, the components dissolve with difficulty and even if they are dissolved, the amount of Compound A described above which is formed is undesirably increased. Also, if the concentrations are lower than the aforesaid ranges, the profitability becomes less and the handling property is also reduced.

Typical examples of the aromatic primary amine color developing agent for use in the present invention are illustrated below but the present invention is not limited to them.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl-)amino]aniline
D-6: 4-Amino-3-methyl-N-ethyl-N-[β-(methanesulfonamido)ethyl]aniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-β-methoxyethylaniline
D-10: 4-Amino-3-methyl-N-ethyl-N-β-ethoxyethylaniline
D-11: 4-Amino-3-methyl-N-ethyl-N-β-butoxyethylaniline Of the aforesaid p-phenylenediamine derivatives, 4-amino-3-methyl-N-ethyl-N-[β-(methanesulfonamido)ethyl]aniline (Compound D-6) is particularly preferred from the viewpoints of color hue and storage stability of color images formed.

Also, these p-phenylenediamine derivatives may be in the form of their salts such as sulfates, hydrochlorides, sulfites, p-toluenesulfonates, etc.

The pH of the condensed developer composition of the present invention for silver halide color photographic materials is in the range of generally from 0.1 to 5, and preferably from 1.0 to 4. The pH of an ordinary color developer is from 0.3 to 0.8 but in such a low pH range, the formation of Compound A described above is relatively large and the storage stability of images formed is sometimes reduced. Accordingly, the pH is preferably 1.0 or more. Also, if the pH is higher than 5, the color developing agent is greatly deteriorated in the case of storing the concentrated developer composition.

For a concentrated developer composition for silver halide color photographic materials, a sulfite for preventing the oxidation of the color developing agent is usually used. The concentration of the sulfite in the conventional concentrated developer composition is in the range of from 0.1 to 1.3, as a mol ratio, to the color developing agent. The concentrated developer composition in the present invention may contain a sulfite and the concentration of the sulfite is preferably from 0.4 to 1.0, and more preferably from 0.5 to 0.8. If the concentration of the sulfite is higher than 1.0, the sulfite dissolves with difficulty and adversely influences the photographic properties. Also, if the concentration thereof is lower than 0.4, the formation of the aforesaid Compound A becomes remarkable and thus greatly reduces the storage stability of color images formed.

Specific examples of sulfite for use in the present invention include sodium sulfite, potassium sulfite, sodium hydrogensulfite, potassium hydrogensulfite, sodium metasulfite, and potassium metasulfite.

It is preferred that the concentrated developer composition of the present invention for silver halide color photographic materials contains an alkanolamine and/or a glycol for dissolving benzyl alcohol at a high concentration. The content thereof is preferably from 70 ml/liter to 400 ml/liter.

Specific examples of preferred alkanolamines and glycols are monoethanolamine, diethanolamine, triethanolamine, ethylene glycol, diethylene glycol, and triethylene glycol. In these compounds, triethanolamine and diethylene glycol are particularly preferred.

Furthermore, the concentrated color developer composition of the present invention can contain, if desired, a chelating agent.

As the chelating agent, an organic acid compound is preferred and examples thereof include aminopolycarboxylic acid described in JP-B-48-30496 and JP-B-44-30232 (the term "JP-B" as used herein refers to an "examined Japanese patent publication"), organic phosphonic acids described in JP-A-56-97347, JP-B-56-39359, and West German Patent 2,227,639, phosphonocarboxylic acids described in JP-A-52-102726, JP-A-53-42730, JP-A-54-121127, JP-A-55-126241, and JP-A-55-659506, and the compounds described in JP-A-58-195845, JP-A-58-203440, and JP-B-53-40900.

Specific examples thereof are illustrated below but the present invention is not limited to them.

That is, they include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraphosphonic acid, 1,2-diaminopropanetetraacetic acid, glycol ether diaminetetraacetic acid, ethylenediamineorthohydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

These chelating agents may be used alone or as a mixture thereof.

The addition amount of the chelating agent may be that sufficient for blocking metal ions in the color developer.

The concentrated color developer composition for use in the present invention can, if desired, contain an optical whitening agent such as 4,4'-diamino-2,2'-disulfostilbene compounds.

Also, if desired, the concentrated color developer composition in the present invention may further contain various surface active agents such as alkylsulfonic acids, arylsulfonic acids, aliphatic carboxylic acids, aromatic carboxylic acids, etc.

The temperature for storing the concentrated color developer composition for silver halide color photographic materials in the present invention is preferably lower than room temperature, and particularly preferably from 0° C. to 10° C. If the storage temperature is higher than room temperature, the formation of the aforesaid Compound A becomes remarkable to reduce greatly the storage stability of color images formed. Also, a temperature lower than 0° C is undesirable from the viewpoint of precipitations of the components.

Furthermore, the color developer for silver halide color photographic materials when prepared for use by diluting the concentrated color developer composition in the present invention with water can, if desired, contain various additives.

Examples of preferred additives are compounds directly preserving the aforesaid color developing agents, such as various hydroxylamines, hydroxamic acids described in JP-A-63-43138, hydrazines or hydrazides described in EP-254280, phenols described in JP-A-63-44657 and JP-A-63-58443, α-hydroxyketones or α-aminoketones described in JP-A-63-44656, and various succharides described in JP-A-63-36244.

Also, it is preferred that the aforesaid additives are used together with monoamines described in JP-A-63-4235, JP-A-63-24254, JP-A-63-21647, JP-A-63-146040, JP-A-63-27841 and JP-A-63-25654, diamines described in JP-A-63-30845, JP-A-63-146040 and JP-A-63-43139, polyamines described in JP-A-63-21647 and JP-A-63-26655, polyamines described in JP-A-63-44655, nitroxy radicals described in JP-A-63-53551, alcohols described in JP-A-63-43140 and JP-A-63-53549, oximes described in JP-A-63-56654, or tertiary amines described in EP-266797.

Furthermore, the color developer may contain, if desired, preservatives such as various metals described in JP-A-57-44148 and JP-A-57-53749, salicylic acids described in JP-A-59-180588, alkanolamines described in JP-A-54-3532, polyethyleneimines described in JP-A-56-94349, and aromatic polyhydroxy compounds described in U.S. Pat. No. 3,746,544. It is particularly preferred to add aromatic polyhydroxy compounds, alkanolamines, or the compounds described in EP-266797 to the color developer.

The pH of the color developer diluted with water for use in the process of the present invention is preferably from 9 to 12, and more preferably from 9 to 11.0.

For keeping the aforesaid pH, it is preferred to use buffers such as carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, etc. In particular, carbonates, tetraborates, and hydroxybenzoates have excellent solubility and buffer faculty at a high pH range of 9.0 or higher, do not adversely influence (fog, etc.) the photographic performance when they are added to the color developer, and are inexpensive. Thus, the use of such buffers is particularly preferred.

Specific examples of these buffers are sodium carbonate, potassium carbonate, sodium hydrogencarbonate, potassium hydrogencarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-salicylate), and potassium 5-sulfo-2-hydroxybenzoate (sodium 5-sulfosalicylate).

The color developer for use in the present invention can, if desired, contain an optional development accelerator.

Examples of development accelerators include thioether series compounds described in JP-B-37-16088, JP-B-37-5987, JP-B-38-7826, JP-B-44-12380, JP-B-45-9019, U.S. Pat. No. 3,813,247, etc., p-phenylenediamine series compounds described in JP-A-52-49829 and JP-A-50-15554, quaternary ammonium salts described in JP-A-50-137726, JP-A-56-156826, and JP-A-52-43429, and JP-B-44-30074, amine series compounds described in U.S. Pat. Nos. 2,494,903, 3,128,182, 4,230,796, 3,253,919, 2,482,546, 2,596,926, and 3,582,346, and JP-B-41-11431, polyalkylene oxides described in U.S. Pat. Nos. 3,128,183 and 3,532,501, JP-B-37-16088, JP-B-42-25201, JP-B-42-23883, and JP-B-41-11431, 1-phenyl-3-pyrazolidones, and imidazoles.

The color developer for use in the present invention may further, if desired, contain an optional antifoggant. Examples of antifoggants include alkali metal halides such as sodium chloride, potassium bromide, potassium iodide, etc., and organic antifoggants such as nitrogen-containing heterocyclic compounds (e.g., benzotriazoles, 6-nitrobenzimidazole, 5-nitroindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, and adenine).

The processing temperature for the color developer in the present invention is generally from 20° C. to 50° C., and more preferably from 30° C. to 40° C. The processing time is generally from 20 seconds to 5 minutes, and preferably from 30 seconds to 4 minutes. The amount of the replenisher for the color developer is preferably less but is generally from 20 ml to 600 ml, preferably from 50 ml to 300 ml, and more preferably from 100 ml to 200 ml, per square meter of the color photographic material being processed.

The desilvering step used in the present invention is explained below.

For the desilvering step, generally a combination of a bleach step and a fix step, a combination of a fix step and a bleach-fix (blix) step, a combination of a bleach step and a blix step, a blix step, etc., are used.

In the present invention, when the time for the desilvering step is shortened, the effect of the present invention becomes remarkable. That is, the processing time for the desilvering step is generally less than 2 minutes, and preferably from 15 seconds to 90 seconds.

The bleach solution, blix solution, and fix solution which can be used in the present invention are explained below.

Bleaching agents which is used for the bleach solution or blix solution include organic complex salts or iron(III) (e.g., the complex salts of aminopolycarboxylic acids such as ethylenediaminetetraacetic acid, diethylenetriaminepentaacetic acid, etc., and organic phosphonic acids such as aminopolyphosphonic acid, phosphonocarboxylic acid, etc.); organic acids such as citric acid, tartaric acid, malic acid, etc.; persulfates; hydrogen peroxide, etc.

Of these materials, the organic complex salts of iron(III) are preferred from the viewpoint of quick processing and the prevention of environmental pollution.

Examples of aminopolycarboxylic acids, aminopolyphosphonic acids, and organic phosphonic acids include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, glycol ether diaminetetraacetic acid, etc.

These compounds may be in the form of the sodium salts, potassium salts, lithium salts, or ammonium salts. Of the aforesaid compounds, the iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferred due to their high bleaching power.

These ferric ion complex salts may be used in the form of complex salts or may be form in an aqueous solution using a ferric salt such as ferric sulfate, ferric chloride, ferric nitrate, ferric ammonium sulfate, ferric phosphate, etc., and a chelating agent such as aminopolycarboxylic acid, aminopolyphosphonic acid, phosphonocarboxylic acid, etc. Also, in the latter case, the chelating agent may be used in an excess amount to form the ferric ion complex salt.

Of the ferric complex salts, aminopolycarboxylic acid ferric complex salts are preferred and the addition amount thereof is from 0.01 mol/liter, and preferably from 0.05 mol/liter to 0.50 mol/liter.

For the bleach solution, blix solution, and/or the prebath thereof, various kinds of compounds can be used. For example, compounds having a mercapto group or a disulfide bond described in U.S. Pat. No. 3,893,858, West German Patent 1,290,812, JP-A-53-95630, and Research Disclosure, No. 17129 (July, 1978), the thiourea series compounds described in JP-B-45-8506, JP-A-52-20832, JP-A-53-32735, and U.S. Pat. No. 3,706,651, and halides such as iodide ions and bromide ions are preferred from the standpoint of excellent bleaching power.

The bleach solution or the blix solution which can be used in the present invention may further contain a rehalogenating agent such as bromides (e.g., potassium bromide, sodium bromide, and ammonium bromide), chlorides (e.g., potassium chloride, sodium chloride, ammonium chloride, etc.), and iodides (e.g., ammonium iodide, etc.). Furthermore, if desired, the bleach solution or blix solution may contain a corrosion inhibitor such as inorganic or organic acids having a pH buffer action or the alkali metal salts and ammonium salts thereof (e.g., boric acid, borax, sodium metaborate, acetic acid, sodium acetate, sodium carbonate, potassium carbonate, phosphorus acids, phosphoric acid, sodium phosphate, citric acid, sodium citrate, and tartaric acid), ammonium nitrate, guanidine, etc.

Examples of fixing agents for the blix solution or the fix solution in the present invention include thiosulfates such as sodium thiosulfate, ammonium thiosulfate, etc.; thiocyanates such as sodium thiocyanate, ammonium thiocyanate, etc.; thioether compounds such as ethylene bisthioglycolic acid, 3,6-dithia-1,8-octanediol, etc.; and water-soluble silver halide solvents such as thioureas, etc. They can be used alone or as a mixture thereof. Also, a specific blix solution composed of a combination of a fixing agent and a large amount of a halide such as potassium iodide described in JP-A-55-155354 can be used. In the present invention, thiosulfates, in particular, ammonium thiosulfate, are preferably used.

The amount of the fixing agent is from 0.3 mol/ liter to 2 mols/liter, and more preferably from 0.5 mol/ liter to 1.0 mol/liter. The pH range of the blix solution or the fix solution is preferably from 3 to 10, and more preferably from 5 to 9.

Also, the blix solution may further contain various kinds of optical whitening agents, defoaming agents or surface active agents, polyvinylpyrrolidone, organic solvents such as methanol, etc.

The blix solution or the fix solution in the present invention further may contain a sulfite ion releasing compound such as sulfites (e.g., sodium sulfite, potassium sulfite, ammonium sulfite, etc.), hydrogensulfites (e.g., ammonium hydrogensulfite, sodium hydrogensulfite, potassium hydrogensulfite, etc.), and metahydrogensulfites (e.g., potassium metahydrogensulfite, sodium metahydrogensulfite, and ammonium metahydrogensulfite) as preservatives.

It is preferred that the aforesaid compound is present in an amount of from about 0.02 mol/liter to 0.50 mol/liter, and more particularly from 0.04 mol/liter to 0.40 mol/liter as sulfite ions.

Sulfites are generally used as the preservatives, but ascorbic acid, a carbonyl-hydrogensulfite addition product, or a carbonyl compound may be used.

Furthermore, the blix solution or fix solution may contain, if desired, a buffer, an optical whitening agent, a chelating agent, a defoaming agent, an antifungal agent, etc.

After desilvering such as fixing or blixing, the color photographic materials thus processed are generally washed and/or stabilized.

The amount of wash water in the wash step can be selected depending on various conditions such as the characteristics of the color photographic materials (e.g., the properties by the materials such as couplers, etc.), the uses thereof, the temperature of the wash water, the number (stage number) of wash tanks, and the replenishing system, such as countercurrent system, normal current system, etc. The relation of the number of wash tanks and water in a multistage countercurrent system can be obtained by the method described in *Journal of the Society of Motion Picture and Television Engineers*, Vol. 64, 248–253 (May, 1955).

The stage number of an ordinary multistage countercurrent system is preferably from 2 to 6, and more preferably from 2 to 4.

According to a multistage countercurrent system, the amount of wash water can be greatly reduced to 0.5 liter to 1 liter per square meter of the color photographic material being processed and in this case, the effect of the present invention is remarkable. However, the increase of the residence time of water in the tanks is accompanied by the growth of bacteria and attachment to the color photographic materials of floats formed. For solving such a problem, the method of reducing calcium and magnesium described in JP-A-62-288838 can be very effectively used. Also, isothiazolone compounds and thiabendazoles described in JP-A-57-8542, chlorine series sterilizers such as chlorinated sodium isocyanuric acid described in JP-A-61-120145, benzotriazoles described in JP-A-61-267761, copper ions, as well as the sterilizers described in Hiroshi Horiguchi, Bokin Bobai Zai no Kagaku (Chemistry of Antibacterial and Antifungal Agents), Biseibutsu no Mekkin, Sakkin, Bobai Gijutsu (Antibacterial and Antifungal Technique of Microorganism), edited by Eisei Gijutsu Kai, and Bokin Bobai Zai Jiten (Antibacterial and Antifunqal Agent Handbook), edited by Nippon Bokin Bobai Gakkai can be used.

Furthermore, the wash water can further contain a surface active agent as a wetting agent and a chelating agent such as ethylenediaminetetraacetic acid (EDTA) as a water softener.

After the described wash step or without employing the wasn step, the color photographic material can be processed by a stabilization solution. The stabilization solution contains a compound capable of stabilizing color images formed, such as aldehyde compounds such as formaldehyde, etc., buffer for controlling the pH of the photographic layers suitable for the stabilization of dyes formed, and ammonium compound. Also, for preventing the growth of bacteria in the solution or imparting antifungal property to the color photographic material after processing, the various antibacterial agents and antifungal agents described above can be used for the stabilization solution.

Furthermore, the stabilization solution may further contain a surface active agent, an optical whitening agent, a hardening agent, etc.

When the stabilization is carried out directly without employing a wash step, the methods described in JP-A-57-8543, JP-A-58-14834 and JP-A-60-220345 can be used.

Furthermore, it is preferred to use chelating agents such as 1-hydroxyethylidene-1,1-diphosphonic acid, ethylenediaminetetramethylenephosphonic acid, etc., or magnesium compounds or bismuth compounds for the stabilization solution.

In the present invention, a so-called rinse solution can be similarly used as wash water or the stabilization solution after the desilvering process.

The pH of wash water or the stabilization solution in the present invention is generally from 4 to 10, and preferably from 5 to 8. The temperature can be desirably selected according to the characteristics and uses of the color photographic materials being processed but is generally from 15° C. to 45° C., and preferably from 20° C. to 40° C. The processing time is preferably shorter but is preferably from 15 seconds to 3 minutes, and more preferably from 30 seconds to 2 minutes.

The amount of the replenisher is preferably less from the viewpoints of operating cost, reduction of waste solution, handling property, etc. A suitable amount of the replenisher is from 0.5 to 50 times, and preferably from 3 to 40 times the amount carried by the color photographic material per unit area from the prebath. Also, the amount is generally 1 liter or less, and preferably 500 ml or less, per square meter of the color photographic material. Also, the replenisher may be supplied continuously or intermittently.

The solution used for wash and/or stabilization can be used for the prebath. As an example thereof, the overflow liquid of the wash water the amount of which was reduced by the employment of a multistage countercurrent system is supplied to a blix bath which is the prebath of the wash step and a concentrated solution is replenished to the blix bath to reduce the amount of the waste liquid.

The process of the present invention can be applied to any process for processing color photographic materials using a color developer. For example, the process of the present invention can be applied for processing color photographic papers, color reversal photographic papers, color direct positive photographic materials, positive color photographic films, negative color photographic films, color reversal photographic films, etc., but the application to the processing for color reversal photographic papers is particularly advantageous.

The compounds shown by formulae (I) and (II), which are used for the color photographic materials being processed by the process of the present invention, are explained below.

The compounds of formulae (I) and (II) have the function of preventing the aforesaid Compound A from remaining in the processed color photographic materials, which then causes a displacement reaction or addition reaction with a color developing agent released, thereafter, by being decomposed to inactive the color developing agent or preventing yellow stain occurring due to the photodecomposition of Compound A itself.

The compounds shown by formulae (I) and (II) are described in detail below.

In these formulae (I) and (II), the aliphatic group represented by $R_1$, $R_2$ and B can be a straight chain, branched or cyclic alkyl group, an alkenyl group, or an alkynyl group and these groups may be substituted. The aliphatic group preferably has 1 to 40 carbon atoms. The aromatic group represented by $R_1$, $R_2$ and B may be a carbon ring series aromatic ring (e.g., phenyl, naphthyl) or a heterocyclic series aromatic ring (e.g., furyl, thienyl, pyrazolyl, pyridyl, indolyl), or further may be a monocyclic series or a condensed ring series (e.g., benzofuryl, phenanthridinyl). Furthermore, these aromatic ring groups may have substituent(s). The aromatic group preferably has 6 to 40 carbon atoms.

The heterocyclic ring for $R_1$, $R_2$ and B is preferably a group having a 3-membered to 10-membered cyclic structure composed of carbon atoms, oxygen atoms, nitrogen atoms, and sulfur atoms, and/or hydrogen atoms, and also the heterocyclic ring itself may be a saturated ring or may be substituted. The heterocyclic ring preferably has 1 to 40 carbon atoms.

Examples of substituents for the aliphatic group, aromatic group and heterocyclic ring described above include coumanyl, pyrrolidyl, pyrrolinyl, morpholinyl.

In formula (I), X represents a group released by reaction with an aromatic primary amine color developing agent and is preferably a group bonded to A through an oxygen atom, a sulfur atom, or a nitrogen atom (e.g., 3-pyrazolyloxy, 3H-1,2,4-oxadiazolin-5-oxy, aryloxy, alkoxy, alkylthio, arylthio, and substituted N-oxy) or a halogen atom.

In formula (I), A represents a group forming a chemical bond by reaction with an aromatic primary amine developing agent and includes a group having an atom of low electron density, such as, for example, $$-L-\overset{\overset{Y}{\|}}{C}-,\ -L-\overset{\overset{Y}{\|}}{S}-,\ -L-\underset{\underset{Y'}{\|}}{\overset{\overset{Y}{\|}}{S}}-,\ -L-\underset{\underset{Y'}{|}}{\overset{\overset{Y}{\|}}{P}}-,\ \text{and}\ -L-\underset{\underset{R''}{|}}{\overset{\overset{R'}{|}}{Si}}-.$$

When X is a halogen atom, n represents 0.

In the above formulae, L represents a single bond, an alkylene group, $$-O-,\ -S-,\ -\overset{\overset{R'''}{|}}{N}-,\ -L'-\overset{\overset{Y}{\|}}{C}-L''-,\ \text{or}\ -L'-\underset{\underset{Y}{\|}}{\overset{\overset{Y}{\|}}{S}}-L'',$$

(e.g., carbonyl, sulfonyl, sulfinyl, oxycarbonyl, phosphonyl, thiocarbonyl, aminocarbonyl, and silyloxy).

Y has the same significance as Y in formula (II) and Y' has the same significance as Y.

R' and R'', which may be the same or different, each represents —L'''—$R_0$.

$R_0$ has the same significance as $R_1$. R''' represents a hydrogen atom, an aliphatic group (e.g., methyl, isobutyl, t-butyl, vinyl, benzyl, octadecyl, and cyclohexyl), an aromatic group (e.g., phenyl, pyridyl, and naphthyl), a heterocyclic group (e.g., piperidinyl, pyranyl, furanyl, and chromanyl), an acyl group (e.g., acetyl and benzyl), or a sulfonyl group (e.g., methanesulfonyl and benzenesulfonyl).

L', L'', and L''' each represents —O—, —S—, or $$-\overset{\overset{R'''}{|}}{N}-.$$

In formula (I), A is preferably a divalent group represented by $$-O-\overset{\overset{O}{\|}}{C}-,\ -S-\overset{\overset{O}{\|}}{C}-,\ \text{or alkylene-}\overset{\overset{O}{\|}}{C}-.$$

In formula (II), Y is preferably an oxygen atom, a sulfur atom, $$=N-R_4\quad\text{or}\quad=\overset{\overset{R_5}{|}}{C}-R_6$$

wherein $R_4$, $R_5$, and $R_6$ each represents a hydrogen atom, an aliphatic group preferably having 1 to 40 carbon atoms (e.g., methyl, isopropyl, t-butyl, vinyl, benzyl, octadecyl, and cyclohexyl), an aromatic group preferably having 6 to 40 carbon atoms (e.g., phenyl, pyridyl, and naphthyl), a heterocyclic group preferably having 1 to 40 carbon atoms (e.g., piperidyl, pyranyl, furanyl, and chromanyl), acyl group (e.g., acetyl and benzoyl), or a sulfonyl group (e.g., methanesulfonyl and benzenesulfonyl). $R_5$ and $R_6$ may combine with each other to form a cyclic structure.

Among compounds represented by formulae (I) and (II), a compound undergoing chemical bonding with the oxidation product of an aromatic primary amine developing agent after color development is preferred. The compound includes compounds having a nucleophilic group induced from a nucleophilic functional group having a Pearson's nucleophilic $nCH_{31}$ (R. G. Pearson, et al., *Journal of American Chemical Society*, 90, 319 (1968)) of at least 5.

Such a compound is more preferably represented by formula (III):

$$R_7-Z\cdot M \qquad \text{(III)}$$

wherein $R_7$ represents an aliphatic group preferably having 1 to 40 carbon atoms, an aromatic group preferably having 6 to 40 carbon atoms, or a heterocyclic group preferably having 1 to 40 carbon atoms; Z represents a nucleophilic group; and M represents a hydrogen atom, a metal cation, an ammonium cation, or a protective group.

The compound represented by formula (III) is explained in more detail below.

The aliphatic group represented by $R_7$ is a straight chain or cyclic alkyl group, alkenyl or alkynyl group, which may be further substituted.

The aromatic group represented by $R_7$ is a carbon ring series aromatic group (e.g., phenyl and naphthyl) or a heterocyclic aromatic group (e.g., furyl, thienyl, pyrazolyl, pyridyl, and indolyl) and the group may be a monocyclic series or a condensed ring series (e.g., benzofuryl and phenanthridinyl). Furthermore, these aromatic ring groups may have substituent(s).

The heterocyclic group represented by $R_7$ is preferably a group of a 3-membered to 10-membered cyclic structure composed of carbon atoms, oxygen atoms, nitrogen atoms, and sulfur atoms, and/or hydrogen atoms, the heterocyclic ring itself may be a saturated ring or unsaturated ring, and further may be substituted.

Examples of substituents for the aliphatic group, aromatic group and heterocyclic ring described above include coumanyl, pyrrolidyl, pyrrolinyl, and morpholinyl.

In formula (III), Z represents a nucleophilic group and examples include a nucleophilic group in which the atom directly chemically bonding to the oxidation product of an aromatic amine series developing agent is an oxygen atom, a sulfur atom, or a nitrogen atom (e.g., amine compounds, azide compounds, hydrazine compounds, mercapto compounds, sulfide compounds, sulfinic acid compounds, cyano compounds, thiocyano compounds, thiosulfuric acid compounds, seleno compounds, halide compounds, carboxy compounds, hydroxamic acid compounds, active methylene compounds, phenol compounds, and nitrogen-containing heterocyclic compounds).

M represents a hydrogen atom, a metal cation such as Li, Na, K, Ca, Mg, an ammonium cation, or a protective group.

The compound represented by formula (III) undergoes a nucleophilic reaction (typically, coupling reaction) with the oxidation product of an aromatic amine series color developing agent.

In the compound represented by formula (III), the compound represented by formula (IV) is most preferred.

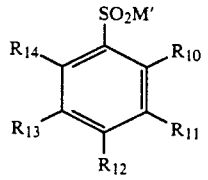

(IV)

wherein M' represents an atom or an atomic group forming an inorganic salt (e.g., Li, Na, K, Ca, and Mg) or an organic salt (e.g., triethylamine, methylamine, and ammonia),

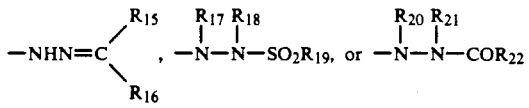

(wherein $R_{15}$ and $R_{16}$, which may be the same or different, each represents a hydrogen atom or the aliphatic group, aromatic group or heterocyclic group as described above for $R_1$, $R_{15}$ and $R_{16}$ may combine with each other to form a 5-membered to 7-membered ring; $R_{17}$, $R_{18}$, $R_{20}$, and $R_{21}$, which may be the same or different, each represents a hydrogen atom or the aliphatic group, aromatic group or heterocyclic group as described above for $R_7$; $R_{17}$, $R_{18}$, $R_{20}$, and $R_{21}$ further represent an acyl group, an alkoxycarbonyl group, a sulfonyl group, a ureido group, or a urethane group; at least one of $R_{17}$ and $R_{18}$ and at least one of $R_{20}$ and $R_{21}$ is, however, a hydrogen atom.

$R_{19}$ and $R_{22}$ each represents a hydrogen atom or the aliphatic group, aromatic group or heterocyclic group as described above for $R_7$. $R_{22}$ further represents an alkylamino group, an arylamino group, an alkoxy group, an aryloxy group, an acyl group, an alkoxycarbonyl group, or an aryloxycarbonyl group.

In this case, at least two of $R_{17}$, $R_{18}$, and $R_{19}$ may combine with each other to form a 5-membered to 7-membered ring and at least two of $R_{20}$, $R_{21}$, $R_{22}$ may combine with each other to form a 5-membered to 7-membered ring.

In formula (IV), $R_{10}$, $R_{11}$, $R_{12}$, $R_{13}$, and $R_{14}$, which may be the same or different, each represents a hydrogen atom, an aliphatic group (e.g., methyl, isopropyl, t-butyl, vinyl, benzyl, octadecyl, and cyclohexyl), an aromatic group (e.g., phenyl, pyridyl, and naphthyl), a heterocyclic group (e.g., piperidinyl, pyranyl, furanyl, and chromanyl), a halogen atom (e.g., chlorine and bromine),

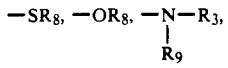

an acyl group (e.g., acetyl and benzoyl), an alkoxycarbonyl group (e.g., methoxycarbonyl, butoxycarbonyl, cyclohexylcarbonyl, and octylcarbonyl), an aryloxycarbonyl group (e.g., phenyloxycarbonyl and naphthyloxycarbonyl), a sulfonyl group (e.g., methanesulfonyl and benzenesulfonyl), a sulfonamide group (e.g., methanesulfonamide and benzenesulfonamide), a sulfamoyl group, a ureido group, a urethane group, a carbamoyl group, a sulfo group, a carboxy group, a nitro group, a cyano group, an alkoxalyl group (e.g., methoxalyl, isobutoxalyl, octyloxalyl, and benzoyloxalyl), an allyloxalyl group (e.g., phenoxalyl and naphthoxalyl), a sulfonyloxy group (e.g., methanesulfonyloxy and benzenesulfonyloxy),

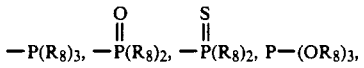

or a formyl group. In the above formulae, $R_8$ and $R_9$ each represents a hydrogen atom, an aliphatic group, an alkoxy group, or an aromatic group.

Of the above-described compounds, the compounds having the total sum of the Hammett $\sigma$ values to $-SO_2M'$ of at least 0.5 are particularly effective.

Specific examples of the compounds represented by the aforesaid formulae (I), (II), and (III) are illustrated below.

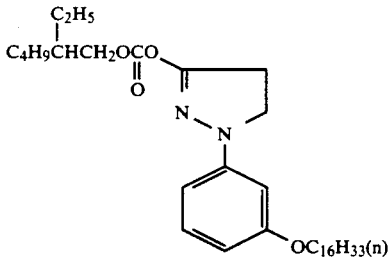

(A-1)

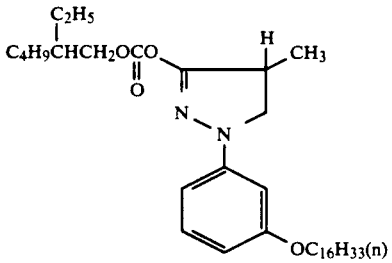

(A-2)

-continued
(A-3)
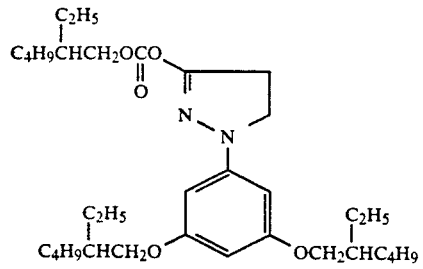
(A-4)
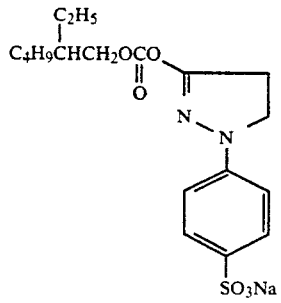
(A-5)
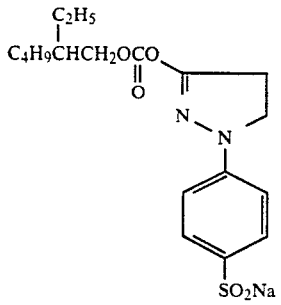
(A-6)
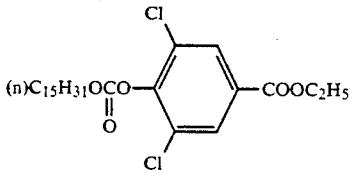
(A-7)
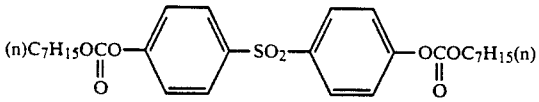
(A-8)
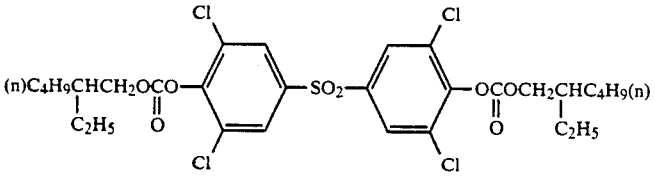
(A-9)
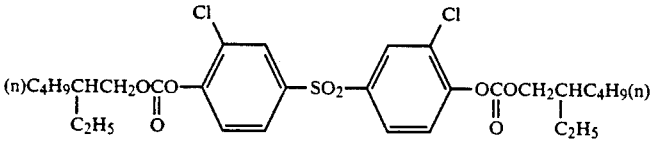
(A-10)
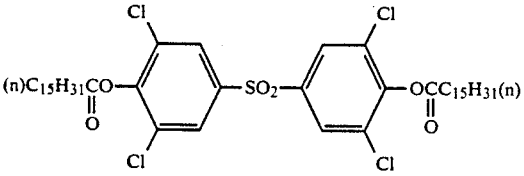

-continued
(A-11)
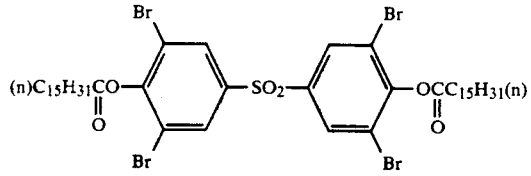
(A-12)
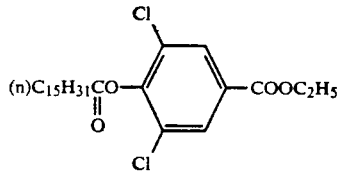
(A-13)
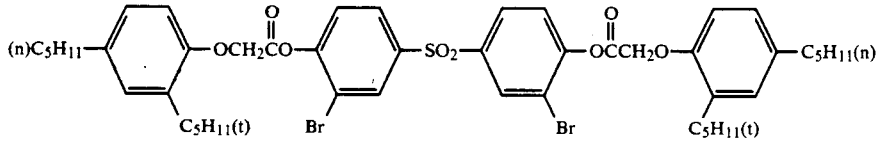
(A-14)
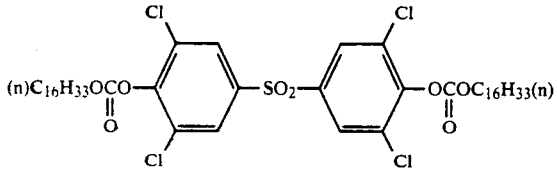
(A-15)
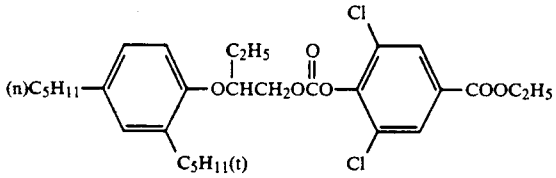
(A-16)
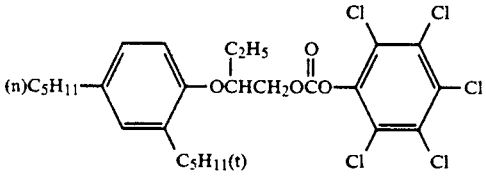
(A-17)
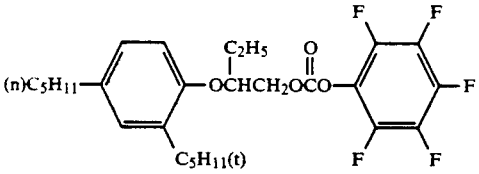
(A-18)
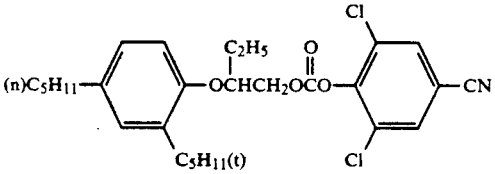
(A-19)
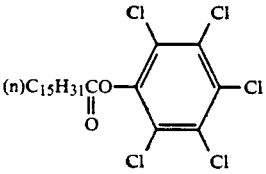

-continued
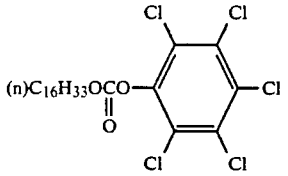
(A-20)
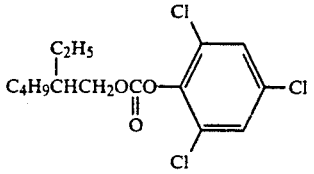
(A-21)
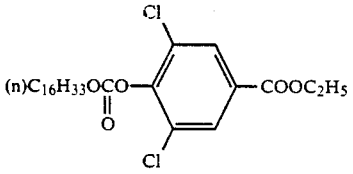
(A-22)
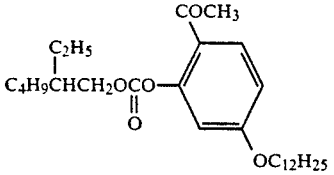
(A-23)
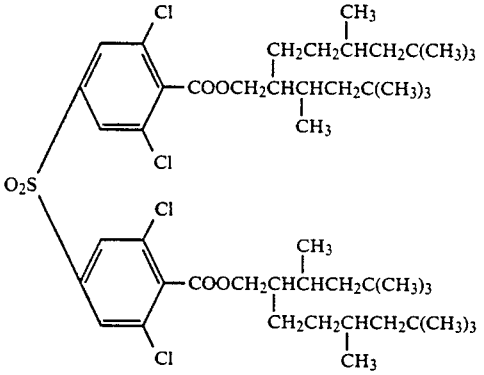
(A-24)
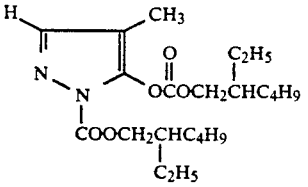
(A-25)
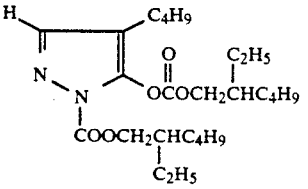
(A-26)

-continued
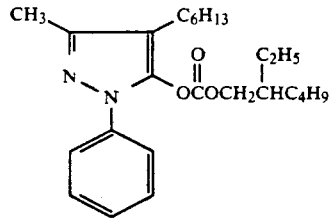
(A-27)
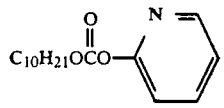
(A-28)
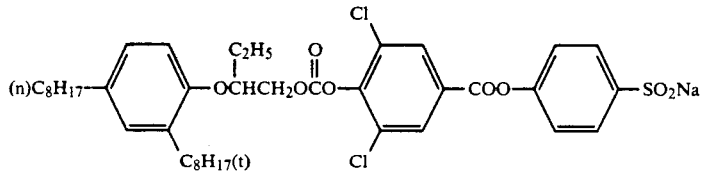
(A-29)
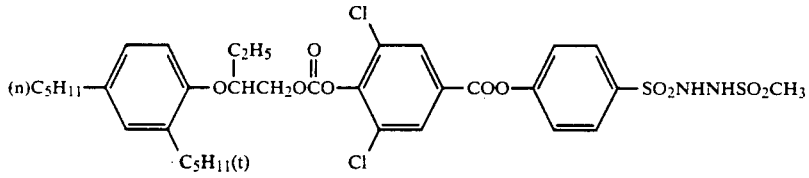
(A-30)
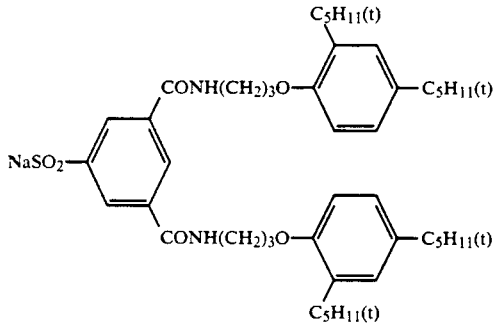
(A-31)
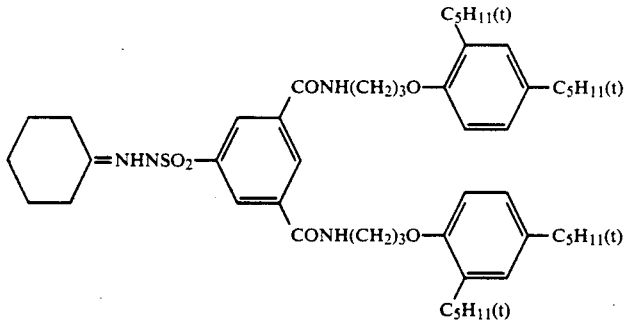
(A-32)
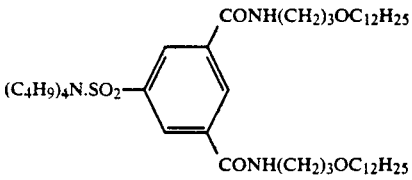
(A-33)

-continued
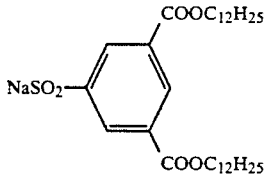
(A-34)
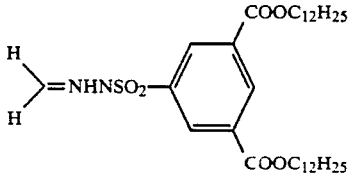
(A-35)
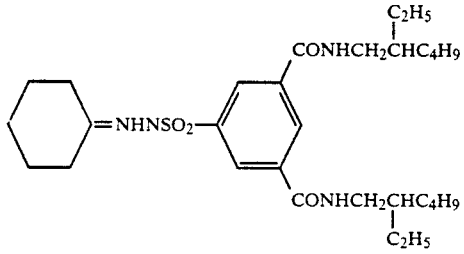
(A-36)
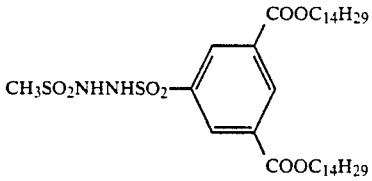
(A-37)
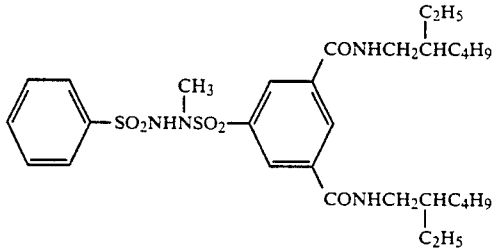
(A-38)
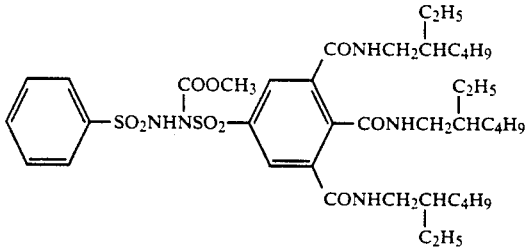
(A-39)
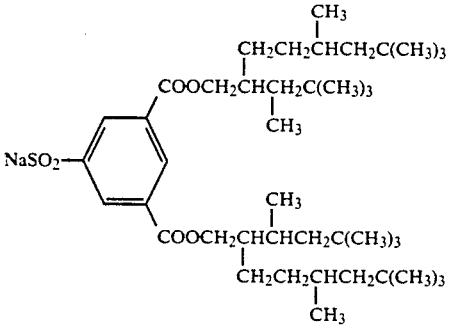
(A-40)

-continued (A-41)

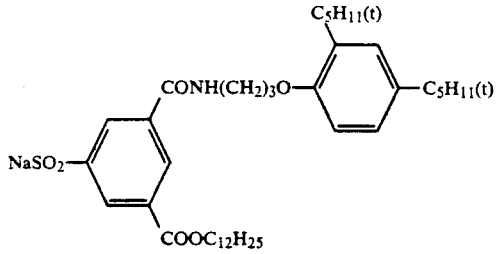

(A-42)

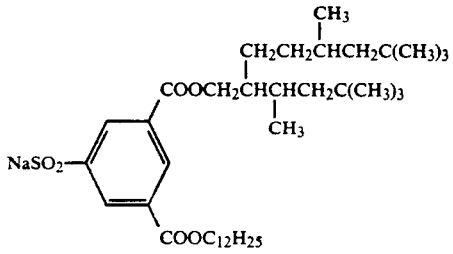

(A-43)

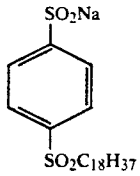

(A-44)

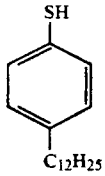

(A-45)

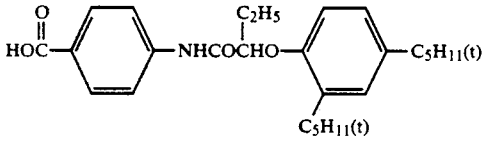

(A-46)

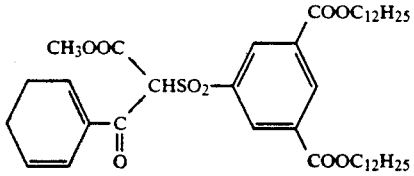

The compound represented by formula (I) or (II) may be incorporated in any layer(s) of a silver halide color photographic material but particularly preferably is present in a layer containing an oil-soluble coupler. There is no particular restriction on the addition amount thereof to the color photographic material but it is preferably present from 0.05 to 5 times, and particularly preferably from 0.10 to 2 times, the amount of the coupler in the same layer.

The silver halide color photographic material which can be processed in the present invention is explained in detail below.

The halogen composition for the silver halide emulsions in the present invention may be silver chlorobromide, silver iodochlorobromide, silver bromide, or silver iodobromide of which the content of silver bromide is at least 20 mol% but silver chlorobromide containing substantially no silver iodide is particularly preferred. The term "containing substantially no silver iodide" as used herein means that the content of silver iodide is 3 mol % or less, and preferably 1 mol % or less, to the total amount of silver halide. More preferably, the content of silver iodide is 0.5 mol % or less and it is most preferred that no silver iodide is present. The presence of silver iodide may give various advantages in that the light absorption amount is increased in the point of light sensitivity, the adsorption of spectral sensitizing dye(s) is increased, and the desensitization by spectral sensitizing dye(s) is reduced but when quick processing is performed in a short time in using the technique of the present invention, the presence of silver iodide is disadvantageous in that the delay of the development speed delays the development speed of all of the silver halide grains.

A silver chlorobromide emulsion having a silver bromide content of at least 20 mol% is preferably used in the present invention. For obtaining a silver halide emulsion having a sufficient sensitivity without increasing the formation of fog, the content of silver bromide is preferably at least 50 mol %, and more preferably at least 70 mol % but when there are restrictions in performance such as spectral sensitivity, etc., required for the color photographic materials and quick processing is required, it is sometimes preferred to use a silver halide emulsion having a silver bromide content of from about 20 mol % to 40 mol %.

The system for use in the present invention is very excellent in the stability of processing performance as compared to the case of using a silver chlorobromide emulsion containing 20 mol % or less, for example, 3 mol % or less or 1 mol % or less. If the content of silver bromide is less, the quickness of the development is increased as well as when the color photographic material containing such a silver halide emulsion is subjected to operating processing using the processing solution, bromide ions of the equilibrium accumulated amount determined by relation with the replenishing amount present in the developer at a low concentration, whereby the quick developing property of the developer itself can be increased, but the advantages are canceled in that the compounds adsorptive to silver halide grains incorporated therein for preventing the influence of bromide ions caused by silver bromide present in a slight amount, for preventing the formation of fog by silver bromide present in a slight amount, and for stabilizing the developing performance reduces the quickness of processing and changes the processing performance.

For obtaining color images with stable gradation and with less formation of fog by the process of the present invention, it is preferred to use a silver halide emulsion having a high content of silver bromide for color photographic materials. If the content of silver bromide becomes about 100 mol %, the quickness of development is slightly reduced but such a reduction does not result in problems if the form of the crystal grains of silver halide emulsion is changed (e.g., tabular silver chlorobromide grains are used), the halogen distribution in the silver halide grains is changed (e.g., double phase grains containing silver chloride higher in the surface portion than the inside thereof are used), or the grain sizes or the grain size distribution is used (e.g., a monodispersed fine grain silver halide emulsion is used), and a silver halide color photographic material having high sensitivity and showing high storage stability and processing stability is obtained.

The mean grain size (the mean value of diameters of spheres corresponding to the volume) of the silver halide emulsion in the present invention is preferably from 0.1 μm to 2 μm, and particularly preferably from 0.15 μm to 1.4 μm. The grain size distribution may be narrow or broad but a monodispersed emulsion is preferred. In particular, a monodispersed silver halide emulsion of regular grains such as cubic grains or tabular grains is preferred in the present invention. A silver halide emulsion wherein the value of the standard deviation of the mean grain size distribution divided by the mean grain size by number or weight is 0.22 or less, more preferably 0.15 or less, and particularly preferably 0.12 or less is preferred. Furthermore, it is preferred for the gradation control of the color photographic materials to use two or more kinds of monodispersed emulsions, each containing regular silver halide grains such as cubic, octahedral, or tetradecahedral grains as a mixture or in multilayers.

The color photographic materials which are processed by the process of the present invention contain various color couplers. A color coupler which can be used in the present invention is a compound capable of forming a dye by a coupling reaction with the oxidation product of an aromatic primary amine developing agent. Typical examples of useful color couplers include naphtholic or phenolic compounds, pyrazolone or pyrazoloazole series compounds, and open chain or heterocyclic ketomethylene series compounds. Specific examples of these cyan, magenta and yellow couplers which can be used in the present invention are described in the patents cited in *Research Disclosure (RD)*, No. 17643, VII-D (December, 1978) and ibid., No. 18717 (November, 1979).

It is preferred for the color couplers to be rendered nondiffusible by a ballast group or by being polymerized. Furthermore, the use of 2-equivalent color couplers, the coupling active position of which is substituted by a releasing group, is more effective for reducing the amount of silver than the case of using 4-equivalent color couplers having a hydrogen atom at the coupling active position thereof. Couplers providing colored dyes having an appropriate diffusibility, noncoloring couplers, DIR couplers releasing a development inhibitor with the coupling reaction or couplers releasing a development accelerator with the coupling reaction can be also used for the color photographic materials.

Typical examples of the yellow couplers for use in the present invention are oil-protect type acylacetamide series yellow couplers. Specific examples thereof are described in U.S. Pat. Nos. 2,407,210, 2,875,057 and 3,265,506. In the present invention, 2-equivalent yellow couplers are preferably used and typical examples are oxygen atom-releasing type yellow couplers described in U.S. Pat. Nos. 3,408,194, 3,447,928, 3,933,501 and 4,022,620 and nitrogen atom-releasing type yellow couplers described in JP-B-58-10739, U.S. Pat. Nos. 4,401,752 and 4,326,024, *Research Disclosure*, No. 18053 (April, 1979), British Patent 1,425,020, West German Patent Application (OLS) Nos. 2,219,917, 2,261,361, 2,329,587, AND 2,433,812. Of these couplers, α-pivaloylacetanilide series yellow couplers are excellent in fastness, in particular, light fastness of the colored dyes formed, while α-benzoylacetanilide series yellow couplers give high coloring density.

Suitable magenta couplers for use in the present invention are oil-protect type indazolone series or cyanoacetyl series magenta couplers, preferably 5-pyrazolone series couplers and pyrazoloazole series couplers such as pyrazolotriazole series couplers.

The 5-pyrazolone series couplers having an arylamino group or an acylamino group at the 3-position thereof are preferred from the viewpoint of the hue of the colored dyes and the coloring density, and typical examples of the couplers are described in U.S. Pat. Nos. 2,311,082, 2,343,703, 2,600,788, 2,908,573, 3,062,653, 3,152,896, and 3,936,015. Preferred releasing groups for the 2-equivalent 5-pyrazolone series magenta couplers include nitrogen-releasing groups described in U.S. Pat. No. 4,310,619 and arylthio groups described in U.S. Pat. No. 4,351,897. Also, 5-pyrazolone series magenta couplers having a ballast group described in European Patent 73,636 give high coloring density.

Pyrazolone series magenta couplers include pyrazolobenzimidazoles described in U.S. Pat. No. 3,369,879, preferably pyrazolo[5,1-c][1,2,4]triazoles described in U.S. Pat. No. 3,725,067, pyrazolotetrazoles described in *Research Disclosure,* No. 24220 (June, 1984), and pyrazolopyrazoles described in *Research Disclosure,* No. 24230 (June, 1984). From the viewpoint of less yellow side absorption of the colored dyes formed and high light fastness of the colored dyes, imidazo[1,2,b]pyrazoles described in European Patent 119,741 and pyrazolo[1,5-b][1,2,4]triazoles described in European Patent 119,860 are particularly preferred.

As cyan couplers for use in the present invention, there are oil-protect type naphtholic and phenolic couplers.

The naphtholic cyan couplers include, as typical examples, naphtholic couplers described in U.S. Pat. No. 2,474,293 and, preferably, oxygen atom-releasing type 2-equivalent naphtholic couplers described in U.S. Pat. Nos. 4,052,212, 4,146,396, 4,228,233, and 4,296,200. Also, specific examples of phenolic cyan couplers are described in U.S. Pat. Nos. 2,369,929, 2,801,171, 2,772,162, and 2,895,826. Cyan couplers having high fastness to moisture and heat are preferably used in the present invention, and typical examples thereof are phenolic couplers having an alkyl group of two or more carbon atoms at the meta-position of the phenol nucleus described in U.S. Pat. No. 3,772,002, 2,5-diacylaminosubstituted phenolic cyan couplers described in U.S. Pat. Nos. 2,772,162, 3,758,308, 4,126,396, 4,334,011 and 4,327,173, West German Patent Application (OLS) No. 3,329,729, and JP-A-59-166956, and phenolic cyan couplers having a phenylureido group at the 2-position and an acylamino group at the 5-position described in U.S. Pat. Nos. 3,446,622, 4,333,999, 4,451,559 and 4,427,767.

In the present invention, for effectively inhibiting the increase of stain (increase of the minimum density) with the passage of time after processing, the use of the following couplers are preferred.

Preferred cyan couplers are represented by the following formulae (VI) and (VII):

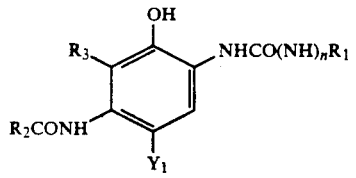

(VI)

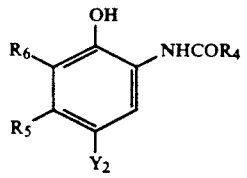

(VII)

In formulae (VI) and (VII), $R_1$, $R_2$, and $R_4$ each represents a substituted or unsubstituted aliphatic group, a substituted or unsubstituted aromatic group, a substituted or unsubstituted heterocyclic group; $R_3$, $R_5$, and $R_6$ each represents a hydrogen atom, a halogen atom, an aliphatic group, an aromatic group, or an acylamino group, $R_3$ may represent a nonmetallic atomic group forming a 5-membered or 6-membered nitrogen-containing ring together with $R_2$; $Y_1$ and $Y_2$ each represents a hydrogen atom or a group that can be released on coupling reaction with the oxidation product of an aromatic primary amine color developing agent; and in formula (VI), n represents 0 or 1.

When $Y_1$ and $Y_2$ represent a coupling releasing group (hereinafter, referred to as releasing group), the releasing groups are a group bonding an aliphatic group, an aromatic group, a heterocyclic group, an aliphatic sulfonyl group, an aromatic sulfonyl group, a heterocyclic sulfonyl group, an aliphatic carbonyl group, an aromatic carbonyl group, or a heterocyclic carbonyl group to the coupling active carbon through an oxygen atom, a nitrogen atom, a sulfur atom, or a carbon atom; a halogen atom; or an aromatic azo group. The aliphatic group, aromatic group or heterocyclic group included in the releasing group may be substituted by substituent(s) allowable for $R_1$ in formula (VI) described hereinafter. When two or more such substituents exist, they may be the same or different and these groups may be further substituted by a substituent allowable for $R_1$ in formula (VI) described hereinafter.

In the cyan couplers represented by formula (VI) and (VII), the aliphatic group represented by $R_1$, $R_2$, or $R_4$ are aliphatic groups having from 1 to 32 carbon atoms, such as methyl, butyl, tridecyl, cyclohexyl, and allyl. Examples of aromatic groups are phenyl and naphthyl. Examples of heterocyclic groups are 2-pyridyl, 2-imidazolyl, 2-furyl, and 6-quinolyl. The aforesaid groups each may be further substituted by an alkyl group, an aryl group, a heterocyclic group, an alkoxy group (e.g., methoxy and 2-methoxyethoxy), an aryloxy group (e.g., 2,4-di-tert-amylphenoxy, 2-chlorophenoxy, and 4-cyanophenoxy), an alkenyloxy group (e.g., 2-propenyloxy), an acyl group (e.g., acetyl and benzoyl), an ester group (e.g., butoxycarbonyl, phenoxycarbonyl, acetoxy, benzoyloxy, butoxysulfonyl, and toluenesulfonyloxy), an amide group (e.g., acetylamino, methanesulfonamide, and dipropylsulfamoylamino), a carbamoyl group (e.g., dimethylcarbamoyl, ethylcarbamoyl), a sulfamoyl group (e.g., butylsulfamoyl), an imide group (e.g., succinimide and hydantoinyl), a ureido group (e.g., phenylureido and dimethylureido), an aliphatic or aromatic sulfonyl group (e.g., methanesulfonyl and phenylsulfonyl), an aliphatic or aromatic thio group (e.g., ethylthio and phenylthio), a hydroxy group, a cyano group, a carboxy group, a nitro group, a sulfo group, and a halogen atom.

When $R_3$ or $R_5$ in formula (VI) is a group which can be substituted, the group may be substituted by the substituent for $R_1$ in formula (VI) described hereinafter.

In formula (VII), $R_5$ is preferably an aliphatic group such as methyl, ethyl, propyl, butyl, pentadecyl, tert-butyl, cyclohexyl, cyclohexylmethyl, phenylthiomethyl, dodecyloxyphenylthiomethyl, butanamidomethyl, and methoxymethyl.

In formulae (VI) and (VII), $Y_1$ and $Y_2$ each represents a hydrogen atom or a coupling releasing group (including a coupling releasing atom, and so forth) and examples thereof are a halogen atom (e.g., fluorine, chlorine, and bromine), an alkoxy group (e.g., ethoxy, dodecyloxy, methoxyethylcarbamoylmethoxy, carboxypropyloxy, and methylsulfonylethoxy), an aryloxy group (e.g., 4-chlorophenoxy, 4-methoxyphenoxy, and 4-carboxyphenoxy), an acyloxy group (e.g., acetoxy, tetradecanoyloxy, and benzoyloxy), a sulfonyloxy group (e.g., methanesulfonyloxy and toluenesulfonyloxy), an amide group (e.g., dichloroacetylamino, pentafluorobutyrylamino, methanesulfonylamino, and toluenesulfonylamino), an alkoxycarbonyloxy group (e.g., ethoxycarbonyloxy and benzyloxycarbonyloxy), an aryloxycarbonyloxy group (e.g., phenoxycarbonyloxy), an aliphatic or aromatic thio group (e.g., ethylthio, phenylthio, and tetrazolylthio), an imide group (e.g., succinimide and hydantoinyl), and an aromatic azo group (e.g., phenylazo). These releasing groups may contain a photographically useful group.

Preferred examples of the cyan coupler represented by formula (VI) or (VII) are as follows.

In formula (VI), $R_1$ is preferably an aryl group or a heterocyclic group, and more preferably is an aryl group substituted by a halogen atom, an alkyl group, an alkoxy group, an aryloxy group, an acylamino group, an acyl group, a carbamoyl group, a sulfonamide group, a sulfamoyl group, a sulfonyl group, a sulfamide group, an oxycarbonyl group, or a cyano group. These substituents are substituents for $R_1$ in formula (VI) described hereinbefore and hereinafter.

When in formula (VI) a ring is not formed at $R_3$ and $R_2$, $R_2$ is preferably a substituted or unsubstituted alkyl group or a substituted or unsubstituted aryl group, and particularly preferably an alkyl group substituted by a substituted aryloxy group. Also, $R_3$ is preferably a hydrogen atom.

In formula (VII), $R_4$ is preferably a substituted or unsubstituted alkyl group or a substituted or unsubstituted aryl group, and particularly preferably an alkyl group substituted by a substituted aryloxy group.

In formula (VII), $R_5$ is preferably an alkyl group having from 2 to 15 carbon atoms or a methyl group having a substituent having at least one carbon atom. Examples of substituents are an arylthio group, an alkylthio group, an acylamino group, an aryloxy group, and an alkyloxy group.

In formula (VII), $R_5$ is more preferably an alkyl group having from 2 to 15 carbon atoms, and particularly preferably an alkyl group having from 2 to 4 carbon atoms.

In formula (VII}, $R_6$ is preferably a hydrogen atom or a halogen atom, and more preferably chlorine or fluorine.

In formulae (VI) and (VII), $Y_1$ and $Y_2$ each is preferably a hydrogen atom, a halogen atom, an alkoxy group, an aryloxy group, an acyloxy group, or a sulfonamide group.

In formula (VII), $Y_2$ is more preferably a halogen atom, and particularly preferably chlorine or fluorine.

When n is 0 in formula (VI), $Y_1$ is more preferably a halogen atom, and particularly preferably chlorine or fluorine.

Specific examples of the cyan couplers represented by formula (VI) and (VII) are illustrated below.

(VI-1)

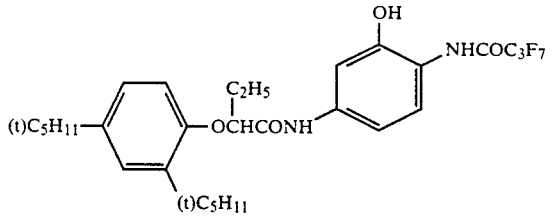

(VI-2)

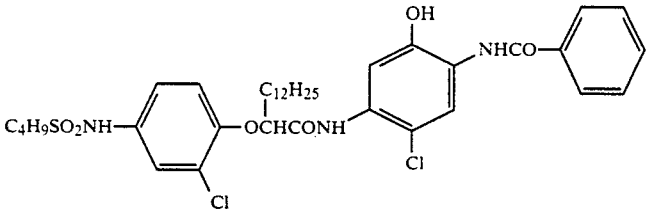

(VI-3)

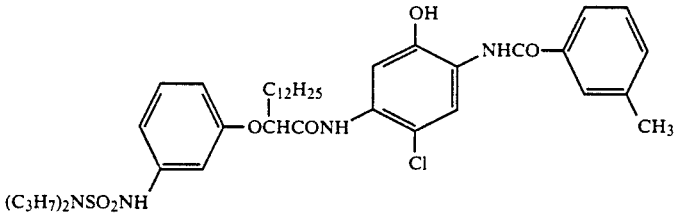

(VI-4)

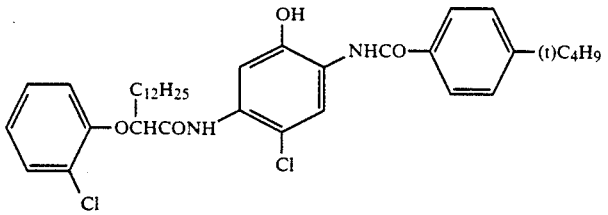

-continued
(VI-5)
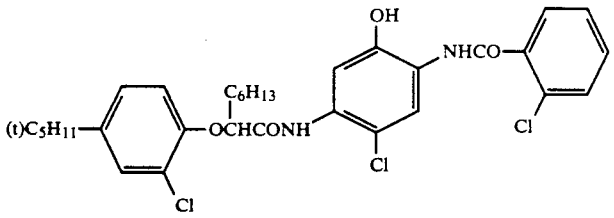
(VI-6)
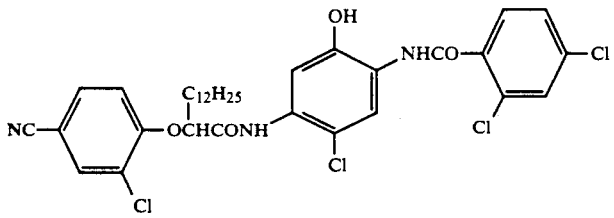
(VI-7)
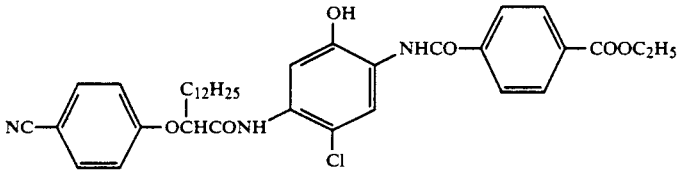
(VI-8)
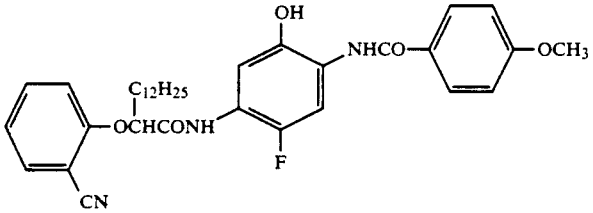
(VI-9)
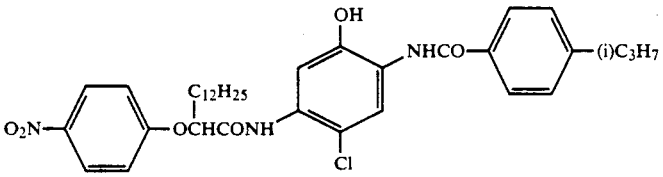
(VI-10)
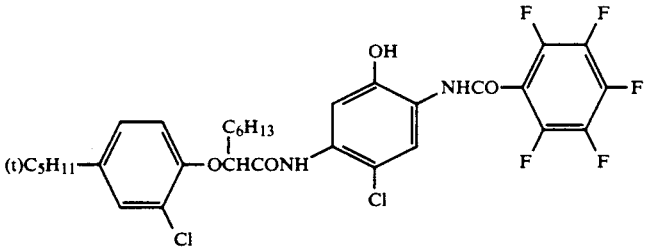
(VI-11)
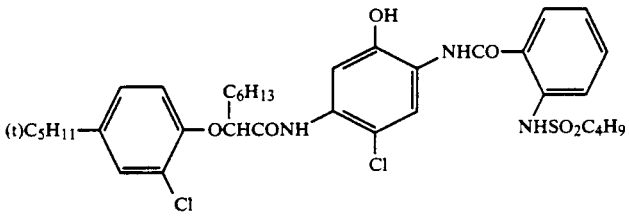

-continued
(VI-12)
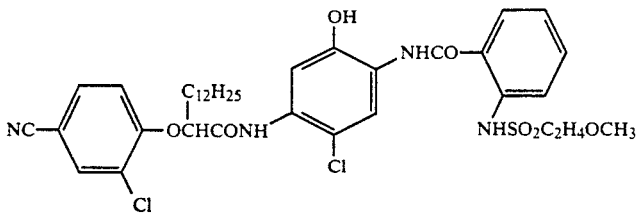
(VI-13)
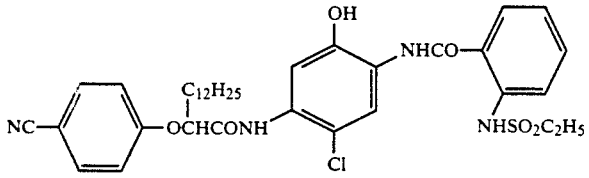
(VI-14)
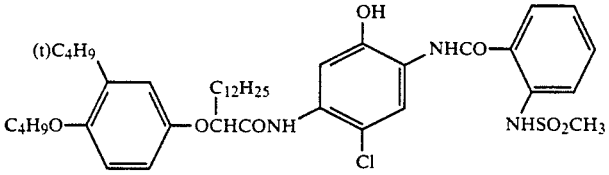
(VI-15)
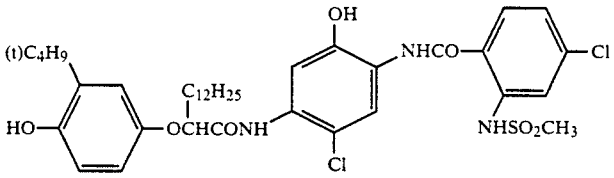
(VI-16)
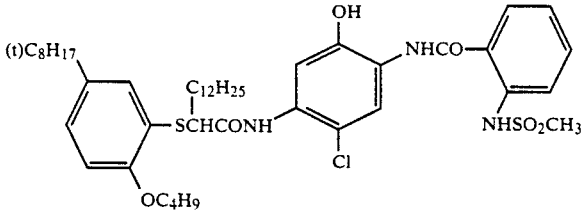
(VI-17)
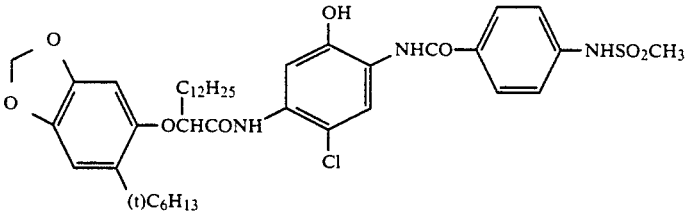
(VI-18)
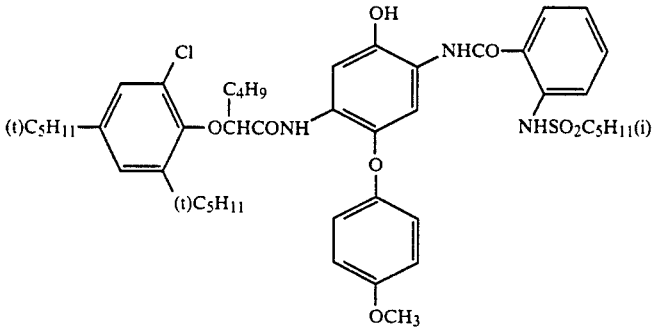

-continued
(VI-19)
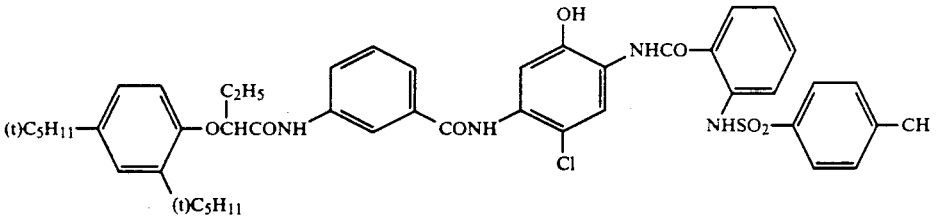
(VI-20)
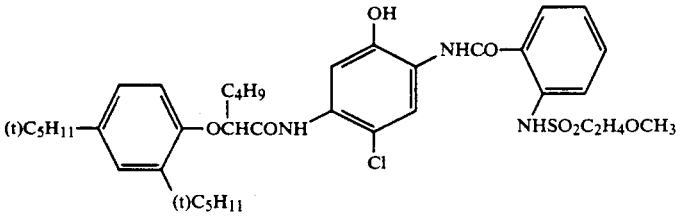
(VI-21)
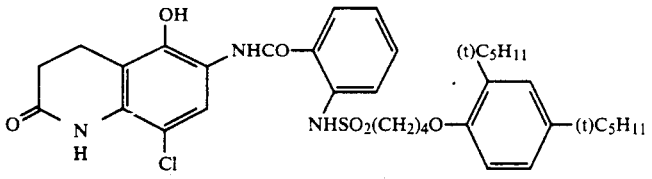
(VI-22)
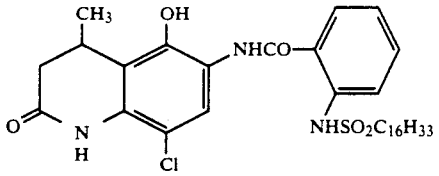
(VI-23)
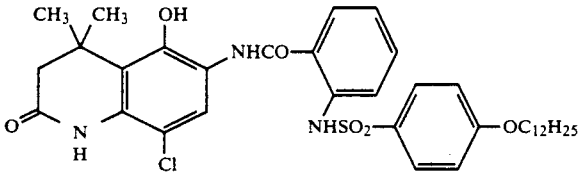
(VI-24)
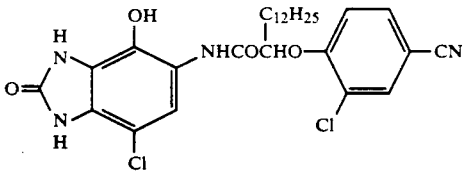
(VI-25)
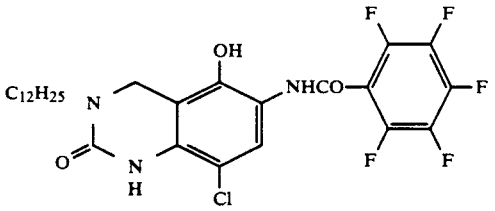
(VI-26)
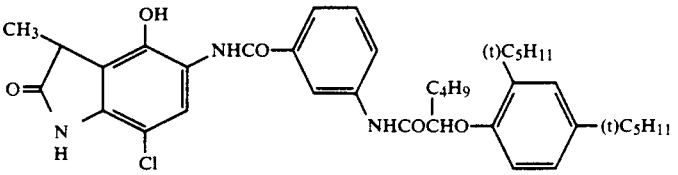

-continued
(VI-27)
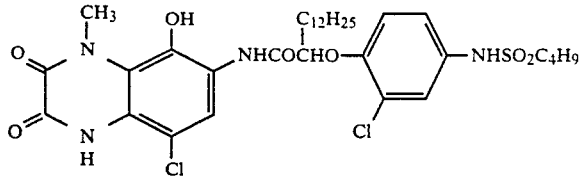
(VI-28)
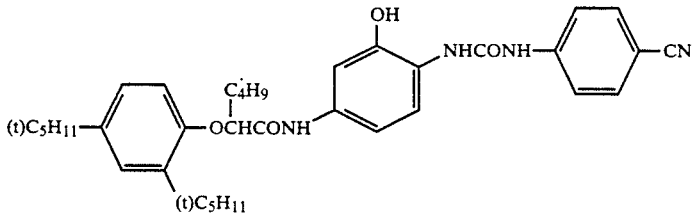
(VI-29)
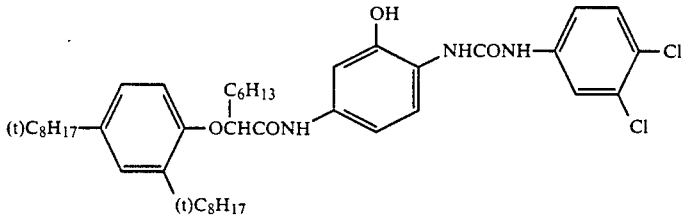
(VI-30)
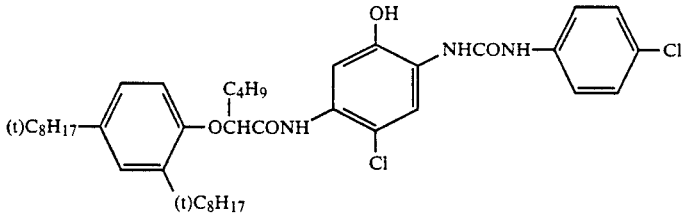
(VI-31)
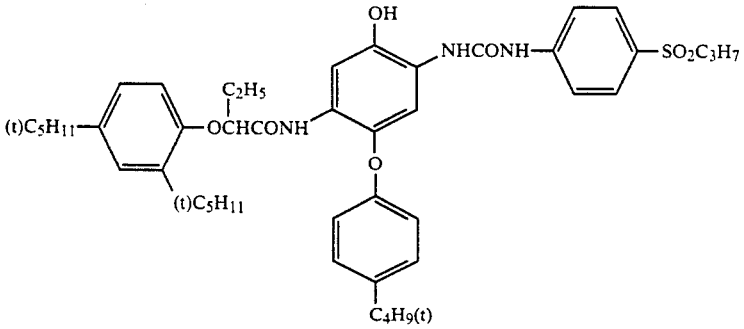
(VI-32)
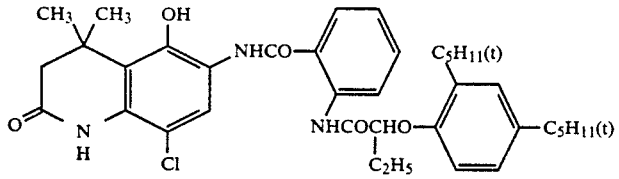
(VI-33)
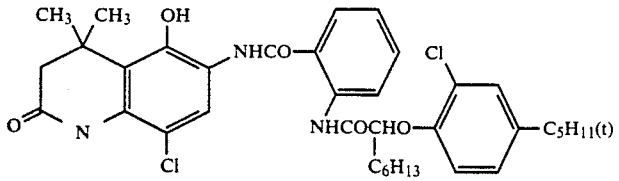

-continued
(IV-34)
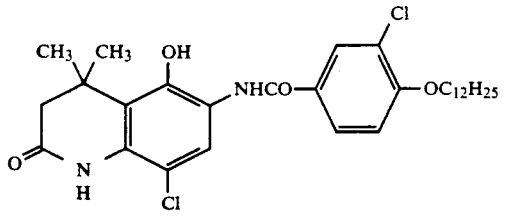
(IV-35)
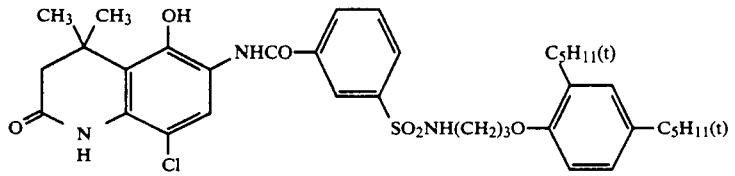
(IV-36)
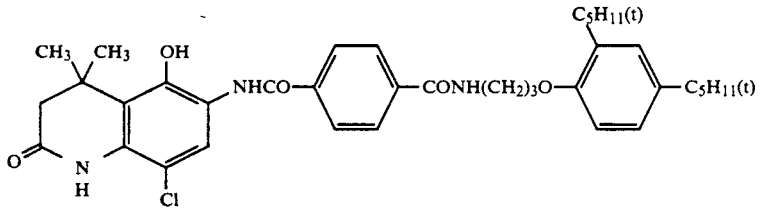
(IV-37)
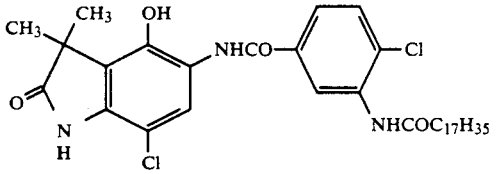
(VI-38)
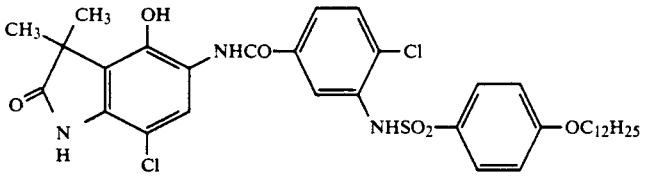
(VI-39)
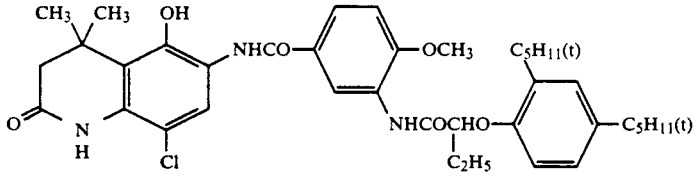
(VI-40)
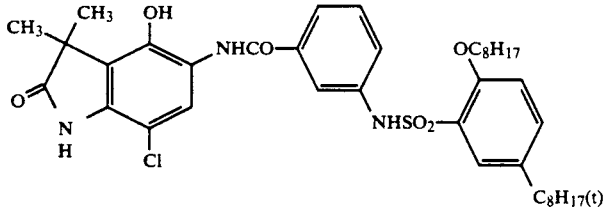
(VI-41)
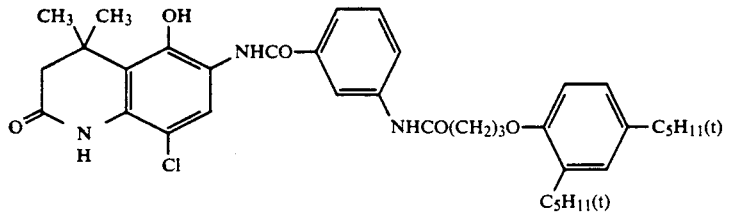

-continued
(VI-42)
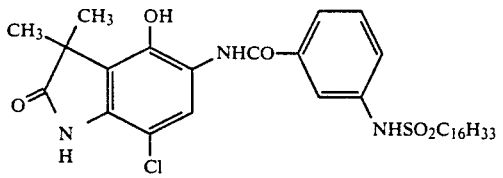
(VI-43)
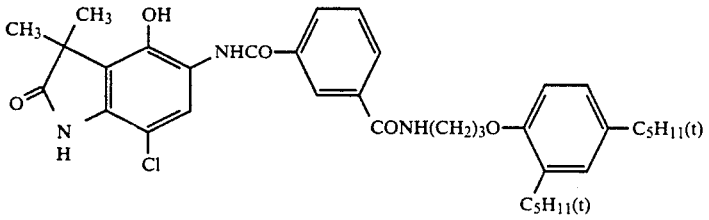
(VI-44)
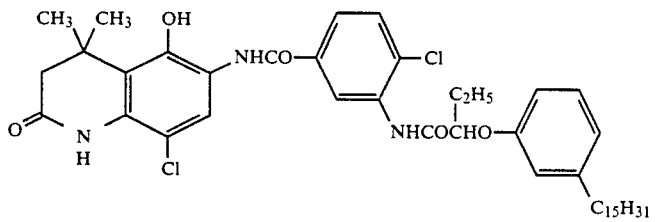
(VI-45)
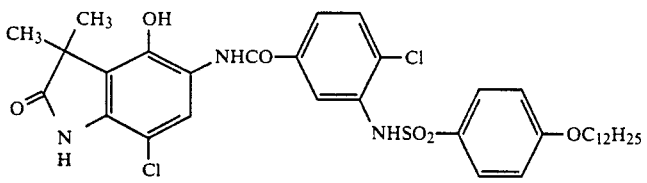
(VI-46)
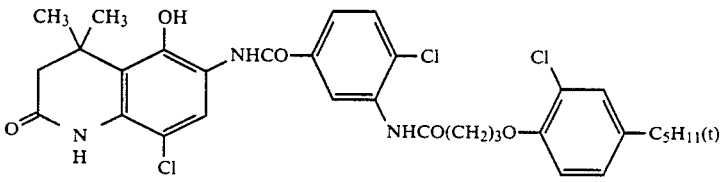
(VII-1)
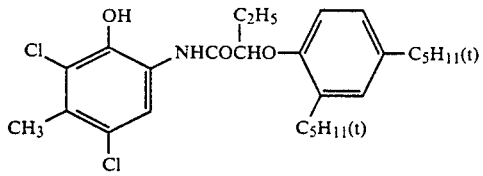
(VII-2)
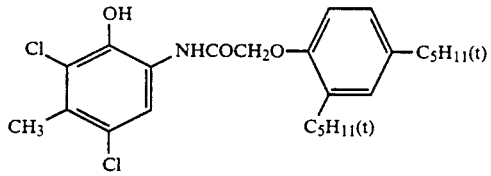
(VII-3)
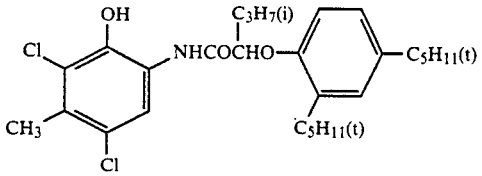

-continued
(VII-4)
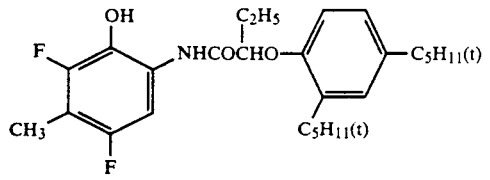
(VII-5)
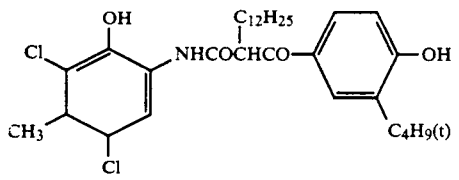
(VII-6)
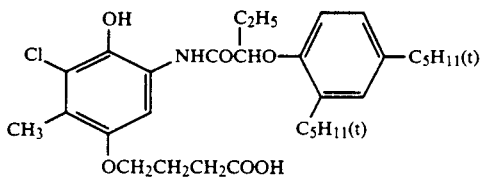
(VII-7)
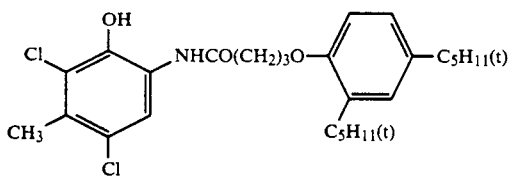
(VII-8)
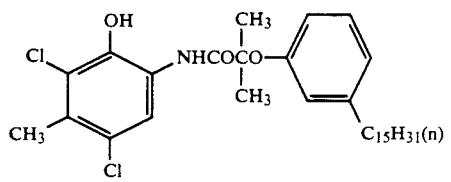
(VII-9)
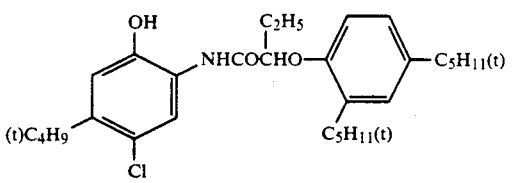
(VII-10)
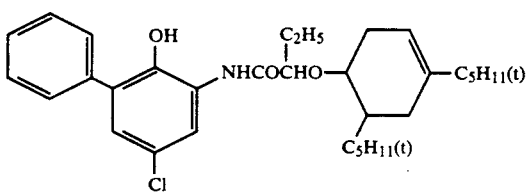
(VII-11)
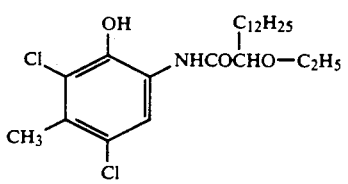

-continued
(VII-12)
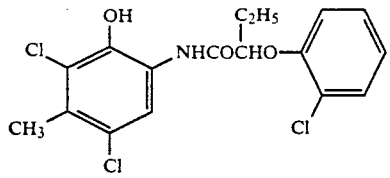
(VII-13)
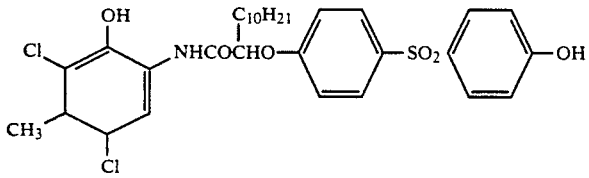
(VII-14)
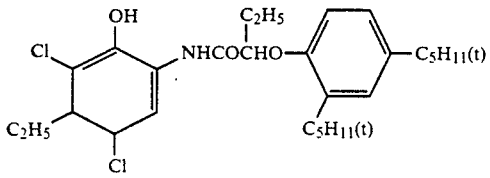
(VII-15)
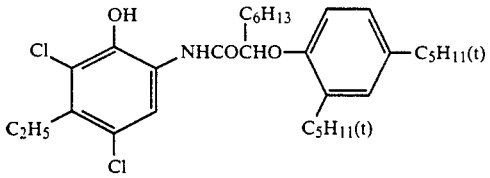
(VII-16)
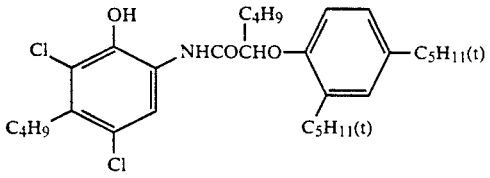
(VII-17)
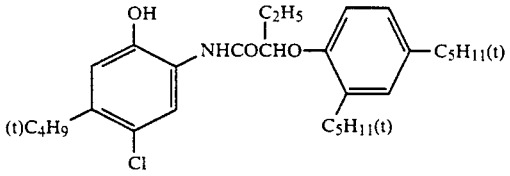
(VII-18)
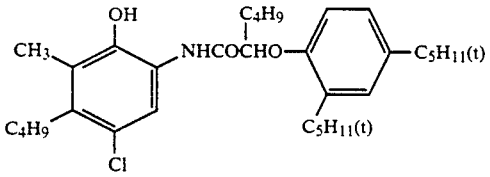
(VII-19)
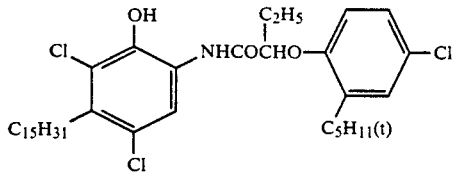

-continued
(VII-20)
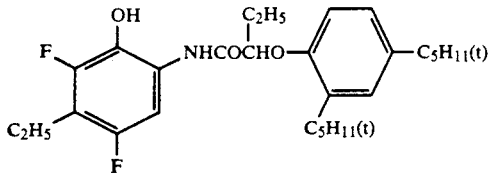
(VII-21)
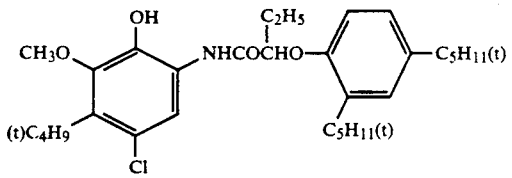
(VII-22)
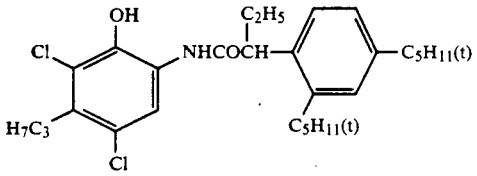
(VII-23)
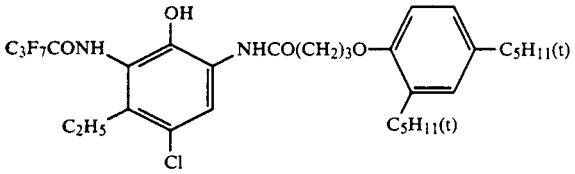
(VII-24)
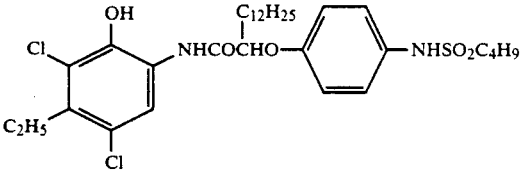
(VII-25)
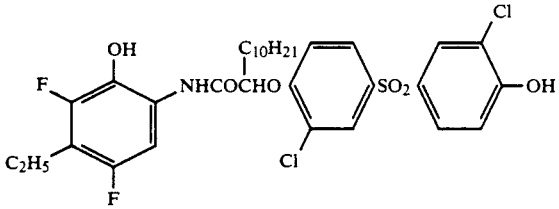
(VII-26)
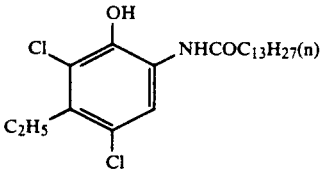
(VII-27)
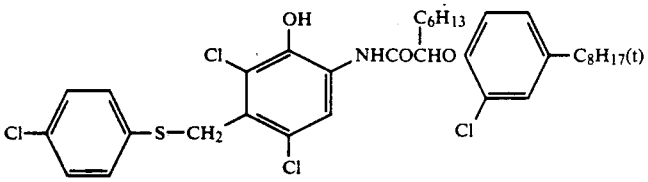

-continued (VII-28)

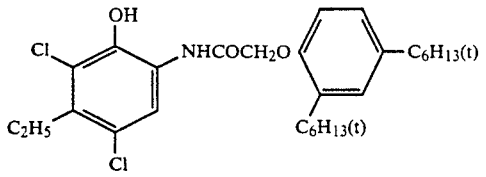

(VII-29)

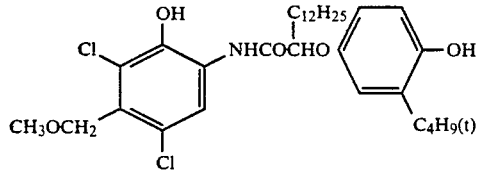

(VII-30)

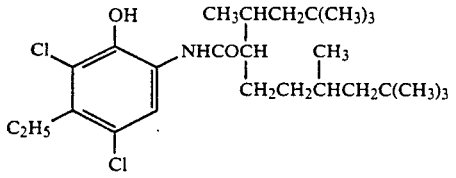

(VII-31)

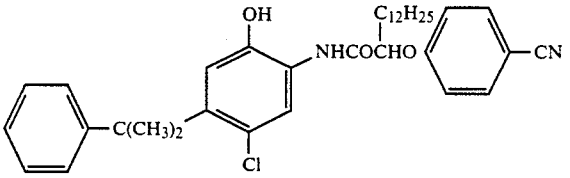

(VII-32)

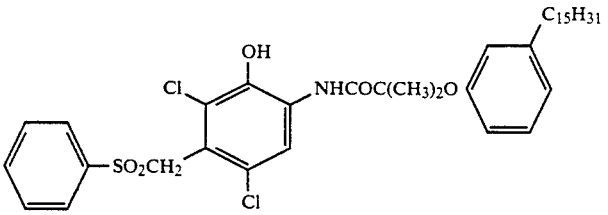

(VII-33)

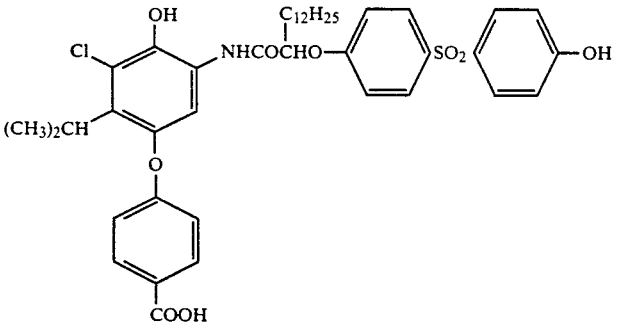

Preferred magenta couplers in the present invention are represented by the formulae (VIII) and (IX):

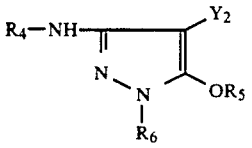

(VIII)

wherein $R_4$ and $R_6$ each represents an aryl group; $R_5$ represents a hydrogen atom, an aliphatic acyl group, an aromatic acyl group, an aliphatic sulfonyl group, or an aromatic sulfonyl group and $Y_2$ represents a hydrogen atom or a releasing group;

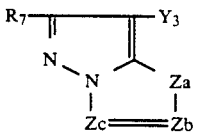

(IX)

wherein $R_7$ represents a hydrogen atom or a substituent; $Y_3$ represents a hydrogen atom or a releasing group; and Za, Zb, and Zc each represents methine, substituted methine, =N—, or —NH—; one of the Za—Zb bond and the Zb—Zc bond is a double bond and the other is a single bond.

When the Zb—Zc bond is a carbon-carbon double bond, the double bond may be a part of an aromatic ring. The magenta coupler of formula (IX) includes a dimer or more polymer at $R_7$ or $Y_3$ or, when Za, Zb, or Zc is a substituted methine, a dimer or more polymer at the substituted methine.

In formula (VIII), a substituent for the aryl group (preferably, phenyl) shown by $R_4$ or $R_6$ is the substituent as described above as those for $R_1$ in formula (VI) and when two or more substituents exist, they may be the same or different.

In formula (VIII), $R_5$ is preferably a hydrogen atom, an aliphatic acyl group, or an aliphatic sulfonyl group, and particularly preferably a hydrogen atom. Also, $Y_2$ is preferably a group of the type releasing by sulfur, oxygen or nitrogen, and is particularly preferably a sulfur atom-releasing group.

The compound represented by formula (IX) is a 5-membered-5-membered condensed nitrogen-containing hetero type coupler (hereinafter, is referred to as 5,5N heterocyclic coupler) and the coloring nucleus thereof has aromaticity which is isoelectric to naphthalene and usually has a chemical structure designated an azapentalene.

Preferred compounds of the couplers represented by formula (IX) are 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, and 1H-pyrazolo[1,5-d]tetrazoles, which are represented by the following formulae (IXa), (IXb), (IXc), (IXd), and (IXe), respectively.

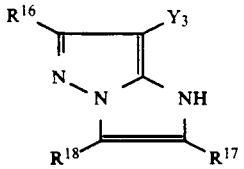
(IXa)

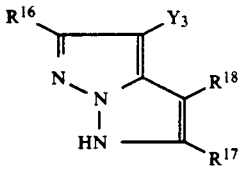
(IXb)

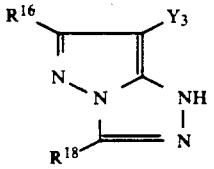
(IXc)

-continued

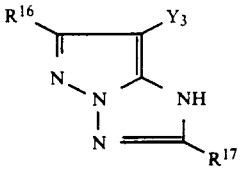
(IXd)

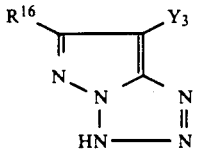
(IXe)

Then, the compounds represented by formulae (IXa) to (IXe) are explained in detail.

In the above formulae, $R^{16}$, $R^{17}$, and $R^{18}$ each represents an aliphatic group, an aromatic group, or a heterocyclic group and these groups may be substituted by at least one of the substituents which are allowed as substituents for $R_1$ in formula (VI). $R^{16}$, $R^{17}$, and $R^{18}$ may further represent $$RO-,\ R\underset{\underset{O}{\|}}{C}-,\ R\underset{\underset{O}{\|}}{C}O-,\ RSO-,\ RSO_2-,$$

$$RSO_2NH-,\ R\underset{\underset{O}{\|}}{C}NH-,\ RNH-,\ RS-,\ RO\underset{\underset{O}{\|}}{C}NH-$$

(wherein R represents an alkyl group, an aryl group, or a heterocyclic group), a hydrogen atom, a halogen atom, a cyano group, or an imide group.

In the above formulae, $R^{16}$, $R^{17}$, and $R^{18}$ may be further a carbamoyl group, a sulfamoyl group, a ureido group, or a sulfamoylamino group and the nitrogen atoms of these groups may be substituted by the substituent allowable for $R_1$ in formula (VI).

In the aforesaid formulae, $Y_3$ represents a hydrogen atom or a releasing group.

Also, $R^{16}$, $R^{17}$, $R^{18}$, or $Y_3$ may form a divalent group to form a dimer or may become a divalent group bonding the main chain of a polymer and a coupler chromophore.

In the aforesaid formulae, $R^{16}$, $R^{17}$, and $R^{18}$ is preferably a hydrogen atom, a halogen atom, an aliphatic group, an aromatic group, a heterocyclic group, RO—, RCONH—, $RSO_2NH$—, RNH—, RS—or ROCONH—. Also, $Y_3$ *is preferably a halogen atom, an acylamino group, an imido group, an aliphatic or aromatic sulfonamide group, a* 5-membered or 6-membered nitrogen-containing heterocyclic ring bonded to the coupling active position by a nitrogen atom, an aryloxy group, an alkoxy group, an arylthio group, or an alkylthio group.

Specific examples of the preferred magenta couplers represented by formulae (VIII) and (IX) are illustrated below.

(VIII-1)
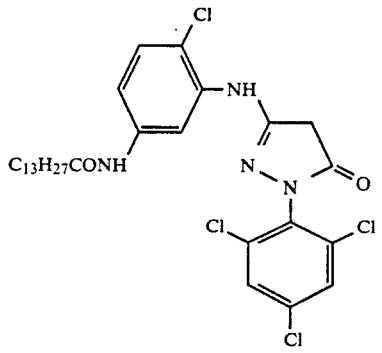
(VIII-2)
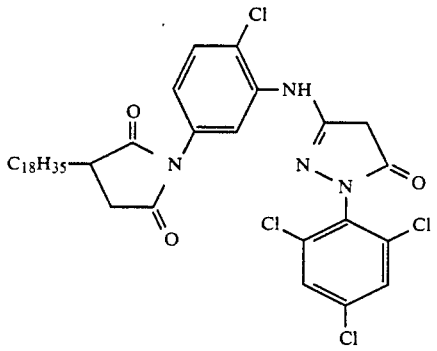
(VIII-3)
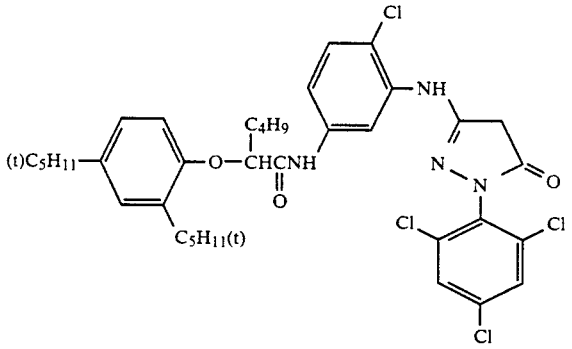
(VIII-4)
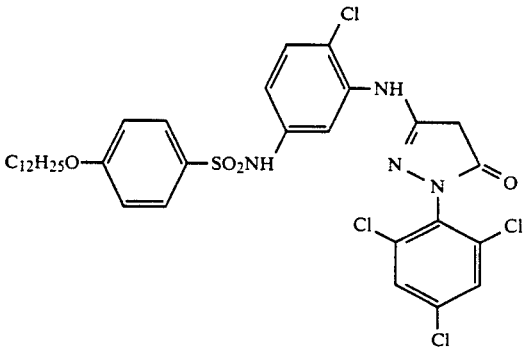

-continued
(VIII-5)
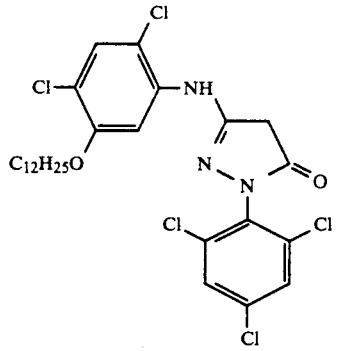
(VIII-6)
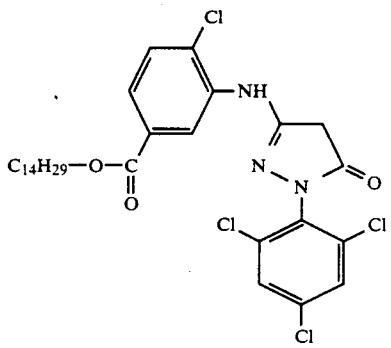
(VIII-7)
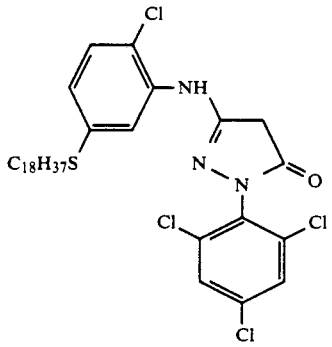
(VIII-8)
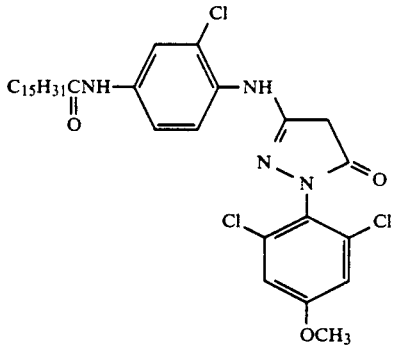
(VIII-9)
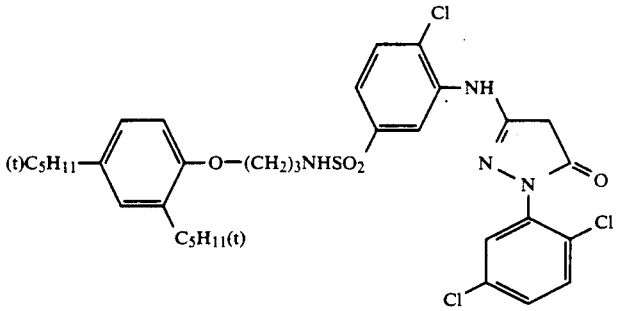

-continued
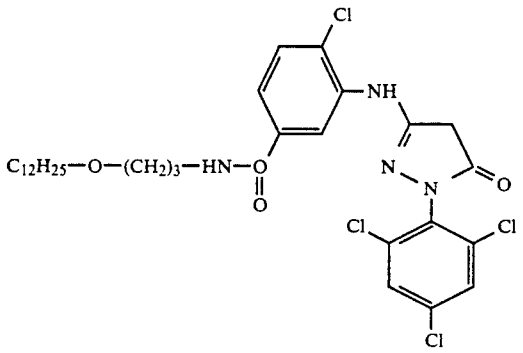
(VIII-10)
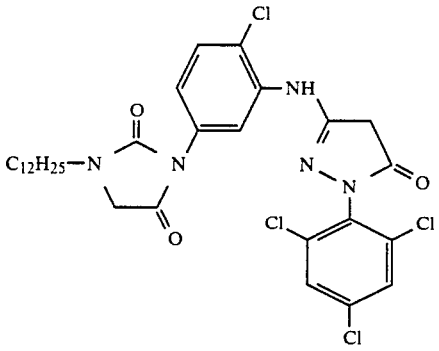
(VIII-11)
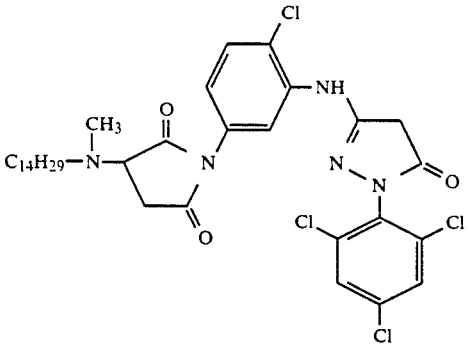
(VIII-12)
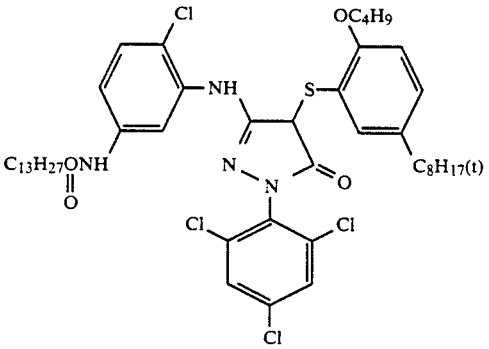
(VIII-13)

-continued
(VIII-14)
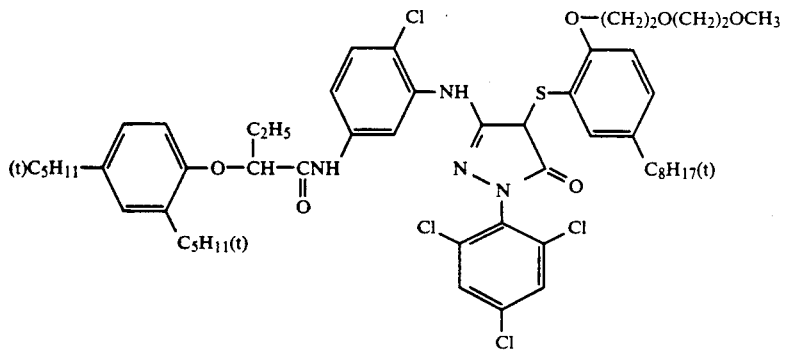
(VIII-15)
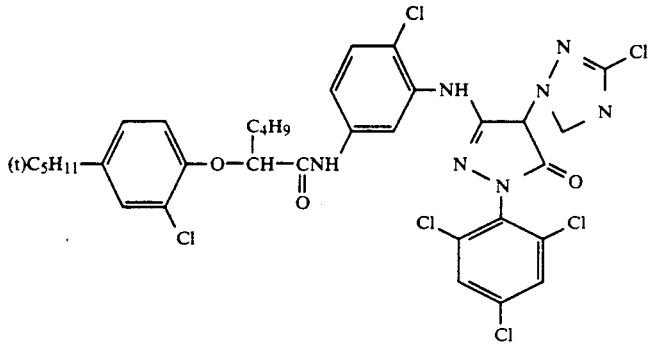
(IX-1)
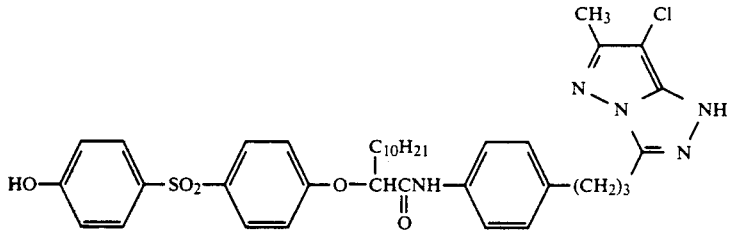
(IX-2)
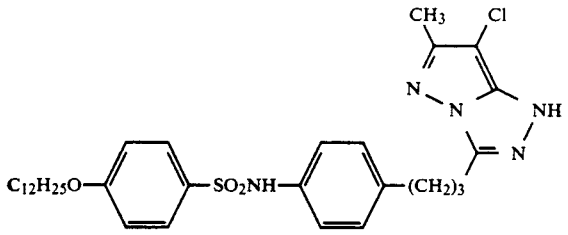
(IX-3)
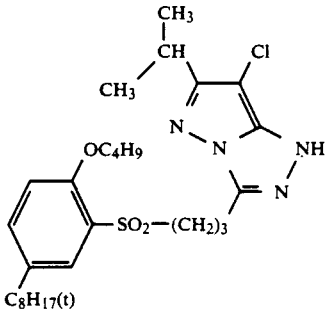

-continued
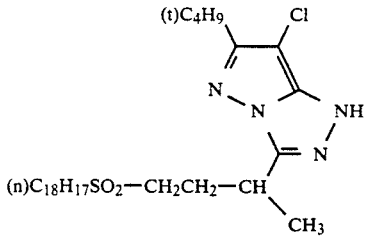
(IX-4)
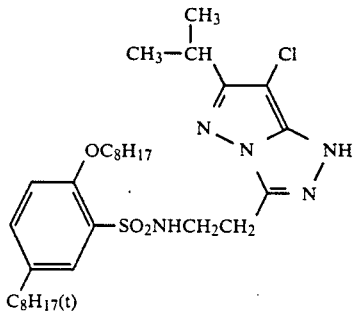
(IX-5)
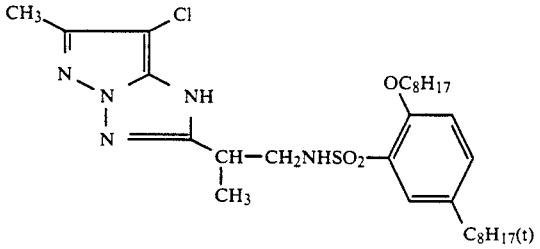
(IX-6)
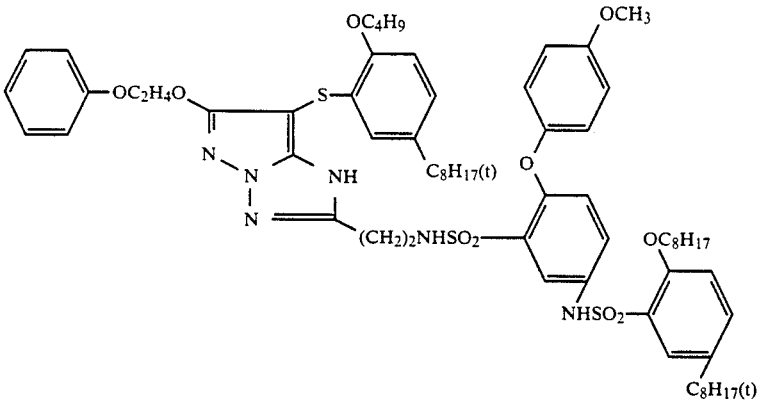
(IX-7)
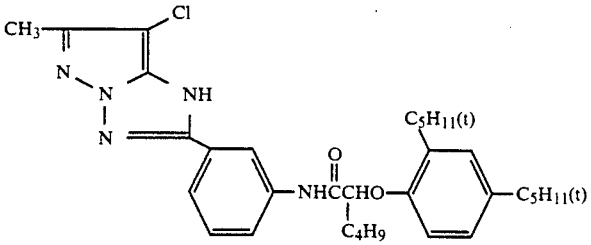
(IX-8)

-continued
(IX-9)
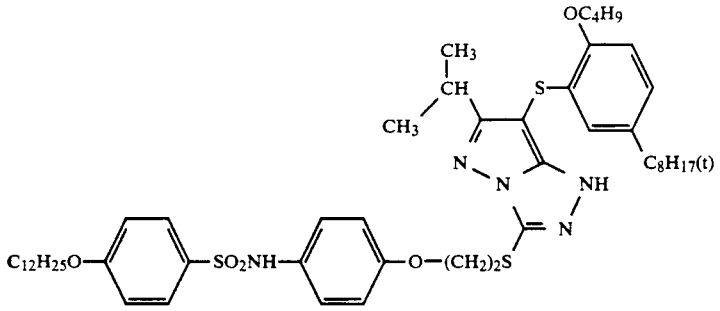
(IX-10)
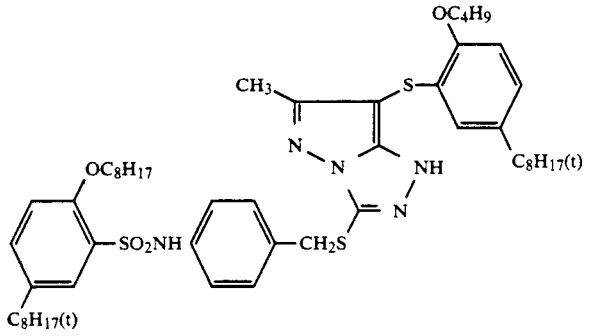
(IX-11)
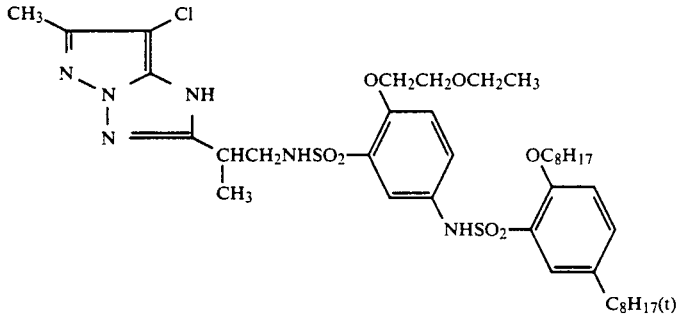
(IX-12)
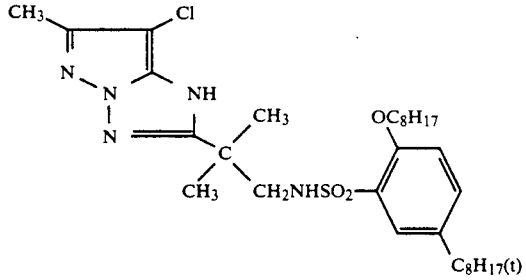
(IX-13)
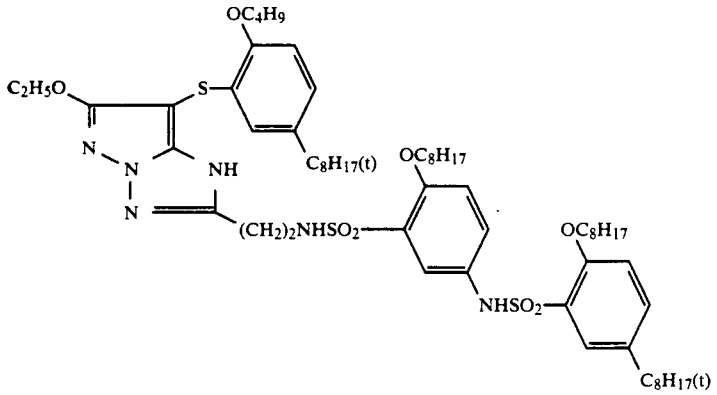

-continued
(IX-14)
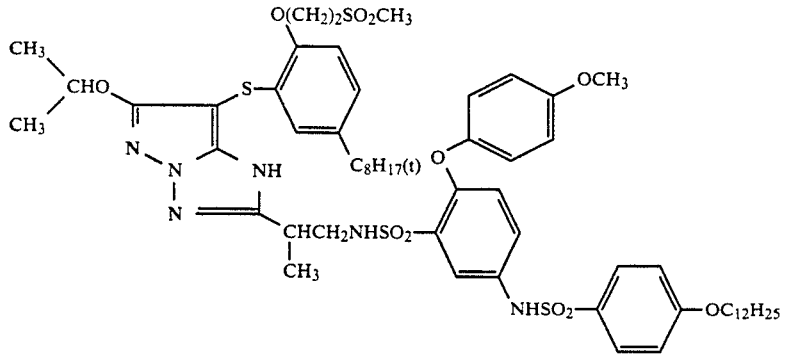
(IX-15)
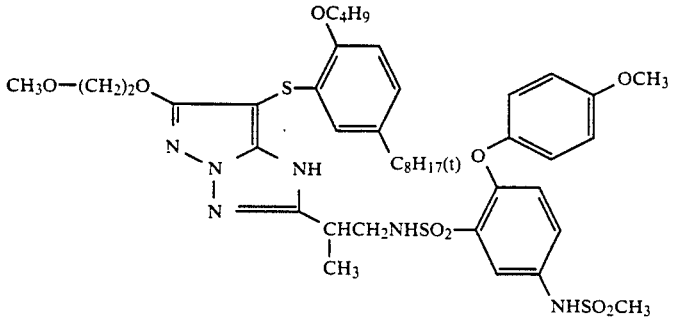
(IX-16)
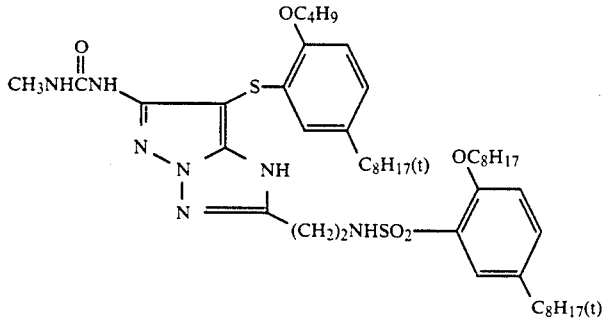
(IX-17)
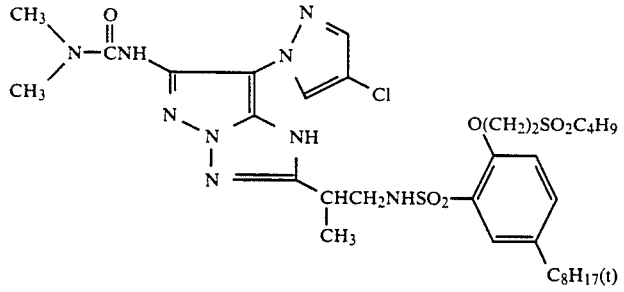
(IX-18)
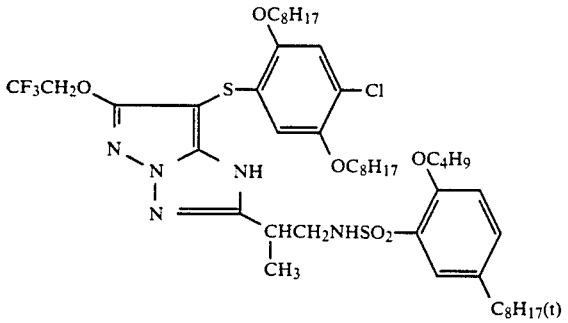

-continued
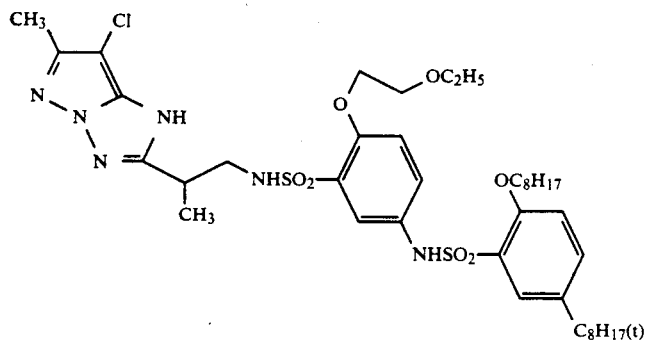
(IX-19)
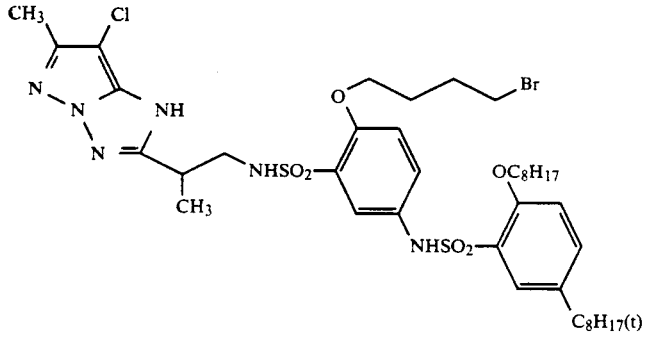
(IX-20)
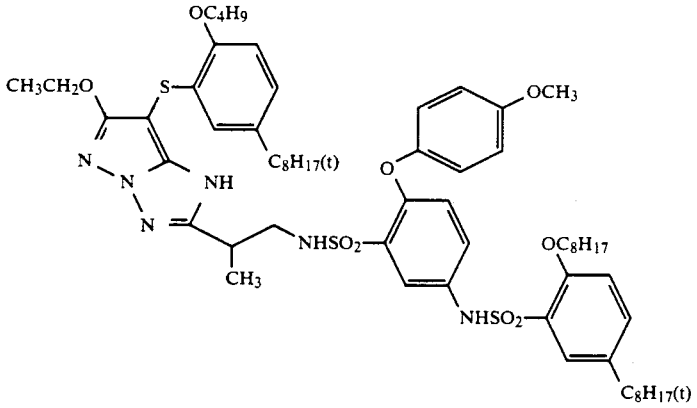
(IX-21)
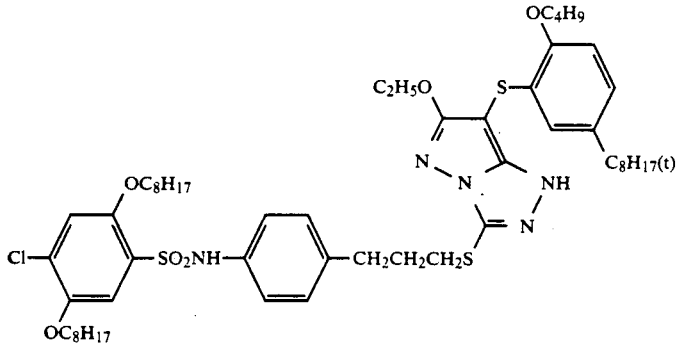
(IX-22)

-continued
(IX-23)
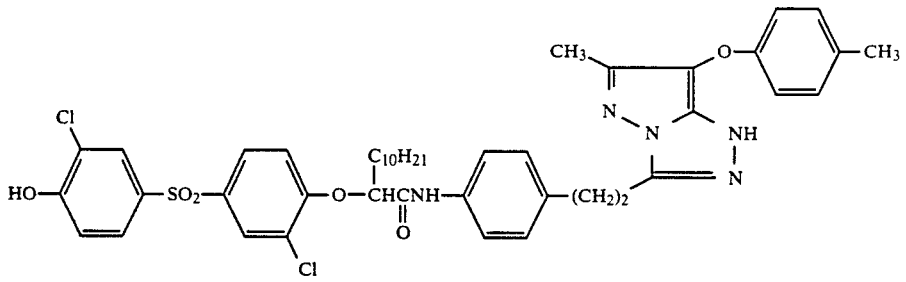
(IX-24)
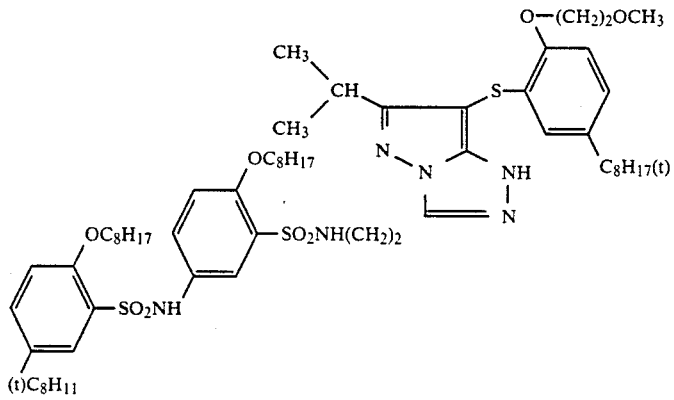
(IX-25)
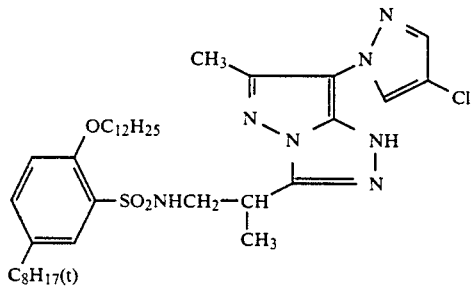
(IX-26)
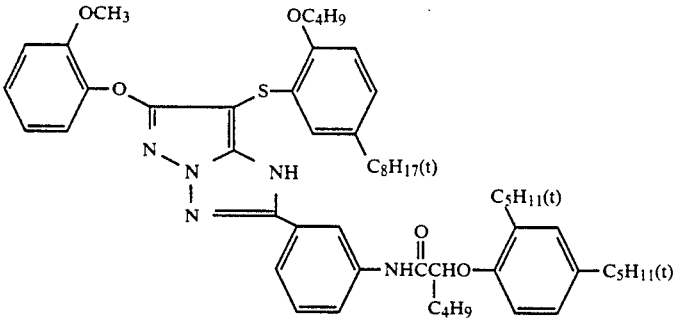
(IX-27)
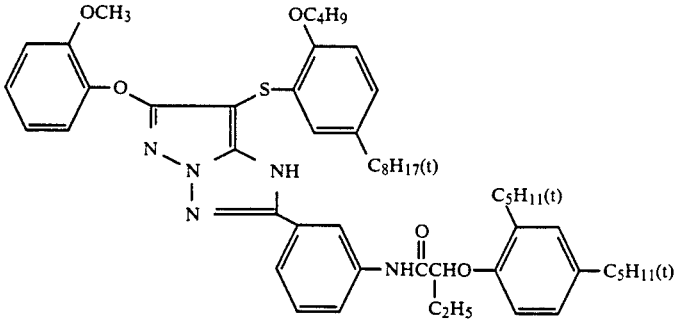

-continued
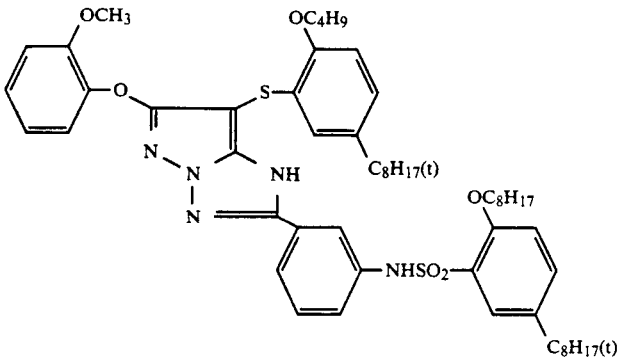
(IX-28)
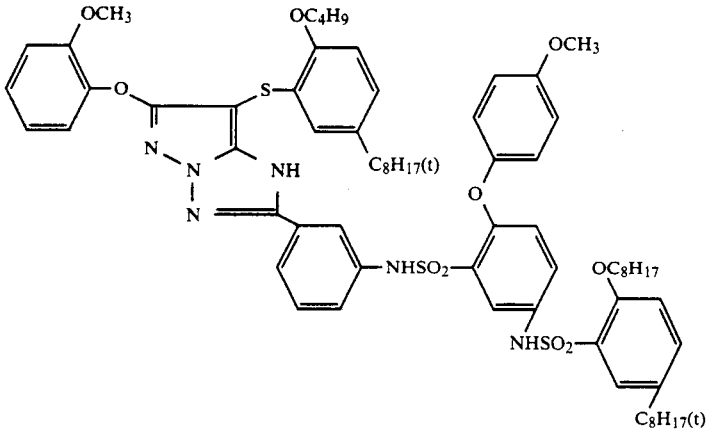
(IX-29)
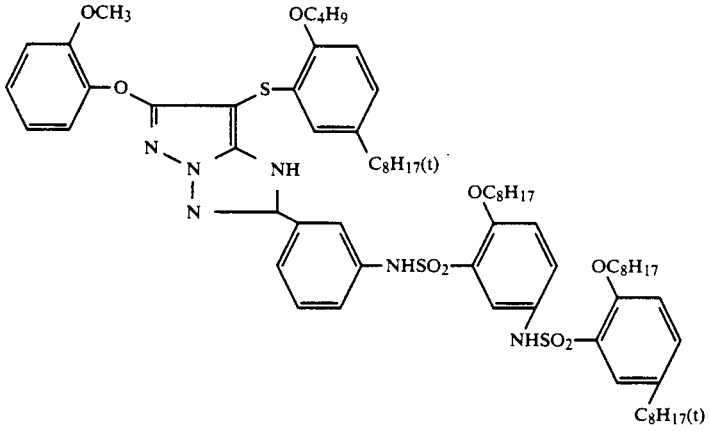
(IX-30)
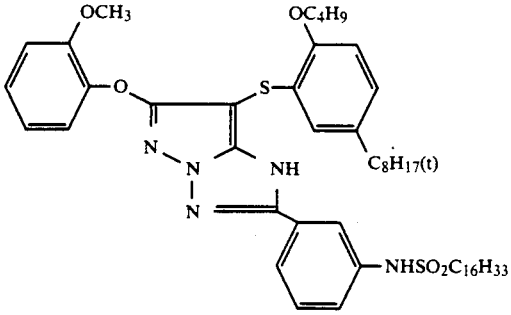
(IX-31)

-continued

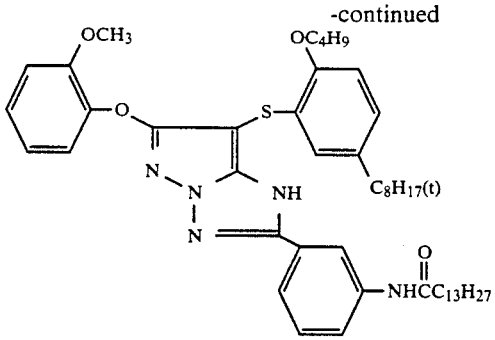

(IX-32)

The preferred yellow couplers for use in the present invention are shown by the formula (X):

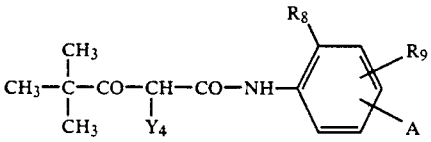

(X)

wherein $R_8$ represents a halogen atom or an alkoxy group; $R_9$ represents a hydrogen atom, a halogen atom, or an alkoxy group; A represents $—NHCOR_{10}$, $—NHSO_2—R_{10}$, $—SO_2NHR_{10}$, $—COOR_{10}$, or $$—SO_2\underset{\underset{R_{11}}{|}}{N}—R_{10}$$

(wherein $R_{10}$ and $R_{11}$ each represents an alkyl group); and $Y_4$ represents a releasing group.

In formula (X), the groups represented by $R_9$ and $R_{10}$ may be substituted by the substituents allowable for $R_1$ in formula (VI) and the releasing group represented by $Y_4$ includes the groups represented by formulae (Xa) to (Xg):

$$\overset{|}{O}R_{20} \quad \text{(Xa)}$$

wherein $R_{20}$ represents an aryl group or a heterocyclic group, each may be substituted;

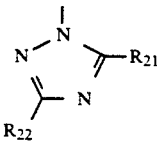

(Xb)

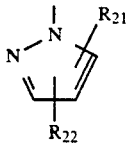

(Xc)

wherein $R_{21}$ and $R_{22}$ each represents a hydrogen atom, a carboxylic acid ester group, an amino group, an alkyl group, an alkylthio group, an alkoxy group, an alkoxysulfonyl group, an alkylsulfinyl group, a carboxylic acid group, a sulfonic acid group, a substituted or unsubstituted phenyl group, or a substituted or unsubstituted heterocyclic group. Also, $R_{21}$ and $R_{22}$ may be the same or different.

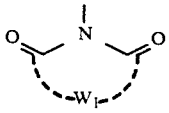

(Xd)

wherein $W_1$ represents a nonmetallic atom required for forming a 4-membered to 6-membered ring together with

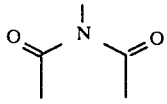

in the formula.

In the groups represented by formula (Xd), the groups represented by the following formulae (Xe) to (Xg) are preferred.

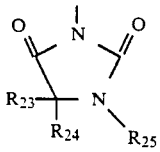

(Xe)

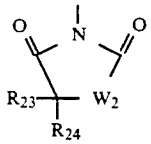

(Xf)

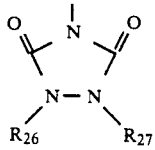

(Xg)

wherein $R_{23}$ and $R_{24}$ each represents a hydrogen atom, an alkyl group, an aryl group, an alkoxy group, an aryloxy group, or a hydroxy group; $R_{25}$, $R_{26}$, and $R_{27}$ each represents a hydrogen atom, an alkyl group, an aryl group, an aralkyl group, or an acyl group, and $W_2$ represents an oxygen atom or a sulfur atom.

Specific examples of these couplers are illustrated below.

(X-1)
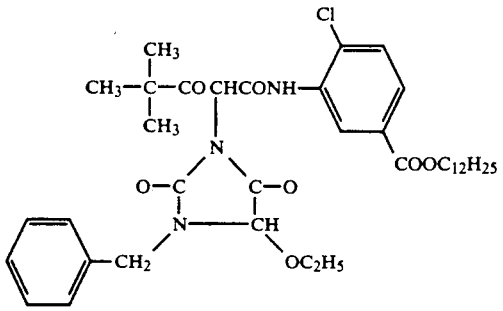
(X-2)
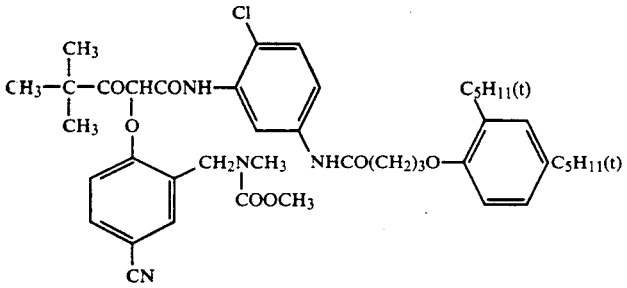
(X-3)
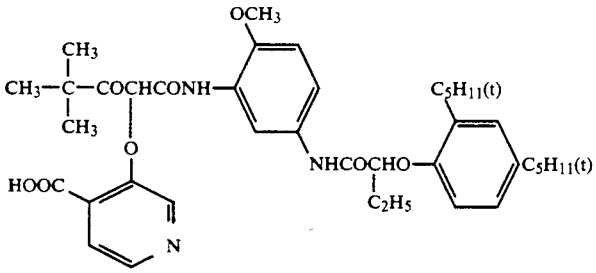
(X-4)
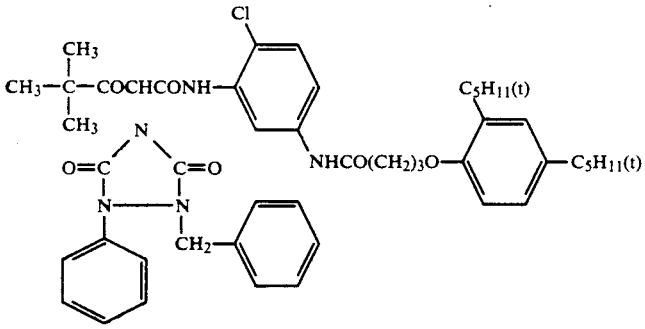
(X-5)
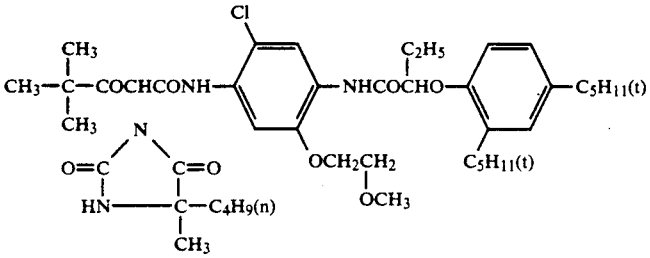

-continued
(X-6)
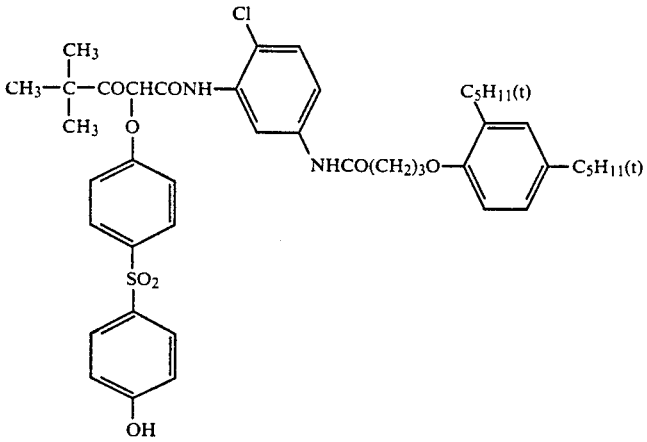
(X-7)
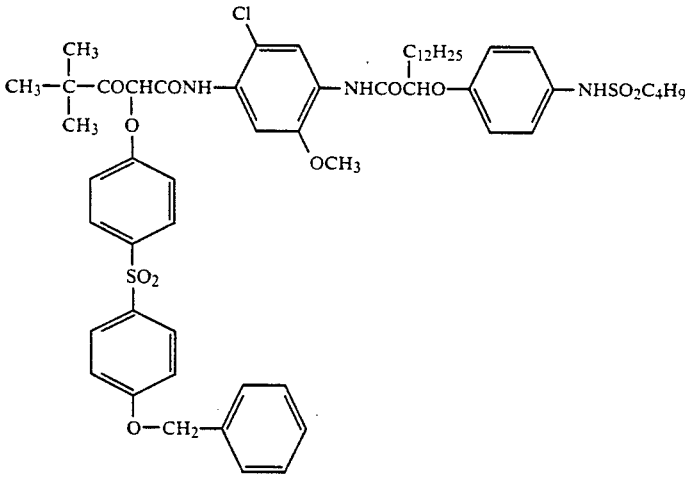
(X-8)
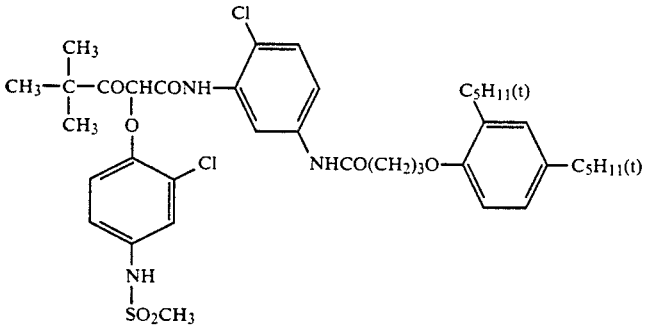
(X-9)
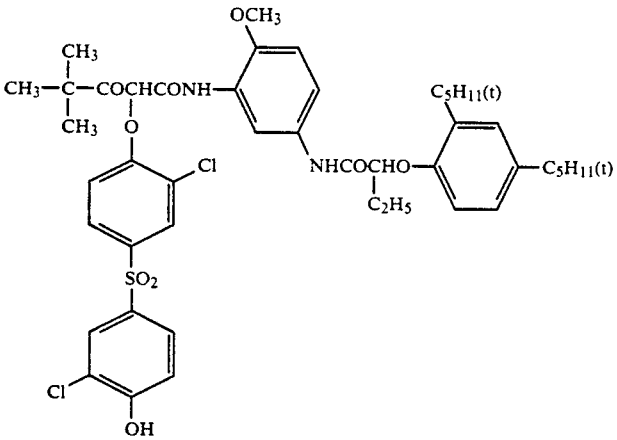

-continued
(X-10)
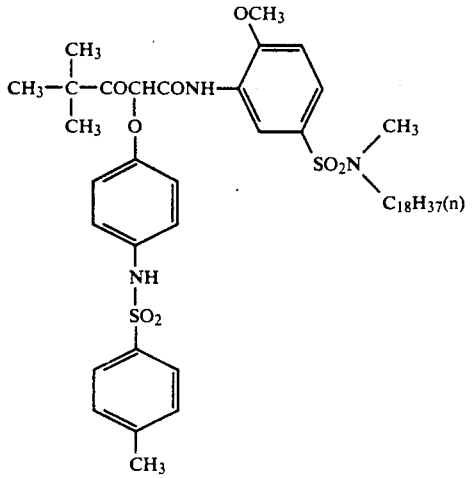
(X-11)
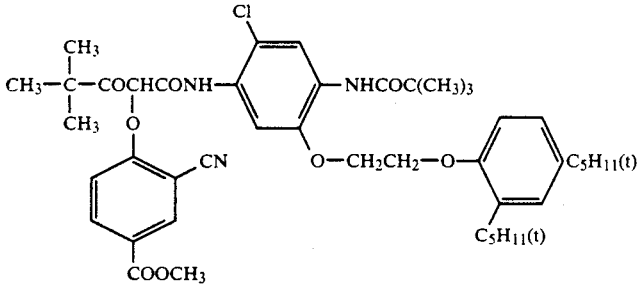
(X-12)
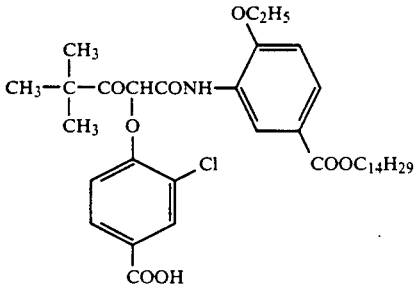
(X-13)
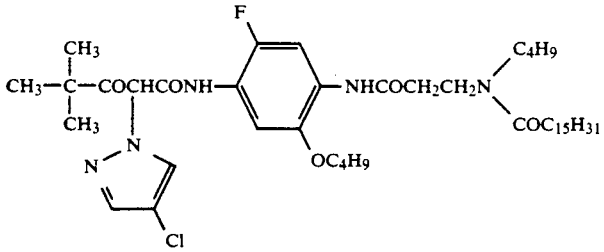
(X-14)
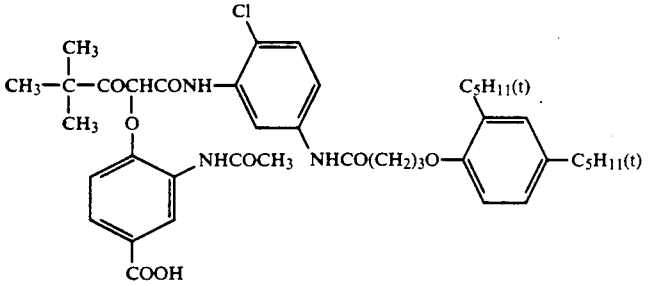

-continued
(X-15)
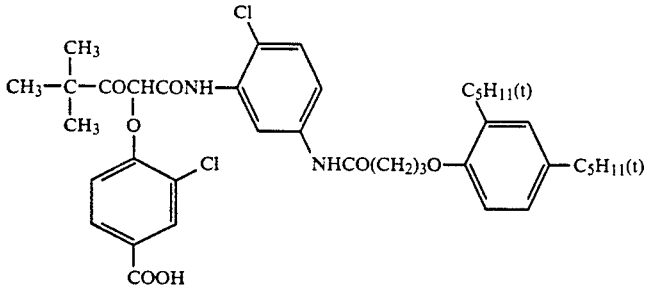
(X-16)
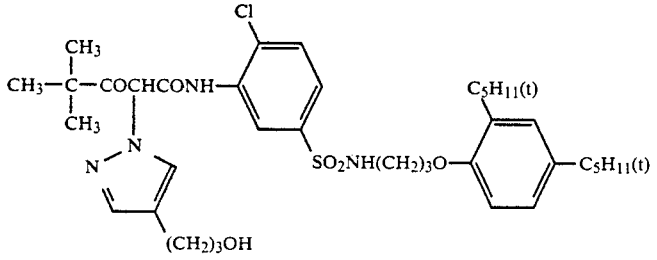
(X-17)
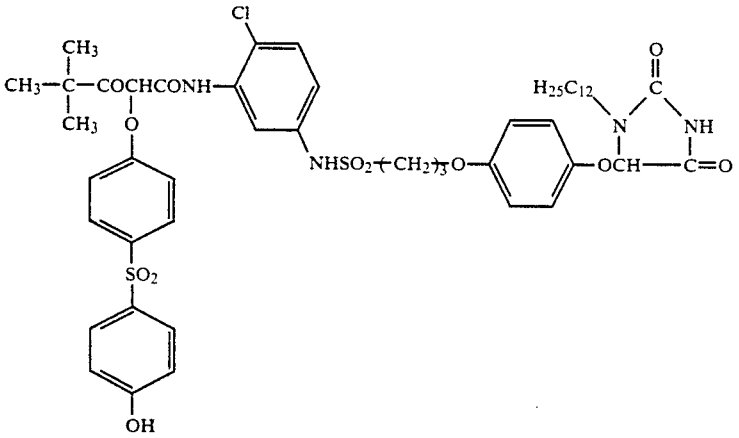
(X-18)
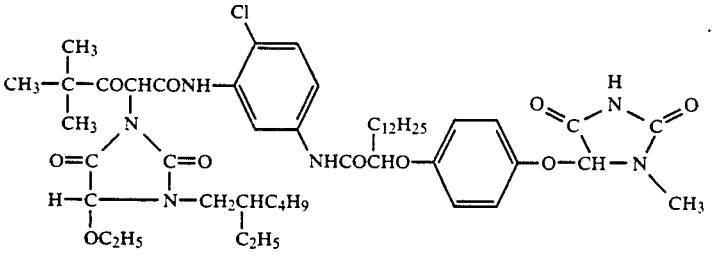
(X-19)
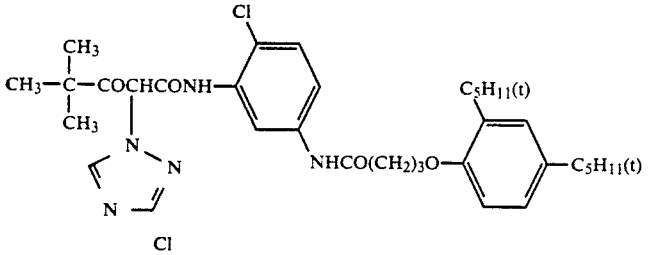

-continued
(X-20)
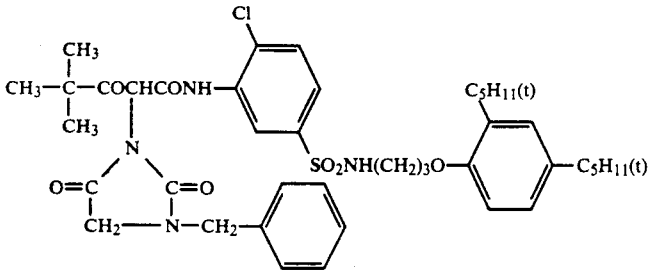
(X-21)
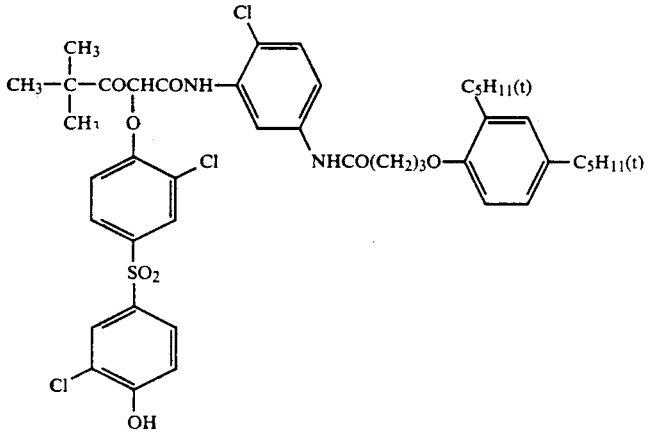
(X-22)
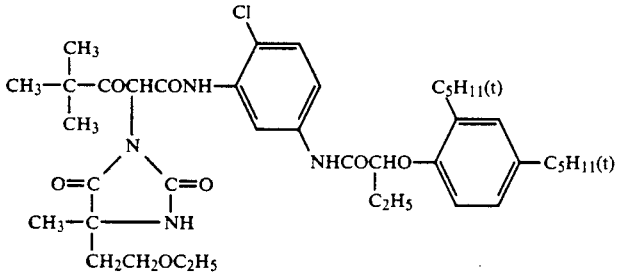
(X-23)
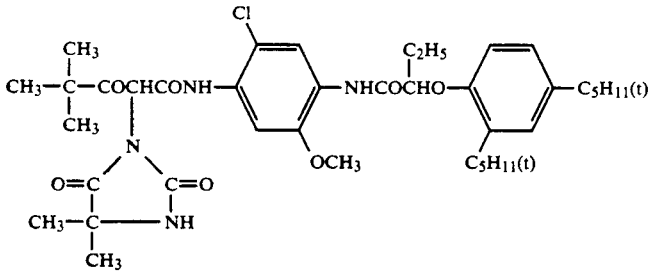
(X-24)
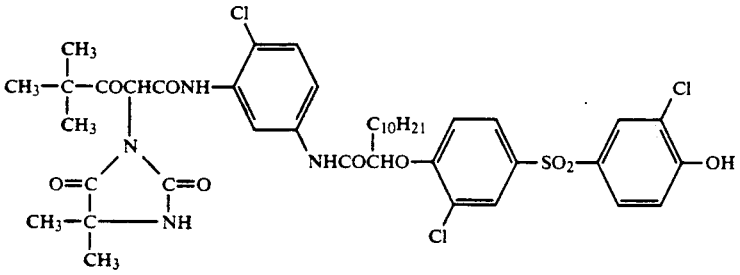

-continued
(X-25)
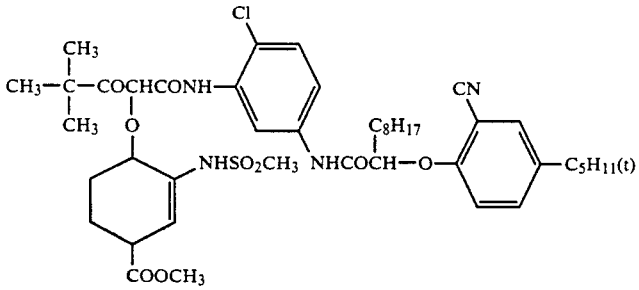
(X-26)
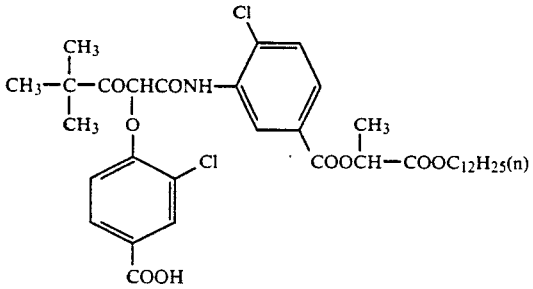
(X-27)
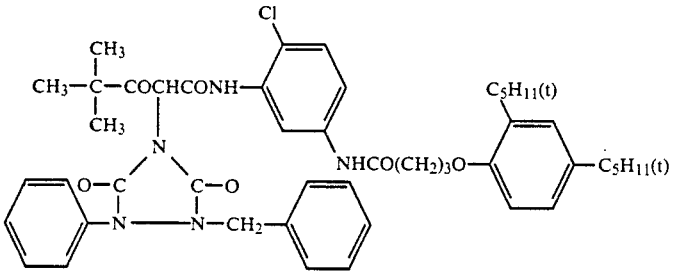
(X-28)
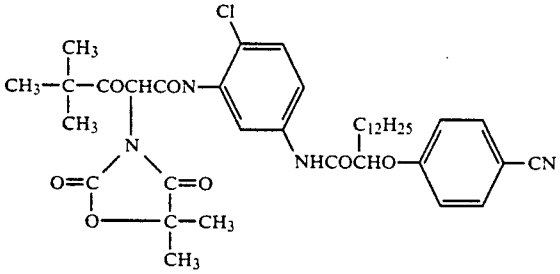
(X-29)
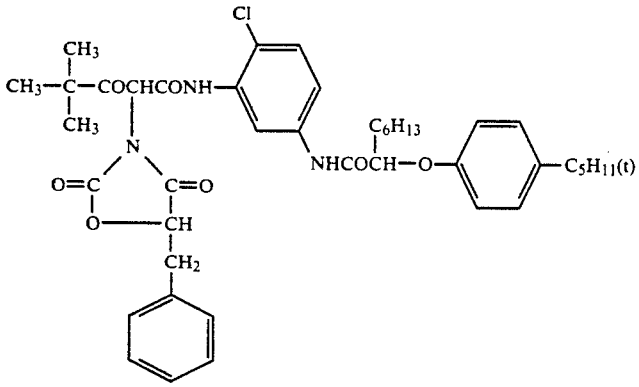

-continued
(X-30)
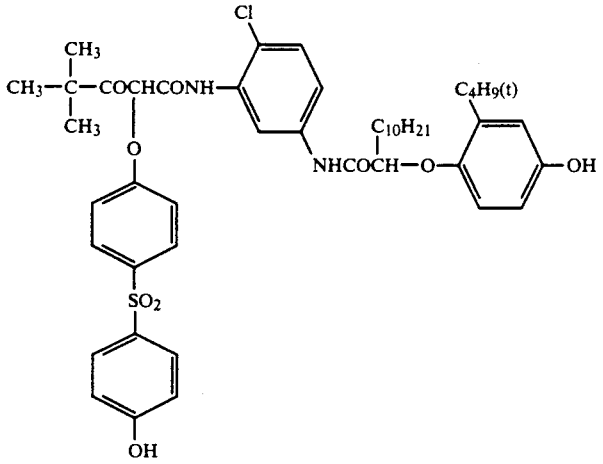
(X-31)
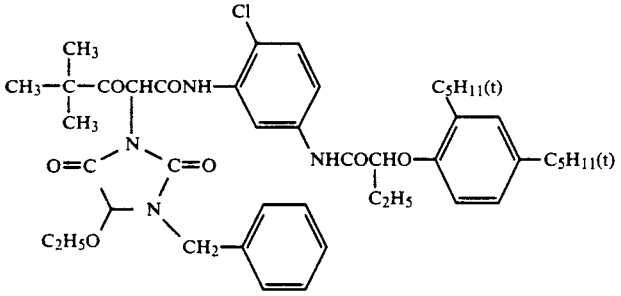
(X-32)
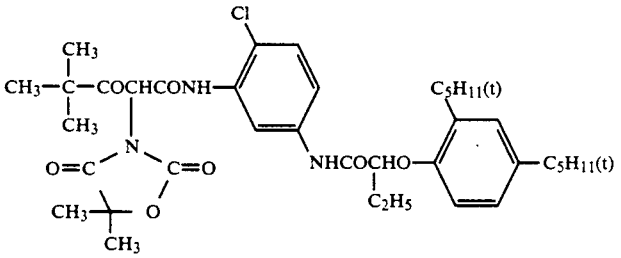
(X-33)
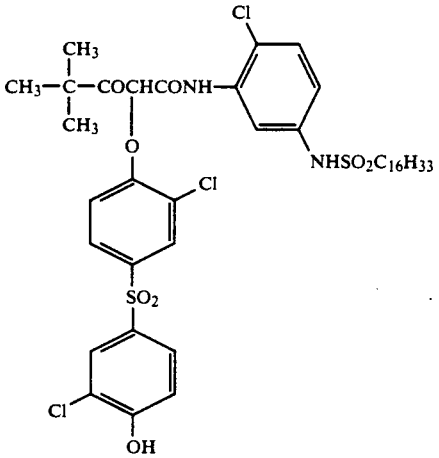

-continued (X-34)

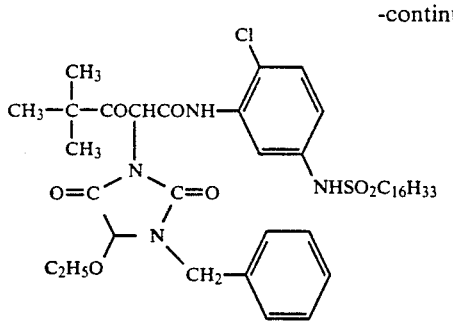

The couplers represented by the aforesaid formula (VI) and (VII) or formulae (VIII), (IX), and (X) are incorporated in silver halide emulsion layers of the silver halide color photographic materials in an amount of usually from 0.1 mol to 1.0 mol, and preferably from 0.1 mol to 0.5 mol, per mol of silver halide in the layer. Also, the mol ratio of the coupler(s) represented by the formula (VI) or (VII)/the coupler represented by formula (VIII) or (IX)/the coupler represented by formula (X) is usually in the range of from 1/0.2 to 1.5/0.5 to 1.5 but other ratios than these can be also employed.

In the present invention, for adding couplers to silver halide emulsion layers, various techniques can be employed. Usually, an oil-in-water method known as an oil protect method can be employed. That is, after dissolving the coupler in an organic solvent, the solution is dispersed by emulsification in an aqueous gelatin solution containing a surface active agent. Alternatively, water or an aqueous gelatin solution may be added to an organic solvent solution of the gelatin containing a surface active agent to form an oil-in-water dispersion with phase transfer. Also, in the case of an alkali-soluble coupler, the coupler can be dispersed by a so-called Fisher dispersion method. Furthermore, after removing a low boiling organic solvent from a coupler dispersion by distillation, noodle washing, or ultrafiltration, the dispersion may be mixed with a silver halide emulsion.

As a dispersion medium for such couplers, a high boiling organic solvent having a dielectric constant (25° C.) of from 2 to 20 and a reflective index (25° C.) of from 1.3 to 1.7 and/or a water-insoluble high molecular weight compound is used.

Examples of high boiling organic solvents are those having a boiling point of higher than 160° C., such as phthalic acid alkyl esters (e.g., dibutyl phthalate and dioctyl phthalate), phosphoric acid esters (e.g., diphenyl phosphate, triphenyl phosphate, tricresyl phosphate, and dioctylbutyl phosphate), citric acid esters (e.g., tributyl acetyl citrate), benzoic acid esters (e.g., octyl benzoate), alkylamides (e.g., diethyllaurylamide), fatty acid esters (e.g., dibutoxyethyl succinate and dioctyl azelate), and phenols (e.g., 2,4-di-(t)-amylphenol).

Examples of water-insoluble high molecular weight compounds are the compounds described in JP-B-60-18978, columns 18–21 and vinyl polymers (including homopolymers and copolymers) containing an acrylamide or a methacrylamide as a monomer component.

Specific examples thereof are polymethyl methacrylate, polyethyl methacrylate, polybutyl methacrylate, polycyclohexyl methacrylate, and poly-t-butylacrylamide.

Also, if desired, a low boiling organic solvent having a boiling point of from 30° C. to 150° C., such as a lower alkyl acetate, ethyl propionate, secondary butyl alcohol, methyl isobutyl ketone, β-ethoxyethyl acetate, methyl cellosolve acetate, etc., can be used together with the high boiling organic solvent and/or the water-insoluble high molecular weight compound.

The molecular weight and the polymerization degree of the water-insoluble high molecular weight compound for use in the present invention do not substantially greatly influence the effect of the present invention but as the molecular weight thereof becomes higher, the problems occur in that a long time is required to dissolve the compound in a solvent, the solution thereof is difficult to disperse by emulsification due to the high viscosity of the solution to form coarse particles, whereby the coloring property is reduced and also the coating property is reduced.

To solve these problems, it may be considered to reduce the viscosity of the solution by using a large amount of solvent but such a counterplan gives rise to new problems in processing.

From the aforesaid viewpoints, the viscosity of the water-insoluble high molecular weight compound is preferably not higher than 5,000 cps (at 25° C.), and more preferably not higher than 2,000 cps (at 25° C.) when 30 g of the compound is dissolved in 100 ml of an auxiliary solvent. Also, the molecular weight of the water-insoluble high molecular weight compound is preferably 150,000 or less, more preferably 80,000 or less, and particularly preferably 30,000 or less.

The ratio of the water-insoluble high molecular weight compound for use in the present invention to the auxiliary solvent depends upon the kind of the compound and varies over a wide range according to the solubility in the auxiliary solvent, the polymerization degree, the solubility of a coupler, etc. However, the amount of the auxiliary solvent necessary for providing a sufficiently low viscosity so that a solution of at least a coupler, a high boiling organic solvent (coupler solvent), and the water-insoluble high molecular weight compound dissolved in the auxiliary solvent can be easily dispersed in water or an aqueous hydrophilic colloid solution is used. The ratio of the water-insoluble high molecular weight compound to the auxiliary solvent is usually in the range of from 1/1 to 50/1 by weight. Also, the ratio of the high molecular weight compound to the coupler is preferably from 1/20 to 20/1, and more preferably 1/10 to 10/1.

In the present invention, two or more kinds of couplers selected from couplers represented by formula (VI) or (VII), formula (VIII) or (IX), and formula (X) can be used in combination. The couplers can be emulsified alone or in combination and further may be used in combination with fading inhibitors.

The color photographic material processed by the process of the present invention can, if desired, contain specific coupler(s) in addition to the aforesaid color couplers represented by the formulae described above. For example, a colored magenta coupler can be used for a green-sensitive emulsion layer to impart thereto a masking effect.

Also, for each color-sensitive emulsion layer or layer adjacent thereto, a development inhibitor-releasing coupler (DIR coupler) or a development inhibitor-releasing hydroquinone together with the color coupler(s) described above can be used. The development inhibitor released from the above-described compound on development has an interlayer effect such as the improvement of the sharpness of images formed, fining of graininess of the images, or the improvement of monochromatic saturation.

In the present invention, the color photographic material can contain ultraviolet absorbent(s) in an optional layer thereof. Ultraviolet absorbent(s) are incorporated in, preferably, the layer containing the compound represented by formula (VI) or (VII) or a layer adjacent thereto.

The ultraviolet absorbents for use in the present invention are the compounds described in *Research Disclosure,* No. 17643, VIII-C but are preferably benzotriazole derivatives represented by the following formula (XI):

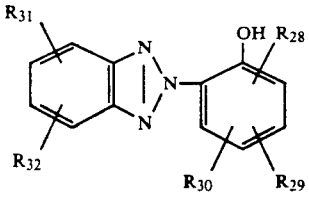

(XI)

wherein $R_{28}$, $R_{29}$, $R_{30}$, $R_{31}$, and $R_{32}$, which may be the same or different, each represents a hydrogen atom or an aromatic group which may be substituted by the substituent allowable for $R_1$ in formula (VI) as described above, and also $R_{31}$ and $R_{32}$ may combine to form a 5-membered or 6-membered aromatic ring composed of carbon atoms. The aromatic ring may be substituted by the substituent allowable for $R_1$ in formula (VI).

The compounds shown by formula (XI) described above can be used alone or as a mixture thereof.

Examples of the synthesis methods for some compounds represented by formula (XI) and examples of other compounds of formula (XI) are described in JP-B-44-29620, JP-A-50-151149, JP-A-54-95233, and JP-A-61-190537, U.S. Pat. No. 3,766,206, European Patent 57,160, and *Research Disclosure,* No. 22519 (No. 225, 1983). Also, the high molecular weight ultraviolet absorbents described in JP-A-58-111942, JP-A-58-178351, JP-A-58-181041, JP-A-59-19945 and JP-A-59-23344 can be used. Furthermore, a low molecular weight ultraviolet absorbent and a high molecular weight ultraviolet absorbent can be used together.

The above-described ultraviolet absorbent is dispersed in an aqueous hydrophilic colloid as a solution thereof in a high boiling organic solvent and/or a low boiling organic solvent as in the case of the coupler(s). There is no particular restriction on the amounts of the high boiling organic solvent and the ultraviolet absorbent but the high boiling organic solvent is generally used in the range of from 0% to 300% to the weight of the ultraviolet absorbent. It is preferred to use ultraviolet absorbents, which are liquid at normal temperature, alone or as a mixture thereof.

When the ultraviolet absorbent(s) represented by formula (XI) described above are used with the combination of the color couplers described above, the storage stability, in particular, the light fastness of colored dye images, in particular, cyan images, can be improved.

For improving the fastness of yellow images formed to heat and light, many compounds such as phenols, hydroquinones, hydroxychromans, hydroxycoumarans, hydroxyamines, and the alkyl ethers, silyl ethers thereof and the hydrolyzable precursor derivatives thereof can be used but the compounds represented by the following formulae (XII) and (XIII) are effective for simultaneously improving the light fastness and heat fastness of yellow images obtained from the couplers of formula (X) described above:

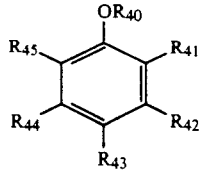

(XII)

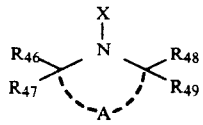

(XIII)

wherein $R_{40}$ represents a hydrogen atom, an aliphatic group, an aromatic group, a heterocyclic group or a substituted silyl group represented by

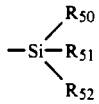

(wherein $R_{50}$, $R_{51}$, and $R_{52}$, which may be the same or different, each represents an aliphatic group, an aromatic group, an aliphatic oxy group, or an aromatic oxy group, each group may be substituted by the substituent allowable for $R_1$ in formula (VI)) $R_{41}$, $R_{42}$, $R_{43}$, $R_{44}$, and $R_{45}$, which may be the same or different, each represents a hydrogen atom, an alkyl group, an aryl group, an alkoxy group, a hydroxy group, a monoalkylamino group, a dialkylamino group, an imino group, or an acylamino group; $R_{46}$, $R_{47}$, $R_{48}$, and $R_{49}$, which may be the same or different, each represents a hydrogen atom or an alkyl group; X represents a hydrogen atom, an aliphatic group, an acyl group, an aliphatic or aromatic sulfinyl group, an oxyradical group, or a hydroxy group; and A represents a nonmetallic atomic group necessary for forming a 5-membered, 6-membered, 7-membered ring.

Examples of the synthesis methods for the compounds represented by formula (XII) or (XIII) and examples of other compounds of the aforesaid formulae are described in British Patents 1,326,889, 1,354,313, 1,410,846, U.S. Pat. Nos. 3,336,135 and 4,268,593, JP-B-51-1420 and JP-B-52-6623, JP-A-58-114036 and JP-A-59-5246.

The compounds represented by formula (XII) and (XIII) may be used alone or as a mixture thereof or a mixture thereof and conventionally known fading inhibitors.

The amount of the compound represented by formula (XII) or (XIII) depends upon the kind of the yellow coupler being used together but is in the range of usually from 0.5 to 200% by weight, and preferably from 2 to 150% by weight, to the amount of the yellow coupler. It is preferred that the compound of formula (XII) or (XIII) is emulsified together with the yellow coupler represented by formula (X).

For the magenta colored dyes formed from the couplers represented by formula (IX), the above-described various dye image stabilizers, stain inhibitors and antioxidants are also effective for improving the storage stability but the compound represented by the following formulae (XIV), (XV), (XVI), (XVII), (XVIII) and (XIX) can greatly improve the light fastness of the dyes and are preferred.

(XIV)

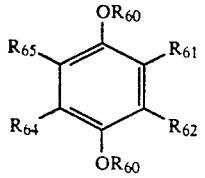

(XV)

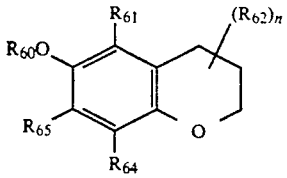

(XVI)

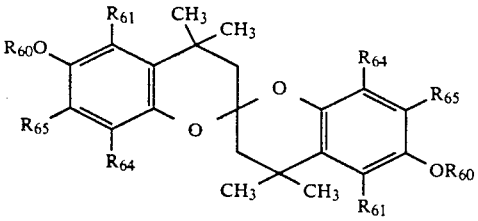

(XVII)

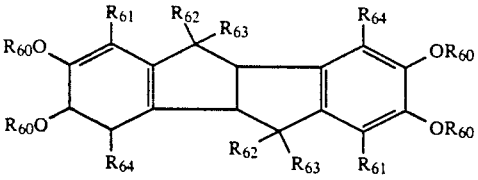

(XVIII)

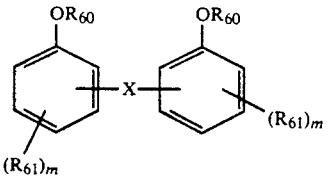

(XIX)

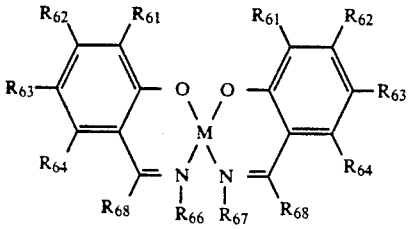

wherein $R_{60}$ has the same significance as $R_{40}$ of formula (XII); $R_{61}$, $R_{62}$, $R_{63}$, $R_{64}$ and $R_{65}$, which may be the same or different, each represents a hydrogen atom, an aliphatic group, an aromatic group, an acylamino group, a mono- or dialkylamino group, an aliphatic or aromatic thio group, an acylamino group, an aliphatic or aromatic oxycarbonyl group, or —$OR_{40}$, said $R_{40}$ and $R_{61}$ may combine with each other to form a 5-membered or 6-membered ring, also said $R_{61y}$ *and* $R_{62}$ may combine together to form a 5-membered or 6-membered ring; X represents a divalent linkage group; $R_{66}$ and $R_{67}$, which may be the same or different, each represents a hydrogen atom, an aliphatic group, an aromatic group, or a hydroxy group; $R_{68}$ represents a hydrogen atom, an aliphatic group, or an aromatic group; $R_{66}$ and $R_{67}$ may form together a 5-membered or 6-membered ring; M represents Cu, Co, Ni, Pd, or Pt; when $R_{61}$ to $R_{68}$ are aliphatic groups or aromatic groups, these groups may be substituted by the substituents allowable for $R_1$ in formula (VI); n represents an integer of from 0 to 3; and m represents an integer of from 0 to 4; n or m means the number of the groups represented b $R_{62}$ or $R_{61}$ and when n or m is 2 or more, the $R_{62}$'s or $R_{61}$'s may be the same or different.

In formula (XVIII), X is preferably

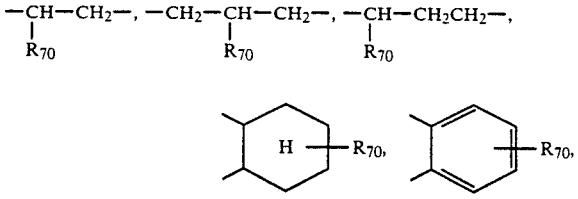

etc., wherein $R_{70}$ represents a hydrogen atom or an alkyl group.

In formula (XIX), $R_{61}$ is preferably a group capable of hydrogen bonding. It is preferred that at least one of $R_{62}$, $R_{63}$ and $R_{64}$ is a hydrogen atom, a hydroxy group, an alkyl group or an alkoxy group and also it is preferred that each of the substituents of $R_{61}$ to $R_{68}$ is a substituent having at least 4 carbon atoms.

The synthesis methods of these compounds are described in U.S. Pat. Nos. 3,336,135, 3,432,300, 3,573,050, 3,574,627, 3,700,455, 3,764,337, 3,935,016, 3,982,944, 4,254,216, and 4,279,990, British Patents 1,347,556, 2,062,888, 2,066,975, and 2,077,455, JP-A-60-97353, JP-A-52-152225, JP-A-53-17729, JP-A-53-20327, JP-A-54-145530, JP-A-55-6321, JP-A-55-21004, JP-A-58-24141, and JP-A-59-10539, JP-B-48-31625 and JP-B-54-12337 together with other aforesaid compounds.

The photographic additives which are used for preparing the color photographic materials processed by the process of the present invention are described in, for example, *Research Disclosure (RD)*, Vol. 176, No. 17643 (December, 1979) and ibid., Vol. 187, No. 18716 (November, 1979), and the corresponding portions thereof are summarized in the following table.

| Additive | RD 17643 | RD 18716 |
|---|---|---|
| 1. Chemical Sensitizer | Page 23 | Page 648, right column |
| 2. Sensitivity Increasing Agent | — | Page 648, right column |
| 3. Spectral Sensitizer | Pages 23–24 | Page 648, right column to page 649, right column |
| 4. Super Color Sensitizer | — | Page 648, right column to page 649, right column |

-continued

| Additive | RD 17643 | RD 18716 |
|---|---|---|
| 5. Whitening Agent | Page 24 | — |
| 6. Antifoggant and Stabilizer | Pages 24–25 | Page 649, right column |
| 7. Coupler | Page 25 | Page 649, right column |
| 8. Organic Solvent | Page 25 | — |
| 9. Light Absorbent, Filter Dye, Ultraviolet Absorbent | Pages 25–26 | Page 649, right column to page 650, left column |
| 10. Stain Inhibitor | Page 25, right column | Page 650, left to right columns |
| 11. Dye Image Stabilizer | Page 25 | — |
| 12. Hardening Agent | Page 26 | Page 651, left column |
| 13. Binder | Page 26 | Page 651, left column |
| 14. Plasticizer, Lubricant | Page 27 | Page 650, right column |
| 15. Coating Aid, Surface Active Agent | Pages 26–27 | Page 650, right column |
| 16. Stain Inhibitor | Page 27 | Page 650, right column |

The color photographic material processed in the present invention is prepared by coating the aforesaid coating compositions on a flexible support such as plastic films (e.g., films of cellulose nitrate, cellulose acetate, polyethylene terephthalate, etc.), papers, etc., or a solid support such as glass plate, etc. Details of the supports and coating methods are described in *Research Disclosure,* Vol. 176, Item 17643, XV (page 27) and XVI (page 28) (December, 1978).

In the present invention, a reflective support is preferably used.

A "reflective support" is a support having high reflectivity for clearly viewing color images formed in the silver halide emulsion layer(s) and includes a support coated with a hydrophobic resin having dispersed therein a light reflective material such as titanium oxide, zinc oxide, calcium carbonate, calcium sulfate, etc., and a support composed of a hydrophobic resin containing the light reflective material described above.

The present invention is further explained in detail by reference to the following examples. Unless otherwise indicated, all parts, percents, ratios and the like are by weight.

EXAMPLE 1

A multilayer color photographic paper having the layer structure shown below on a paper support having a polyethylene coating on both surfaces thereof was prepared. The coating compositions for the layers were prepared as follows.

Preparation of Coating Compositions

In 27.2 ml of ethyl acetate and 7.7 ml (8.0 g) of a high boiling solvent (Solv-1) were dissolved 10.2 g of a yellow coupler (ExY-1), 9.1 g of a yellow coupler (ExY-2), and 4.4 g of a color image stabilizer (Cpd-1) and the solution was dispersed by emulsification in 185 ml of an aqueous 10% gelatin solution containing 8 ml of an aqueous solution of 10% sodium dodecylbenzenesulfonate. The emulsified dispersion was mixed with emulsions EM 1 and EM 2 and the gelatin concentration was adjusted as shown below to provide the coating composition for Layer 1. The coating compositions for Layer 2 to Layer 7 were also prepared in a similar manner to the above. For each layer 1-oxy-3,5-dichloro-s-triazine sodium salt was used as a gelatin hardening agent. Also, a compound (Cpd-2) was used for each layer as a thickener.

Layer Structure

The compositions of the layers are shown below. The numeral indicated is the coating amount ($g/m^2$), wherein the coating amount of silver halide is shown as the calculated silver amount.

In addition, the polyethylene coating of the emulsion side contained in a white pigment ($TiO_2$) and a bluish dye.

| | |
|---|---|
| Layer 1: Blue-Sensitive Emulsion Layer | |
| Monodispersed Silver Chlorobromide Emulsion (EM 1) Spectrally Sensitized by a Sensitizing Dye (ExS-1) | 0.13 |
| Monodispersed Silver Chlorobromide Emulsion (EM 2) Spectrally Sensitized by a Sensitizing Dye (ExS-1) | 0.13 |
| Gelatin | 1.86 |
| Yellow Coupler (ExY-1) | 0.44 |
| Yellow Coupler (ExY-2) | 0.39 |
| Color Image Stabilizer (Cpd-1) | 0.19 |
| Solvent (Solv-1) | 0.35 |
| Layer 2: Color Mixing Inhibition Layer | |
| Gelatin | 0.99 |
| Color Mixing Inhibitor (Cpd-3) | 0.08 |
| Layer 3: Green-Sensitive Emulsion Layer | |
| Monodispersed Silver Chlorobromide Emulsion (EM 3) Spectrally Sensitized by Sensitizing Dyes (ExS-2, ExS-3) | 0.05 |
| Monodispersed Silver Chlorobromide Emulsion (EM 4) Spectrally Sensitized by Sensitizing Dyes (ExS-2, ExS-3) | 0.11 |
| Gelatin | 1.80 |
| Magenta Coupler (ExM-1) | 0.39 |
| Color Image Stabilizer (Cpd-4) | 0.20 |
| Color Image Stabilizer A (Table 1) | 0.02 |
| Color Image Stabilizer B (Table 1) | 0.03 |
| Solvent (Solv-2) | 0.12 |
| Solvent (Solv-3) | 0.25 |
| Layer 4: Ultraviolet Absorption Layer | |
| Gelatin | 1.60 |
| Ultraviolet Absorbents (Cpd-7/Cpd-8/Cpd-9 = 3/2/6 by weight ratio) | 0.70 |
| Color Mixing Inhibitor (Cpd-10) | 0.05 |
| Solvent (Solv-4) | 0.27 |
| Layer 5: Red-Sensitive Emulsion Layer | |
| Monodispersed Silver Chlorobromide Emulsion (EM 5) Spectrally Sensitized by Sensitizing Dyes (ExS-4, ExS-5) | 0.07 |
| Monodispersed Silver Chlorobromide Emulsion (EM 6) Spectrally Sensitized by Sensitizing Dyes (ExS-4, ExS-5) | 0.16 |
| Gelatin | 0.92 |
| Cyan Coupler (ExC-1) | 0.32 |
| Color Image Stabilizers (Cpd-8/Cpd-9/Cpd-12 = 3/4/2 by weight ratio) | 0.17 |
| Dispersing Polymer (Solv-2) | 0.28 |
| Solvent (Solv-2) | 0.20 |
| Layer 6: Ultraviolet Absorption Layer | |
| Gelatin | 0.54 |
| Ultraviolet Absorbents (Cpd-7/Cpd-9/Cpd-12 = 1/5/3 by weight ratio) | 0.21 |
| Solvent (Solv-2) | 0.08 |
| Layer 7: Protective Layer | |
| Gelatin | 1.33 |
| Acryl-Modified Copolymer of Polyvinyl Alcohol (modified degree: 17%) | 0.17 |
| Liquid Paraffin | 0.03 |

Also, in this case, compounds (Cpd-13) and (Cpd-14) were used as irradiation inhibiting dyes.

Furthermore, for each layer were used Alkanol XC (made by Du Pont), sodium alkylbenzenesulfonate, succinic acid ester, and Magefacx F-120 (made by Dainippon Ink and Chemicals, Inc.) as emulsification dispersing agents and coating aid. Also, compounds (Cpd-15 and Cpd-16) were used as a stabilizer for silver halide.

The details of the silver halide emulsions used were as follows.

| Emulsion | Grain Size (μm) | Br Content (mol %) | Coefficient of Variation |
|---|---|---|---|
| EM 1 | 1.0 | 80 | 0.08 |

-continued

| Emulsion | Grain Size (μm) | Br Content (mol %) | Coefficient of Variation |
|---|---|---|---|
| EM 2 | 0.75 | 80 | 0.07 |
| EM 3 | 0.5 | 83 | 0.09 |
| EM 4 | 0.4 | 83 | 0.10 |
| EM 5 | 0.5 | 73 | 0.09 |
| EM 6 | 0.4 | 73 | 0.10 |

The structures of the compounds used are as follows.

ExY-1 ((X)-32)

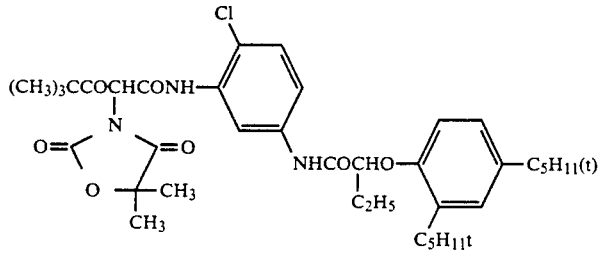

ExY-2 ((X)-31)

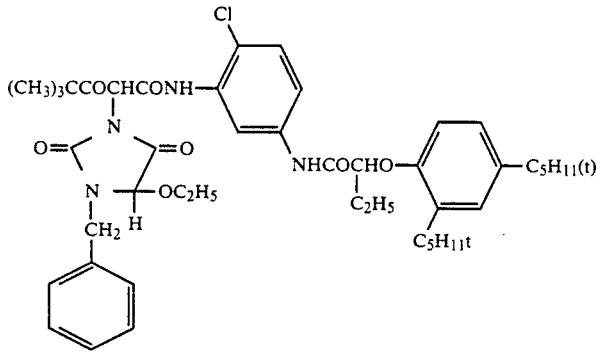

ExM-1 ((IX)-11)

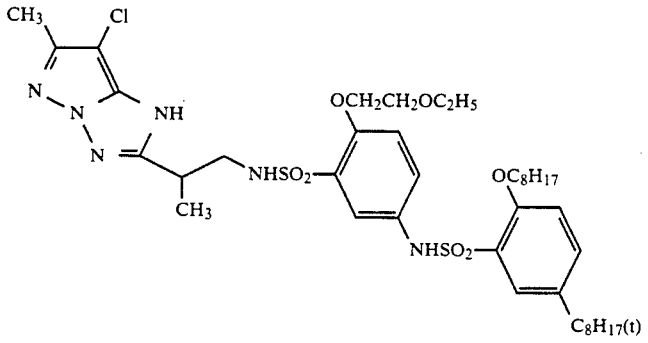

ExC-1 ((VII)-14)

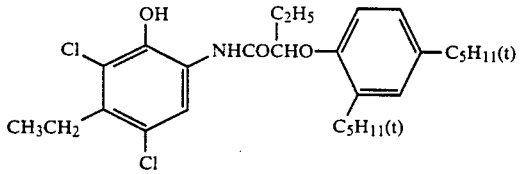

ExS-1

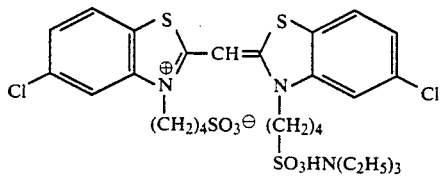

-continued
ExS-2
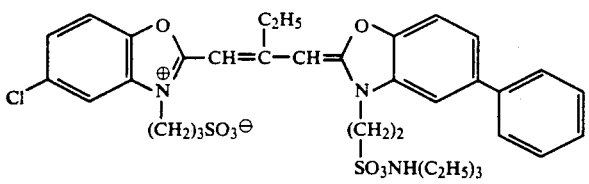
ExS-3
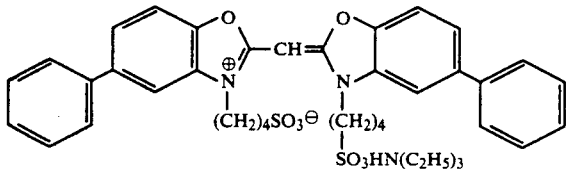
ExS-4
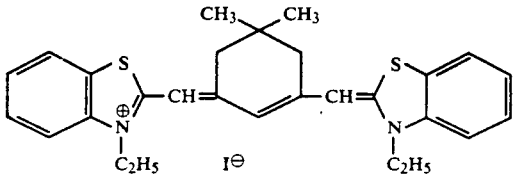
ExS-5
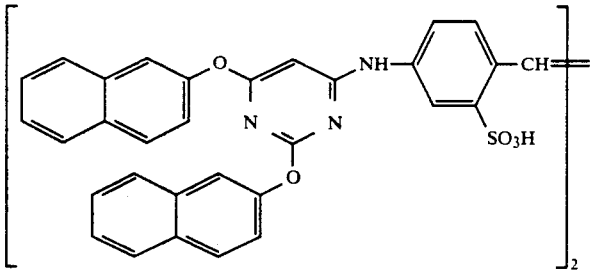
Cpd-1
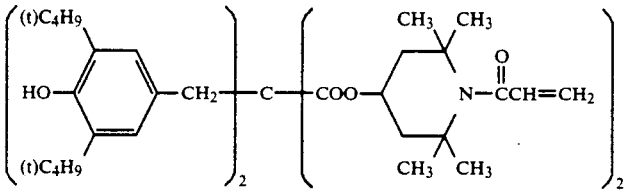
Cpd-2
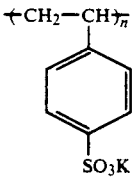
Cpd-3
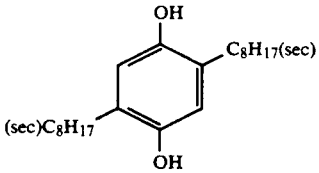
Cpd-4
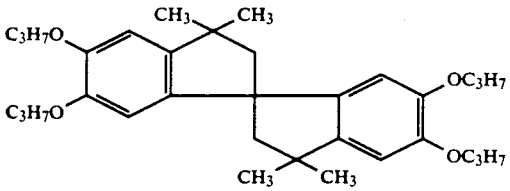

-continued
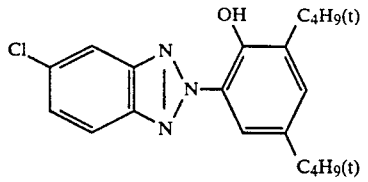
Cpd-7
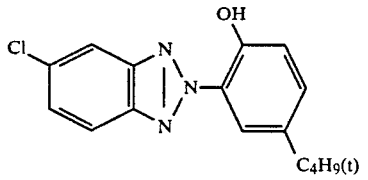
Cpd-8
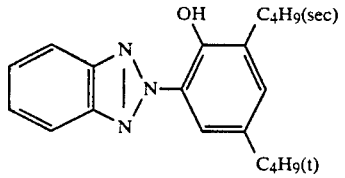
Cpd-9
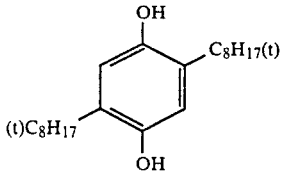
Cpd-10
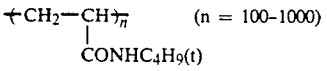
Cpd-11
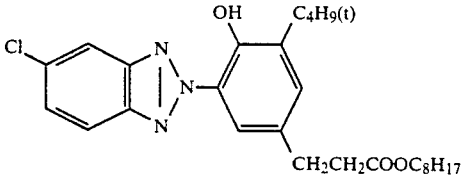
Cpd-12
| | |
|---|---|
| Dibutyl Phthalate | Solv-1 |
| Tricresyl Phosphate | Solv-2 |
| Trioctyl Phosphate | Solv-3 |
| Trinonyl Phosphate | Solv-4 |
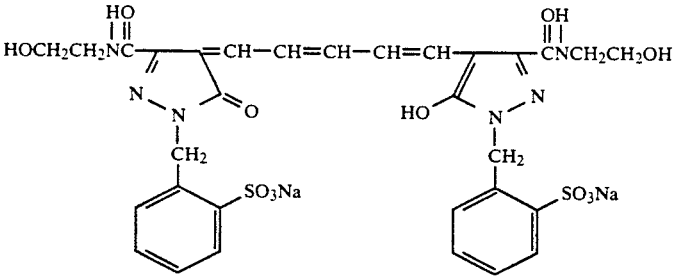
Cpd-13
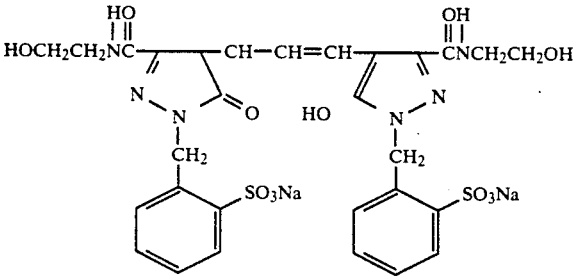
Cpd-14

-continued

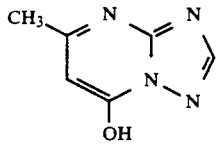

Cpd-15

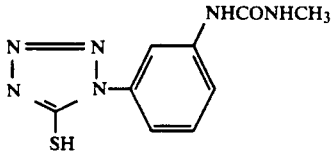

Cpd-16

Thus, by changing the color image stabilizers in Layer 3 as shown in the following table, Samples I-A, I-B, I-C, I-D, I-E, I-F and I-G were prepared.

| Sample | Color Image Stabilizer A | Color Image Stabilizer B |
|---|---|---|
| I-1 | — | — |
| I-B | (A-1) | — |
| I-C | (A-3) | — |
| I-D | — | (A-31) |
| I-E | — | (A-40) |
| I-F | (A-1) | (A-31) |
| I-G | (A-17) | — |

Each of the samples prepared was wedge-exposed at 250CMS and processing using the following processing steps.

| Processing Step | Temperature (°C.) | Time |
|---|---|---|
| Color Development | 38 | 3 min 30 sec |
| Blix | 33 | 1 min 30 sec |
| Wash (1) | 30–34 | 60 sec |
| Wash (2) | 30–34 | 60 sec |
| Wash (3) | 30–34 | 60 sec |
| Drying | 70–80 | 50 sec |

The wash step was performed in a 3 tank countercurrent system of wash (3) to (1).

Color Developer

The concentrated color developer composition divided into the following parts was prepared.

| | |
|---|---|
| Part A | |
| Hydroxylamine Sulfate | 290 g |
| Lithium Chloride | 135 g |
| Water to make | 1 liter |
| pH | 6.0 |
| Part B | |
| 4-Amino-3-methyl-N-ethyl-N-[β-(methanesulfonamido)ethyl]aniline Sulfate (FCD-03) | 200 g |
| Optical Whitening Agent (4,4'-diaminostilbene series) | 15 g |
| Benzyl Alcohol | 550 ml |
| Diethylene Glycol | 300 ml |
| Sodium Sulfite | 26 g |
| Water to make | 1 liter |
| pH | 0.60 |
| Part C | |
| Sodium Sulfite | 25 g |
| Potassium Carbonate | 500 g |
| 1-Hydroxyethylidene-1,1-diphosphonic Acid | 40 g |
| Potassium Hydroxide | 100 g |
| Water to make | 1 liter |

-continued

| | |
|---|---|
| pH | 12.0 |
| Starter | |
| Potassium Bromide | 55 g |
| Potassium Carbonate | 42 g |
| Potassium Hydrogencarbonate | 180 g |
| Water to make | 1 liter |
| pH | 8.5 |

Each of Part A, Part B, Part C and Starter was placed in a plastic container and after allowing each to stand for 3 months at 35° C., a color developer for use was prepared as follows.

| | |
|---|---|
| Water | 700 ml |
| Part A | 14 ml |
| Part B | 26 ml |
| Part C | 40 ml |
| Starter | 24 ml |
| Water to make | 1 liter |
| pH | 10.10 |

| Blix Solution | |
|---|---|
| Water | 400 ml |
| Ammonium Thiosulfate (700 g/l aq. soln.) | 200 ml |
| Sodium Sulfite | 20 g |
| Ethylenediaminetetraacetic Acid Iron (III) Ammonium | 60 g |
| Ethylenediaminetetraacetic Acid Disodium | 5 g |
| Water to make | 1 liter |
| pH | 6.70 |

Each sample thus processed was allowed to stand for 2 months at 80° C. and the amount ($\Delta D_G$min) of increase in the magenta minimum density was measured by a Macbeth densitometer. Also, after irradiating each sample thus processed with a xenon light of 8,500 lux for 20 days, the amount ($\Delta D_B$min) of the yellow minimum density increase was also measured. The results obtained are shown in Table 1 below.

TABLE 1

| Sample | Remarks | Stain with the Passage of Time $\Delta D_G$min | $\Delta D_B$min |
|---|---|---|---|
| I-A | Comparison | +0.32 | +0.12 |
| I-B | Invention | +0.17 | +0.06 |
| I-C | " | +0.16 | +0.07 |
| I-D | " | +0.16 | +0.06 |
| I-E | " | +0.17 | +0.05 |
| I-F | " | +0.13 | +0.07 |
| I-G | " | +0.18 | +0.07 |

As shown by the above results, according to the present invention, the occurrence of magenta stain by heat and the occurrence of yellow stain by light are markedly less.

EXAMPLE 2

By following the same procedure as for Sample I-B in Example 1 except that each of color image stabilizers (A-2), (A-5), (A-6), (A-9), (A-12), (A-16), (A-23), (A-26), (A-30), (A-34), (A-37), (A-42) and (A-45) was used in place of the color image stabilizer (A-1), each sample was prepared. When each sample was processed and tested as in Example 1, an excellent performance having less increase in minimum densities after processing was obtained in each sample.

EXAMPLE 3

By following the same procedure as in Example 1 except that the couplers are changed as shown in the following table, Samples II-A, II-B, II-C, II-D, II-E and II-F were prepared.

| Sample No. | Yellow Coupler | Magenta Coupler | Cyan Coupler |
|---|---|---|---|
| II-A | (X-32)<br>(X-31) | (VIII-1) | (VII-26) |
| II-B | (X-32) | (VIII-13) | (VII-1) (50 mol %)<br>(VI-5) (50 mol %) |
| II-C | (X-31) | (VIII-13) | (VII-14) |
| II-D | Y-a | M-a | C-a |
| II-E | Y-b | M-c | (VII-14) |
| II-F | (X-32) | M-b | C-a |

The compounds shown in the above table were as follows.

M-c

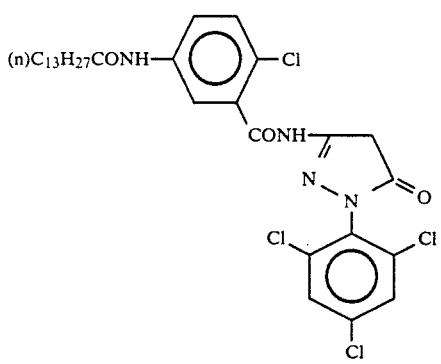

Y-a

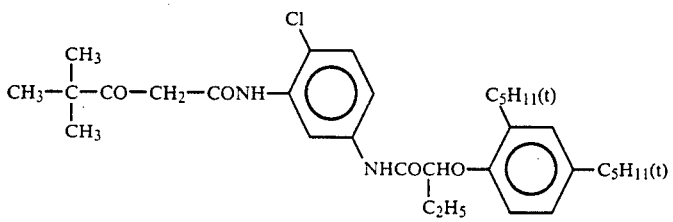

Y-b

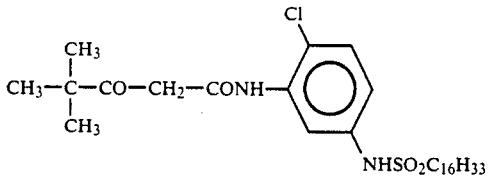

M-a

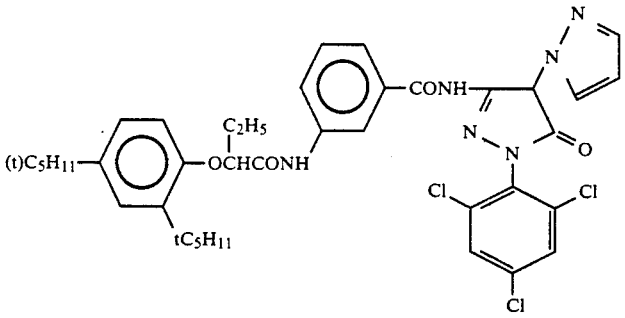

-continued

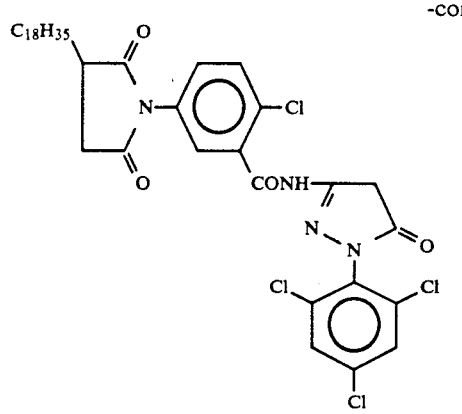

M-b

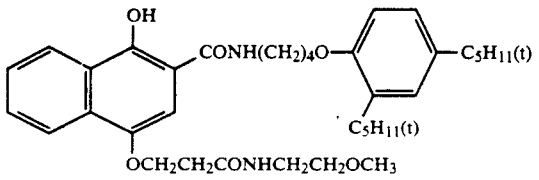

C-a

In the case of using Couplers (VIII-1), M-a, M-b, M-c, Y-a and Y-b, the amount of the corresponding coating silver amount was increased to twice the amount.

Furthermore, Samples (a) contained Compounds (A-1) and (A-31) in each coupler-containing layer and Samples (b) did not contain such couplers.

Then, each sample was processed by the same manner as in Example 1, the samples thus processed were allowed to stand for 1 month at 80° C., and then the increase in Dmin was measured. The results obtained are shown in Table 2 below.

TABLE 2

| Test No. | Sample No. | ΔDmin (after 1 month at 80° C.) B | G | R | Remarks |
|---|---|---|---|---|---|
| 1 | II-A-b | +0.25 | +0.15 | +0.10 | Comparison |
| 2 | II-B-b | +0.20 | +0.20 | +0.11 | " |
| 3 | II-C-b | +0.20 | +0.21 | +0.13 | " |
| 4 | II-D-b | +0.19 | +0.19 | +0.12 | " |
| 5 | II-E-b | +0.19 | +0.20 | +0.12 | " |
| 6 | II-F-b | +0.19 | +0.21 | +0.11 | " |
| 7 | II-A-a | +0.11 | +0.08 | +0.05 | Invention |
| 8 | II-B-a | +0.10 | +0.09 | +0.05 | " |
| 9 | II-C-a | +0.10 | +0.09 | +0.05 | " |
| 10 | II-D-a | +0.13 | +0.14 | +0.09 | " |
| 11 | II-E-a | +0.14 | +0.15 | +0.07 | " |
| 12 | II-F-a | +0.12 | +0.15 | +0.08 | " |

As shown in Table 2, according to the present invention, the increase in Dmin (stain) with the passage of time is greatly reduced and the effect is particularly marked in the case of using the yellow, magenta, and cyan couplers described above as the preferred couplers in the present invention (Sample Nos. 7, 8, and 9).

EXAMPLE 4

By following the same procedure as in Example 3 except that the yellow, magenta, and cyan couplers were changed as shown in the following table, Samples II-G to II-P were prepared.

| Sample No. | Yellow Coupler | Magenta Coupler | Cyan Coupler |
|---|---|---|---|
| II-G | (X-1) | (VIII-2) | (VI-10) |
| II-H | (X-2) | (VIII-5) | (VI-11) |
| II-I | (X-4) | (VIII-11) | (VI-23) |
| II-J | (X-7) | (VIII-13) | (VI-25) |
| II-K | (X-9) | (IX-1) | (VI-30) |
| II-L | (X-17) | (IX-2) | (VI-37) |
| II-M | (X-20) | (IX-7) | (VI-42) |
| II-N | (X-24) | (IX-11) | (VI-45) |
| II-O | (X-31) | (IX-13) | (VII-26) |
| II-P | (X-34) | (IX-14) | (VII-28) |

Samples (a) and (b) were prepared by the same manner as in Example 3 and processed similarly, Samples (a) containing the compounds in the present invention gave less increase in Dmin.

EXAMPLE 5

Concentrated color developer compositions were prepared while changing Part B in Example 1 as follows.

| Composition | Part B 1 | 2 | 3 | 4 | 5 | 6 |
|---|---|---|---|---|---|---|
| FCD-03 (g) | 200 | 200 | 200 | 200 | 200 | 200 |
| Optical Whitening Agent (g) | 15 | 15 | 15 | 15 | 15 | 15 |
| Benzyl Alcohol (ml) | 550 | 550 | 550 | 550 | 550 | 550 |
| Diethylene Glycol (ml) | 300 | 300 | 300 | 300 | 300 | 300 |
| Sodium Sulfite (g) | 26 | 26 | 26 | 13 | 39 | 60 |
| Water to make | 1 | 1 | 1 | 1 | 1 | 1 |
| pH | 0.5 | 1.5 | 5.0 | 1.5 | 1.5 | 1.5 |

Then, after allowing each to stand for 3 months at 35° C. as in Example 1, a color developer for use was prepared as in Example 1.

Then, Samples I-A to I-F were processed as in Example 1 using each color developer, the samples thus processed were allowed to stand for 2 months at 80° C., and then the amount ($\Delta D_G$min) of increase in the magenta minimum density was measured. Also, after irradiating the samples thus processed by xenon light for 20 days, the amount ($\Delta D_B$min) of increase in the yellow minimum density was measured.

The results obtained are shown in Table 3 below.

TABLE 3

| Test No. | Sample No. | Part B No. | Remarks | Stain with the Passage of Time $\Delta D_G$min | $\Delta D_B$min |
|---|---|---|---|---|---|
| 1 | I-A | 1 | Comparison | +0.34 | +0.13 |
| 2 | " | 2 | " | +0.22 | +0.10 |
| 3 | " | 3 | " | +0.30 | +0.14 |
| 4 | " | 4 | " | +0.24 | +0.12 |
| 5 | " | 5 | " | +0.19 | +0.08 |
| 6 | " | 6 | " | +0.19 | +0.10 |
| 7 | I-F | 1 | Invention | +0.14 | +0.08 |
| 8 | " | 2 | " | +0.07 | +0.05 |
| 9 | " | 3 | " | +0.12 | +0.08 |
| 10 | " | 4 | " | +0.09 | +0.07 |
| 11 | " | 5 | " | +0.05 | +0.04 |
| 12 | " | 6 | " | +0.05 | +0.06 |

As shown in Table 3, according to the present invention, the increase in stain with the passage of time is greatly reduced, in particular, when Part B has a preferred pH value, the effect is better (Test Nos. 8, 10, 11 and 12). However, when the sulfite ion concentration is high (Sample Nos. 11 and 12), excellent results are obtained.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide color photographic material, which comprises processing an image-wise exposed silver halide color photographic material containing at least one compound represented by formula (IV):

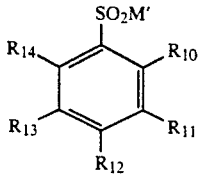

(IV)

wherein M' represents an atom or an atomic group which forms an inorganic salt or an organic salt,

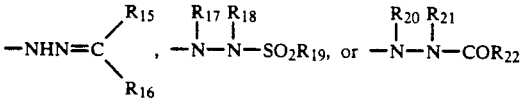

wherein $R_{15}$ and $R_{16}$, which may be the same or different, each represents a hydrogen atom or an aliphatic group, aromatic group or heterocyclic group, and $R_{15}$ and $R_{16}$ may combine with each other to form a 5-membered to 7-membered ring; $R_{17}$, $R_{18}$, $R_{20}$, and $R_{21}$, which may be the same or different, each represent a hydrogen atom, aliphatic group, aromatic group or heterocyclic group; $R_{17}$, $R_{18}$, $R_{20}$, and $R_{21}$ further represent an acyl group, an alkoxycarbonyl group, a sulfonyl group, a ureido group, or a urethane group; at least one of $R_{17}$ and $R_{18}$ and at least one of $R_{20}$ and $R_{21}$ is a hydrogen atom;

$R_{19}$ and $R_{22}$ each represents a hydrogen atom or an aliphatic group, aromatic group or heterocyclic group; $R_{22}$ further represents an alkylamino group, an arylamino group, an alkoxy group, an aryloxy group, an acyl group, an alkoxycarbonyl group, or an aryloxycarbonyl group;

at least two of $R_{17}$, $R_{18}$, and $R_{19}$ may combine with each other to form a 5-membered to 7-membered ring, and at least two of $R_{20}$, $R_{21}$, and $R_{22}$ may combine with each other to form a 5-membered to 7-membered ring;

$R_{10}$, $R_{11}$, $R_{12}$, $R_{13}$, and $R_{14}$, which may be the same or different, each represents a hydrogen atom, an aliphatic group, an aromatic group, a heterocyclic group, a halogen atom, $-SR_8$, $-OR_8$,

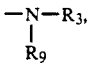

an acyl group, an alkoxycarbonyl group, an aryloxycarbonyl group, a sulfonyl group, a sulfonamide group, a sulfamoyl group, a ureido group, a urethane group, a carbamoyl group, a sulfo group, a carboxy group, a nitro group, a cyano group, an alkoxalyl group, an allyoxalyl group, a sulfonyloxy group, $-P(R_8)_3$,

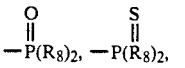

$-P(OR_8)_3$, or a formyl group; wherein $R_8$ and $R_9$ each represents a hydrogen atom, an aliphatic group, an alkoxy group, or an aromatic group, with a color developer prepared by diluting a concentrated color developer composition containing from 90 ml/liter to 600 ml/liter of benzyl alcohol and from 0.07 mol/liter to 0.5 mol/liter of an aromatic primary amine color developing agent, said concentrated color developer composition after storage contains a compound formed by the reaction of benzyl alcohol and the color developing agent which adversely affects the storage stability of the processed photographic material, and the compound of formula (IV) prevents staining of the processed photographic material due the presence of the compound formed by the reaction of benzyl alcohol and the color developing agent.

2. The process for processing a silver halide color photographic material as claimed in claim 1, wherein the aliphatic group for $R_{15}$ and $R_{16}$ is a straight chain, branched or cyclic alkyl group, an alkenyl group, or an alkynyl group, the aromatic group is an aromatic carbocyclic group or an aromatic heterocyclic group and the heterocyclic ring is a 3-membered to 10-membered ring containing carbon atoms and oxygen atoms, and nitrogen atoms and sulfur atoms as hetero atoms.

3. The process for processing a silver halide color photographic material as claimed in claim 1, wherein the benzyl alcohol is present in an amount of from 250 ml/liter to 550 ml/liter and the aromatic amine color developing agent is present in an amount of from 0.15 mol/liter to 0.45 mol/liter.

4. The process for processing a silver halide color photographic material as claimed in claim 1, wherein the pH of said concentrated color developer composition is from 0.1 to 5.

5. The process for processing a silver halide color photographic material as claimed in claim 1, wherein the concentrated color developer composition further contains one or more additives selected from the group consisting of a sulfite, an alkanolamine, a glycol, a chelating agent, an optical whitening agent and a surface active agent.

6. The process for processing a silver halide color photographic material as claimed in claim 1, wherein said silver halide color photographic material contains a cyan couplers represented by formula (VI) or (VII):

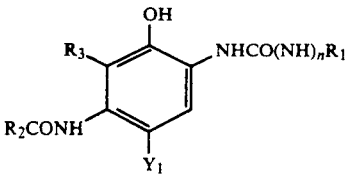

(VI)

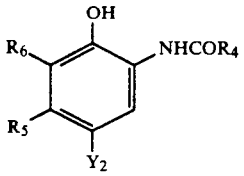

(VII)

wherein $R_1$, $R_2$, and $R_4$ each represents a substituted or unsubstituted aliphatic group, a substituted or unsubstituted aromatic group, a substituted or unsubstituted heterocyclic group; $R_3$, $R_5$, and $R_6$ each represents a hydrogen atom, a halogen atom, an aliphatic group, an aromatic group, or an acylamino group, $R_3$ may represent a nonmetallic atomic group forming a 5-membered or 6-membered nitrogen-containing ring together with $R_2$; $Y_1$ and $Y_2$ each represents a hydrogen atom or a group that can be released on coupling reaction with the oxidation product of an aromatic primary amine color developing agent; and n represents 0 to 1.

7. The process for processing a silver halide color photographic material as claimed in claim 1, wherein said silver halide color photographic material contains a magenta coupler represented by formula (VIII) or (IX):

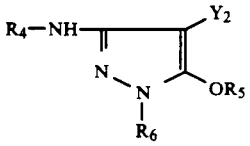

(VIII)

wherein $R_4$ and $R_6$ each represents an aryl group; $R_5$ represents a hydrogen atom, an aliphatic acyl group, an aromatic acyl group, an aliphatic sulfonyl group, or an aromatic sulfonyl group; and $Y_2$ represents a hydrogen atom or a releasing group;

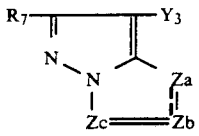

(IX)

wherein $R_7$ represents a hydrogen atom or a substituent; $Y_3$ represents a hydrogen atom or a releasing group; and Za, Zb and Zc each represents methine, substituted methine, =N—, or —NH—; one of the Za—Zb bond and the Zb—Zc bond is a double bond and the other is a single bond.

8. The process for processing a silver halide color photographic material as claimed in claim 1, wherein said silver halide color photographic material contains a yellow coupler represented by formula (X):

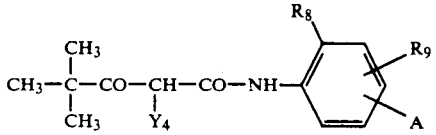

(X)

wherein $R_8$ represents a halogen atom or an alkoxy group; $R_9$ represents a hydrogen atom, a halogen atom, or an alkoxy group; A represents $—NHCOR_{10}$, $—NHSO_2—R_{10}$, $—SO_2NHR_{10}$, $—COOR_{10}$, or $$—SO_2\underset{\underset{R_{11}}{|}}{N}—R_{10}$$

(wherein $R_{10}$ and $R_{11}$ each represents an alkyl group); and $Y_4$ represents a releasing group.

9. The process for processing a silver halide color photographic material as claimed in claim 1, wherein the pH of said concentrated color developer composition is from 1.0 to 4.

10. The process for processing a silver halide color photographic material as claimed in claim 1, wherein said concentrated color developer composition contains a sulfite in the range of from 0.1 to 1.3 as mol ratio to the color developing agent.

11. The process for processing a silver halide color photographic material as claimed in claim 1, wherein said concentrated color developer composition contains a sulfite in the range of from 0.4 to 1.0 as mol ratio to the color developing agent.

12. The process for processing a silver halide color photographic material as claimed in claim 1, wherein the aliphatic group for $R_{19}$ and $R_{22}$ is a straight chain, branched or cyclic alkyl group, an alkenyl group, or an alkynyl group, the aromatic group is an aromatic carbocyclic group or an aromatic heterocyclic group and the heterocyclic group is a 3-membered to 10-membered ring containing carbon atoms and at least one of oxygen atoms, nitrogen atoms and sulfur atoms as hetero atoms.

* * * * *